US008002201B2

(12) United States Patent
Marino

(10) Patent No.: US 8,002,201 B2
(45) Date of Patent: Aug. 23, 2011

(54) HOSE NOZZLE APPARATUS AND METHOD

(75) Inventor: Robert M. Marino, Springdale, AR (US)

(73) Assignee: Watershield LLC, Englewood, CO (US)

( * ) Notice: Subject to any disclaimer, the term of this patent is extended or adjusted under 35 U.S.C. 154(b) by 353 days.

(21) Appl. No.: 12/172,249

(22) Filed: Jul. 13, 2008

(65) Prior Publication Data

US 2009/0020629 A1 Jan. 22, 2009

Related U.S. Application Data

(63) Continuation of application No. 11/456,839, filed on Jul. 11, 2006, now abandoned, which is a continuation of application No. 10/306,273, filed on Nov. 27, 2002, now Pat. No. 7,097,120.

(60) Provisional application No. 60/346,452, filed on Jan. 4, 2002, provisional application No. 60/346,320, filed on Jan. 4, 2002, provisional application No. 60/339,526, filed on Dec. 7, 2001, provisional application No. 60/338,787, filed on Dec. 5, 2001, provisional application No. 60/338,609, filed on Dec. 5, 2001, provisional application No. 60/338,612, filed on Dec. 5, 2001, provisional application No. 60/334,376, filed on Nov. 29, 2001.

(51) Int. Cl.
*B05B 17/04* (2006.01)

(52) U.S. Cl. ..... 239/11; 239/455; 239/452; 239/435; 239/539; 239/590

(58) Field of Classification Search ..... 239/452, 239/453, 539, 583, 435, 590, 11, 455
See application file for complete search history.

(56) References Cited

U.S. PATENT DOCUMENTS

| | | | | |
|---|---|---|---|---|
| 22,819 | A | * | 2/1859 | Parrott et al. |
| 186,310 | A | * | 1/1877 | Curtis |
| 351,968 | A | * | 11/1886 | Derrick |
| 583,135 | A | * | 5/1897 | Wilson |
| 584,197 | A | * | 6/1897 | Snider |
| 603,144 | A | * | 4/1898 | Kellerman et al. |
| 690,754 | A | * | 1/1902 | McKechney |
| 692,571 | A | * | 2/1902 | Wieman |
| 721,665 | A | * | 3/1903 | Busha |
| 851,603 | A | * | 4/1907 | Long |
| 930,095 | A | * | 8/1909 | Seagrave |
| 1,004,770 | A | * | 10/1911 | Galloway |
| 1,040,899 | A | * | 10/1912 | Dahmen |

(Continued)

OTHER PUBLICATIONS

"Sabert Jet Nozzles"; *Akron Brass Company* (Internet Advertisement); 2001; 3 pgs.; http://www.akronbrass.com/products/saberjet.htm.

(Continued)

*Primary Examiner* — Dinh Q Nguyen
(74) *Attorney, Agent, or Firm* — Sheridan Ross P.C.

(57) ABSTRACT

A device and method are provided for regulating two types of flow from a nozzle. The first flow is a deluge stream and the second flow is a fog spray. The deluge stream is controlled by the nozzle operator using a first flow control valve, such as a ball valve. The fog spray is controlled by the nozzle operator using a second flow control valve. The nozzle permits the nozzle operator to manually control the flow of the nozzle, thereby permitting quick regulation and adjustment of flow types and amounts to accommodate then existing fluid pressure and supply conditions to address fluid application needs.

14 Claims, 57 Drawing Sheets

U.S. PATENT DOCUMENTS

| | | | | | |
|---|---|---|---|---|---|
| 1,072,951 | A | * | 9/1913 | Johnston | |
| 1,132,935 | A | * | 3/1915 | Hopkins | |
| 1,823,277 | A | * | 9/1931 | Lum | |
| 1,865,012 | A | * | 6/1932 | Jackson | 366/11 |
| 1,893,298 | A | * | 1/1933 | Moore | |
| 2,176,699 | A | | 10/1939 | Anderson | |
| 2,271,800 | A | | 2/1942 | Meussdorffer | |
| 2,303,992 | A | | 12/1942 | Frazer et al. | |
| 2,331,741 | A | | 10/1943 | Smith | |
| 2,389,642 | A | | 11/1945 | Schellin et al. | |
| 2,567,176 | A | | 9/1951 | Ballard | |
| 2,569,996 | A | | 10/1951 | Kollsman | |
| 2,585,509 | A | * | 2/1952 | Smith | 239/533.13 |
| 2,959,359 | A | | 11/1960 | Casaletto | |
| 2,991,016 | A | | 7/1961 | Allenbaugh, Jr. | |
| 3,016,792 | A | | 1/1962 | Brucker | |
| 3,163,363 | A | | 12/1964 | Travis | |
| 3,204,664 | A | | 9/1965 | Gorchev et al. | |
| 3,301,492 | A | | 1/1967 | Kingsley | |
| 3,363,842 | A | | 1/1968 | Burns | |
| 3,539,112 | A | | 11/1970 | Thompson | |
| 3,647,002 | A | * | 3/1972 | Lindsay | 169/16 |
| 3,684,192 | A | | 8/1972 | McMillan | |
| 3,776,470 | A | | 12/1973 | Tsuchiya | |
| 3,837,362 | A | | 9/1974 | Barnes | |
| 3,863,844 | A | | 2/1975 | McMillan | |
| 4,172,559 | A | | 10/1979 | Allenbaugh, Jr. | |
| 4,252,278 | A | | 2/1981 | McMillan | |
| 4,289,277 | A | | 9/1981 | Allenbaugh | |
| 4,342,426 | A | | 8/1982 | Gagliardo | |
| 4,358,058 | A | | 11/1982 | Bierman | |
| 4,383,550 | A | | 5/1983 | Sotokazu | |
| 4,436,111 | A | | 3/1984 | Gold et al. | |
| 4,589,439 | A | | 5/1986 | Steingass | |
| 4,653,693 | A | | 3/1987 | Steingass | |
| 4,770,212 | A | | 9/1988 | Wienck | |
| 4,785,998 | A | | 11/1988 | Takagi | |
| 4,944,460 | A | | 7/1990 | Steinglass et al. | |
| 4,982,897 | A | | 1/1991 | Matusita et al. | |
| 5,215,254 | A | | 6/1993 | Haruch | |
| 5,261,494 | A | | 11/1993 | McLoughlin et al. | |
| 5,312,048 | A | | 5/1994 | Steingass et al. | |
| 5,390,696 | A | | 2/1995 | Bird et al. | |
| 5,593,092 | A | | 1/1997 | McMillan et al. | |
| 5,775,596 | A | | 7/1998 | Whisman et al. | |
| 5,848,752 | A | | 12/1998 | Kolacz et al. | |
| D414,243 | S | * | 9/1999 | Steingass et al. | |
| 5,964,410 | A | | 10/1999 | Brown et al. | |
| 6,007,001 | A | | 12/1999 | Hilton | |
| 6,039,269 | A | | 3/2000 | Mandzukic | |
| 6,089,474 | A | | 7/2000 | Marino | |
| 6,102,308 | A | | 8/2000 | Steingass et al. | |
| 6,109,360 | A | | 8/2000 | Mandzukic et al. | |
| 6,113,004 | A | | 9/2000 | Steingass et al. | |
| 6,173,940 | B1 | | 1/2001 | Kardohely et al. | |
| 6,305,621 | B1 | | 10/2001 | Kolacz et al. | |
| 6,354,320 | B1 | | 3/2002 | Kolacz et al. | |
| 6,598,810 | B2 | | 7/2003 | Lanteri | |
| 6,749,027 | B1 | * | 6/2004 | Crabtree et al. | 169/44 |
| 7,097,120 | B2 | | 8/2006 | Marino | |
| 7,258,285 | B1 | | 8/2007 | Combs et al. | |
| 2003/0127541 | A1 | | 7/2003 | Marino | |
| 2005/0017095 | A1 | | 1/2005 | Mehr | |

OTHER PUBLICATIONS

"What Goes Around . . . Comes Around . . . ", *Task Force Tips*; Sep. 4, 2001; 2 pgs. (Advertisement).

* cited by examiner

Fig. 9
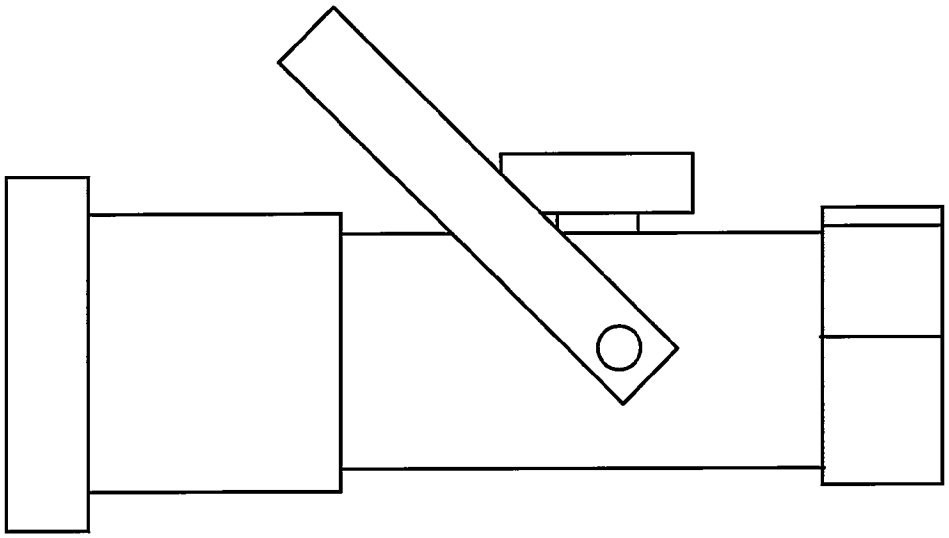
Fig. 10
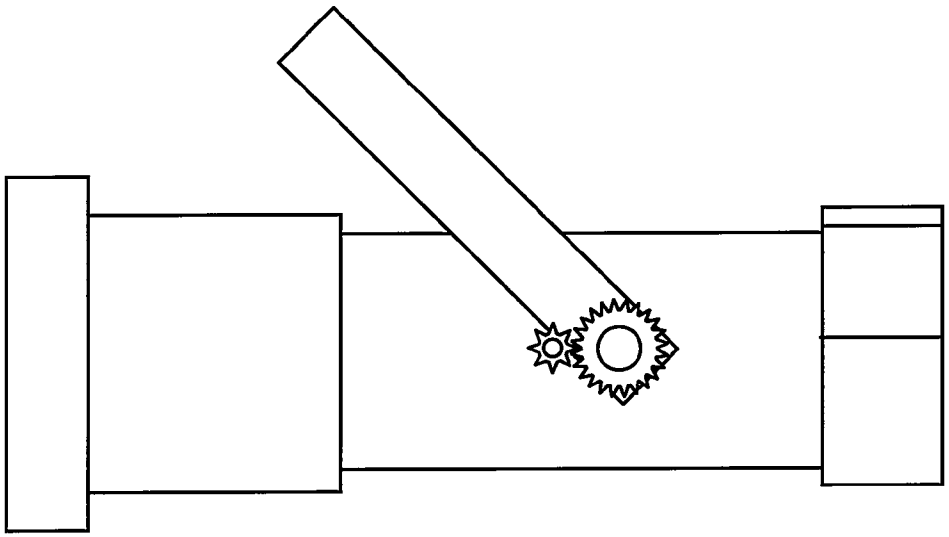
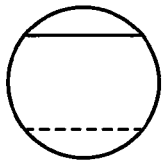

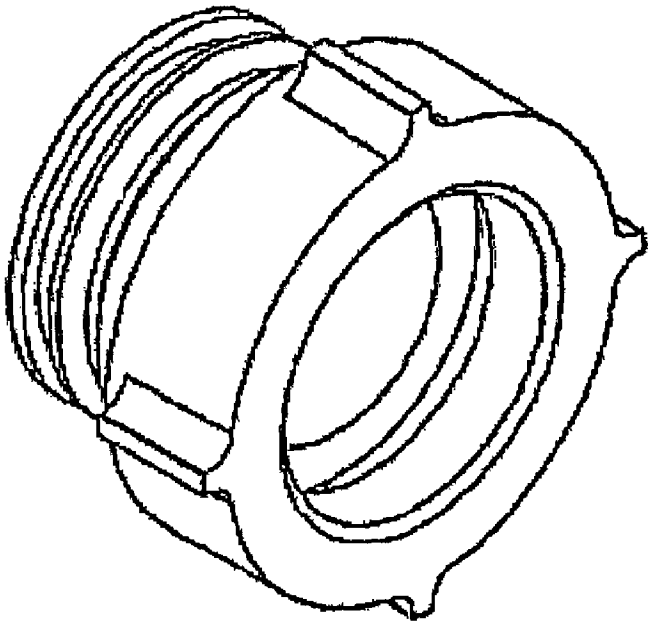
FIG. 15.1
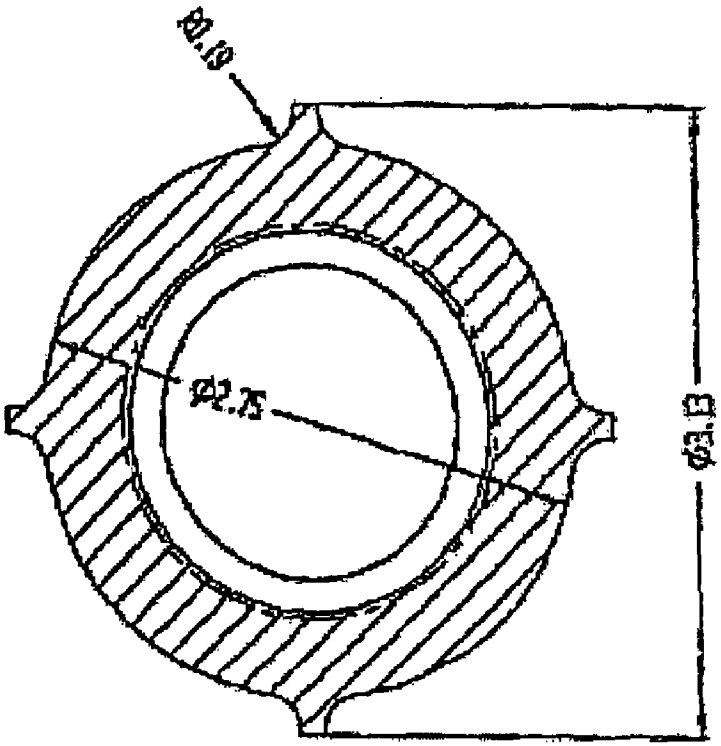
SECTION D-D
FIG. 15.3

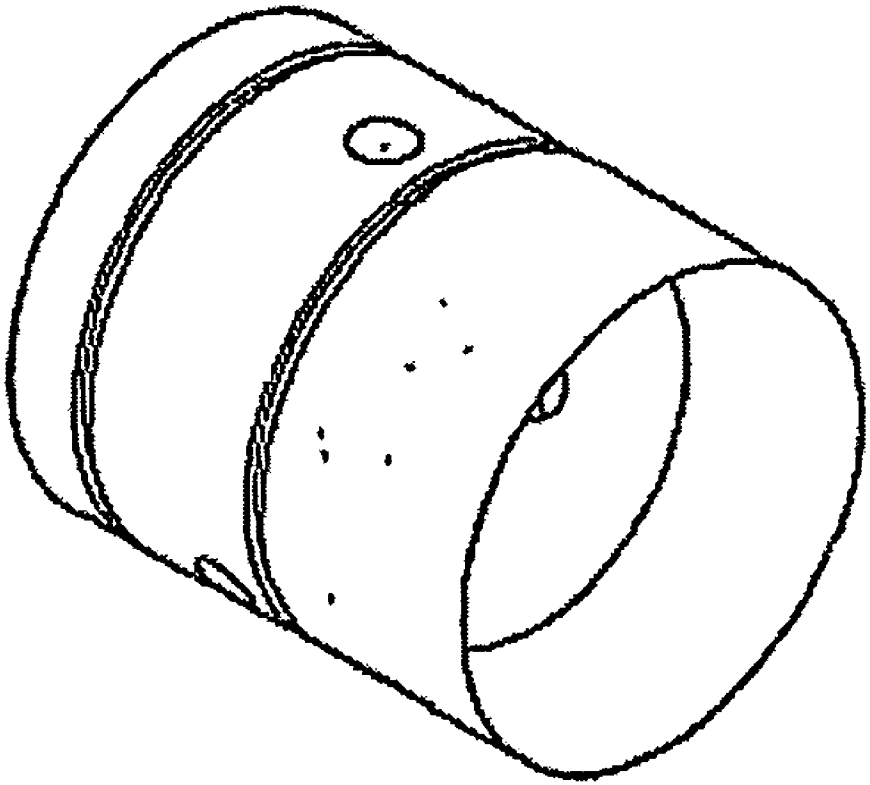
FIG. 16.1

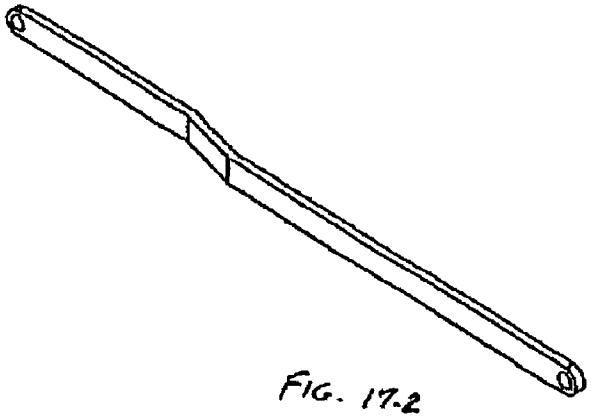
FIG. 17.2
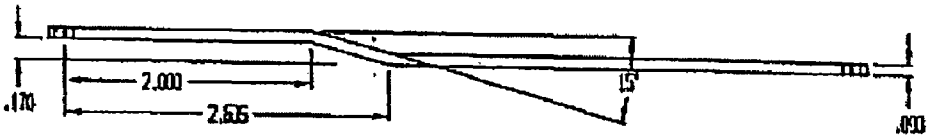
FIG. 17
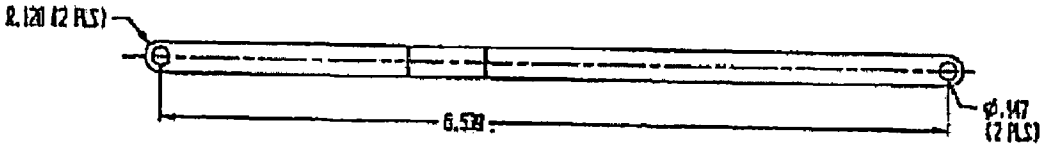
FIG. 17.1

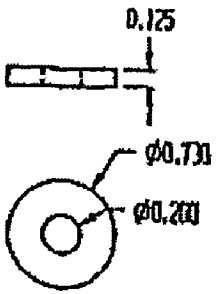
-043 WASHER
(2 REQ'D)
FIG. 19
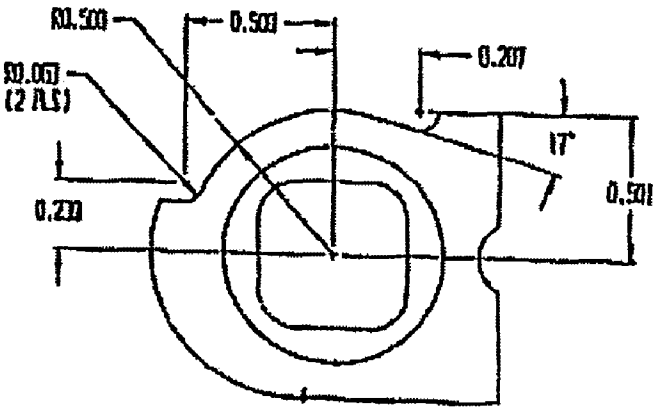
TRIM DETAIL
SCALE: 2/1
FIG. 18A.1

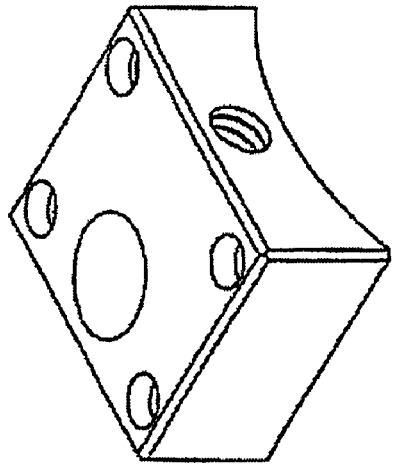
FIG. 20.1
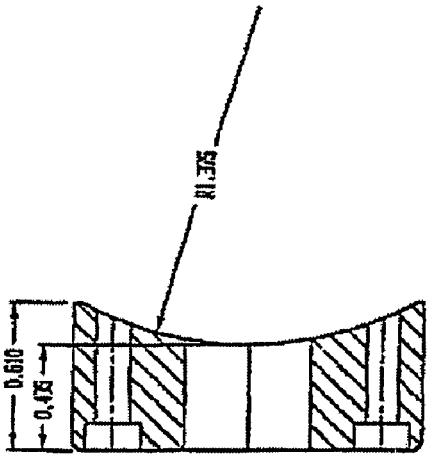
FIG. 20A
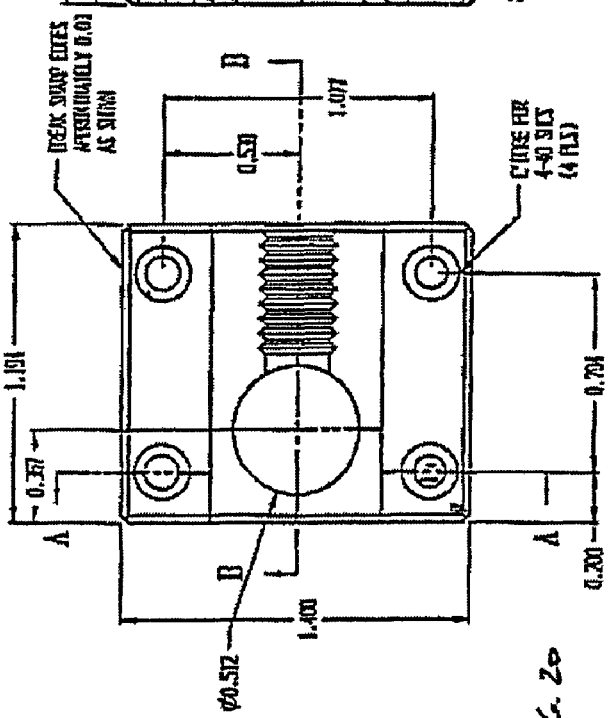
FIG. 20
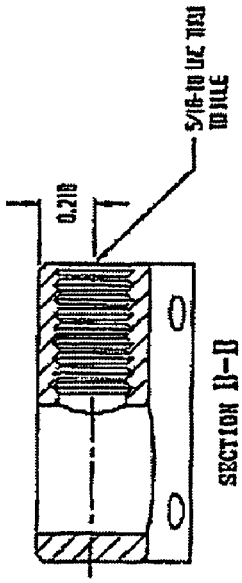
FIG. 20B

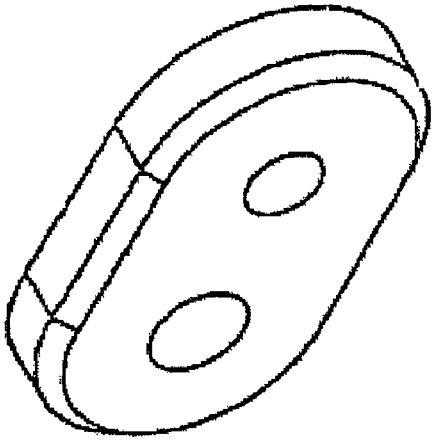
FIG. 21.2
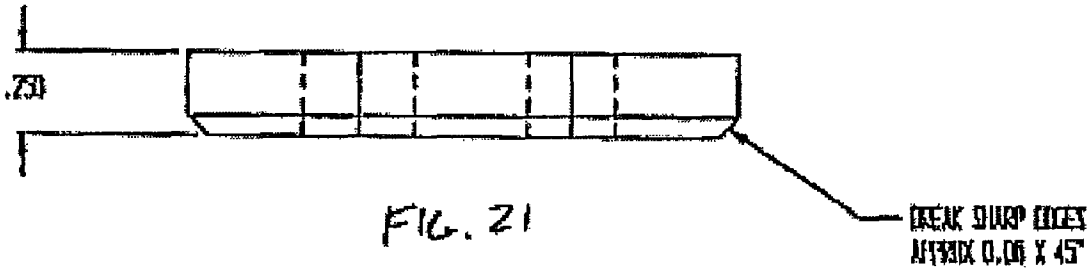
FIG. 21
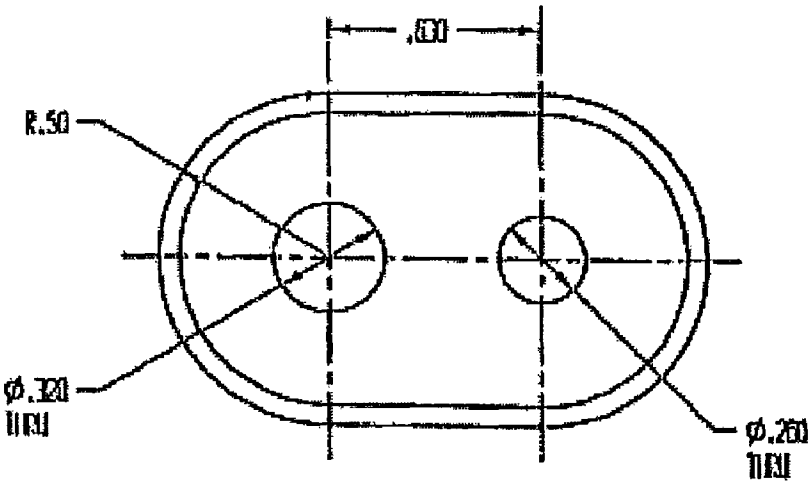
FIG. 21.1

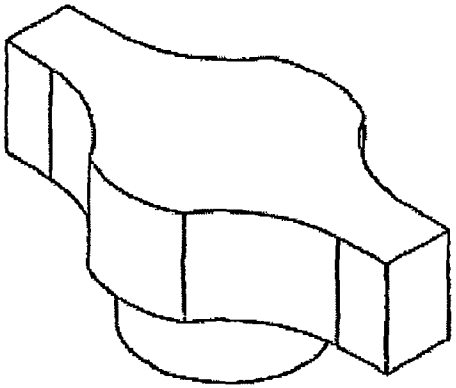
FIG. 22.2
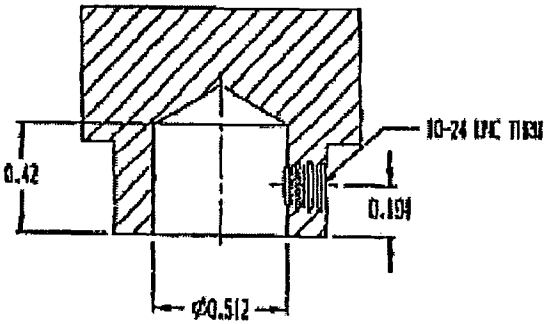
SECTION A-A
FIG. 22A
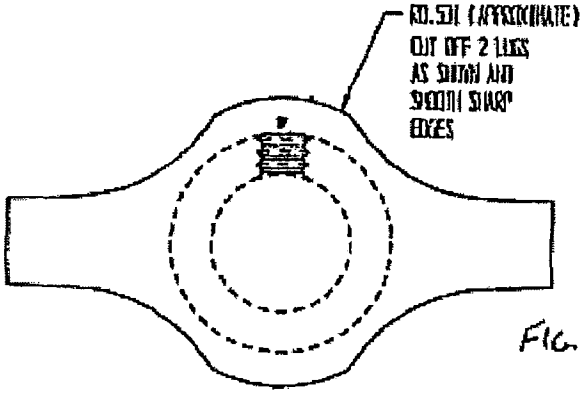
FIG. 22.1
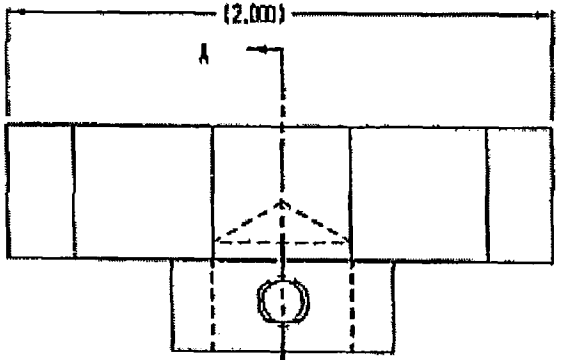
FIG. 22

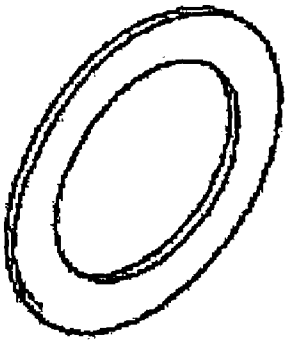
FIG. 23.2
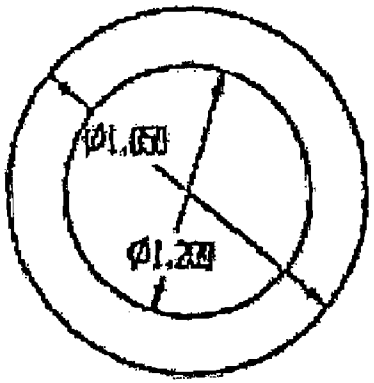
FIG. 23.1
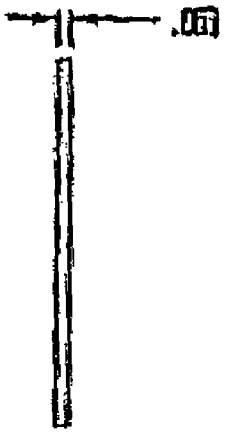
FIG. 23

SECTION B-B
FIG. 24.13
-015 CONFIG 'A' AS SHOWN
-015 CONFIG 'B' SYMM OPPOSITE
FIG. 24.1

SECTION A-A

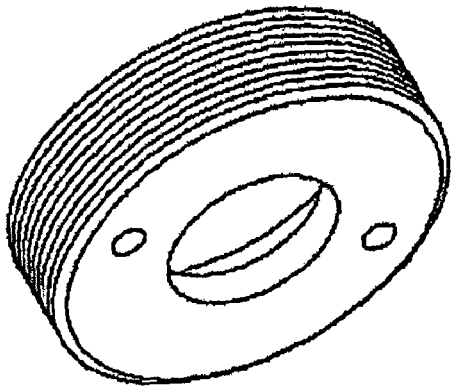
FIG. 25.1
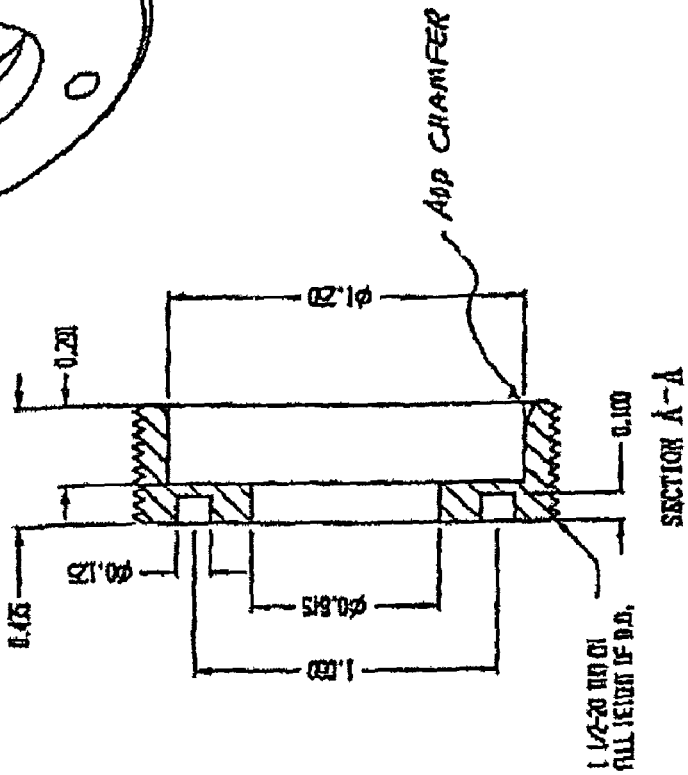
FIG. 25A
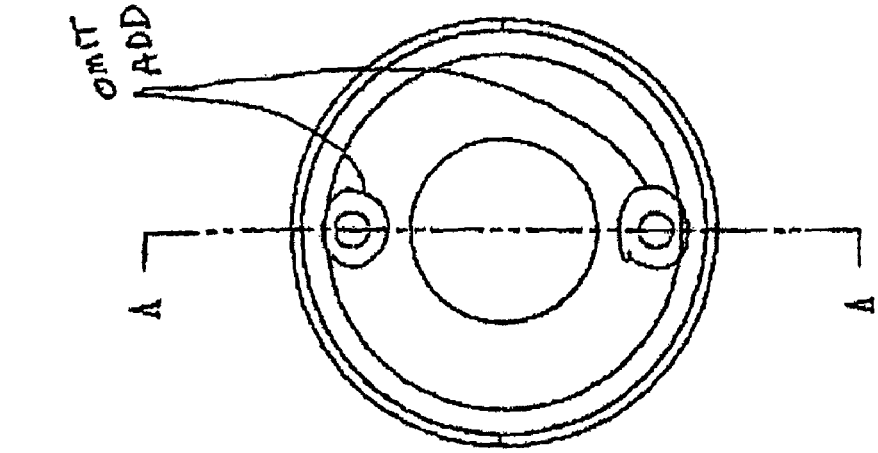
FIG. 25

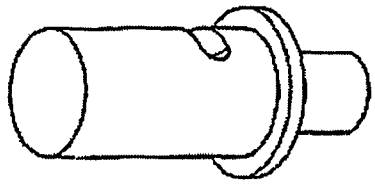
FIG. 26.2
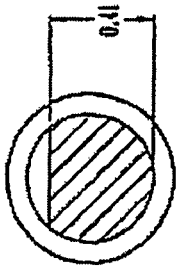
FIG. 26A
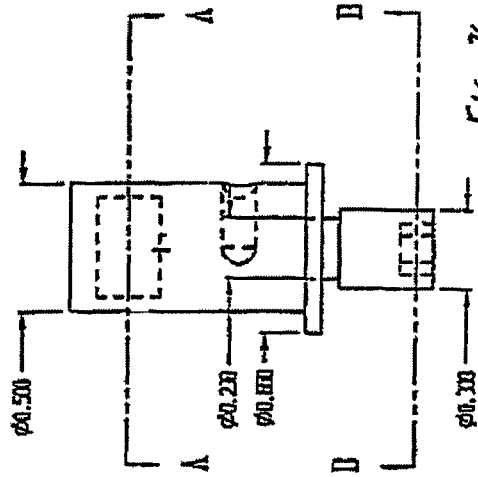
FIG. 26
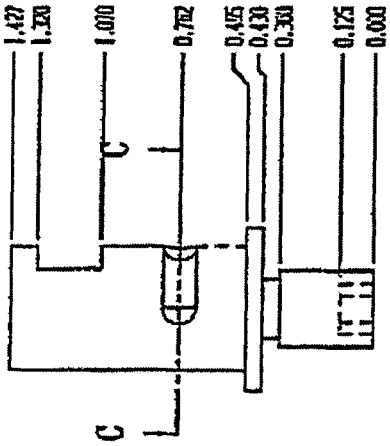
FIG. 26.1
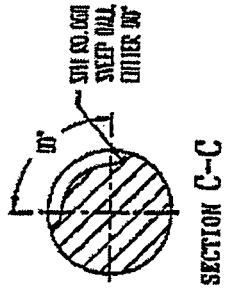
FIG. 26.1C
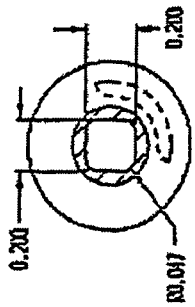
FIG. 26B

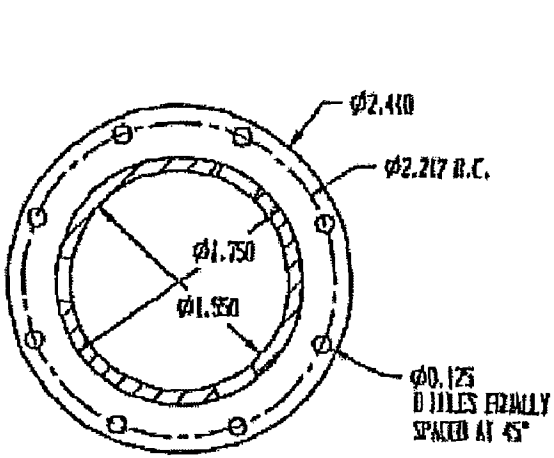
FIG. 27B
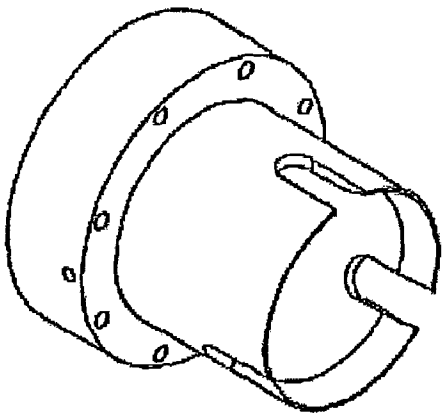
FIG. 27.1
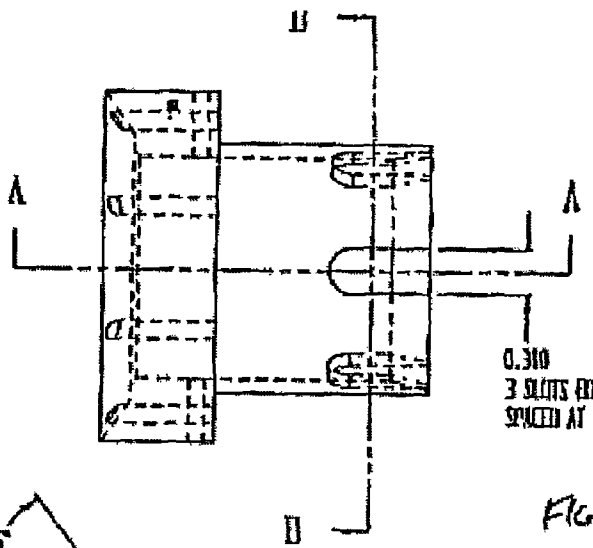
FIG. 27
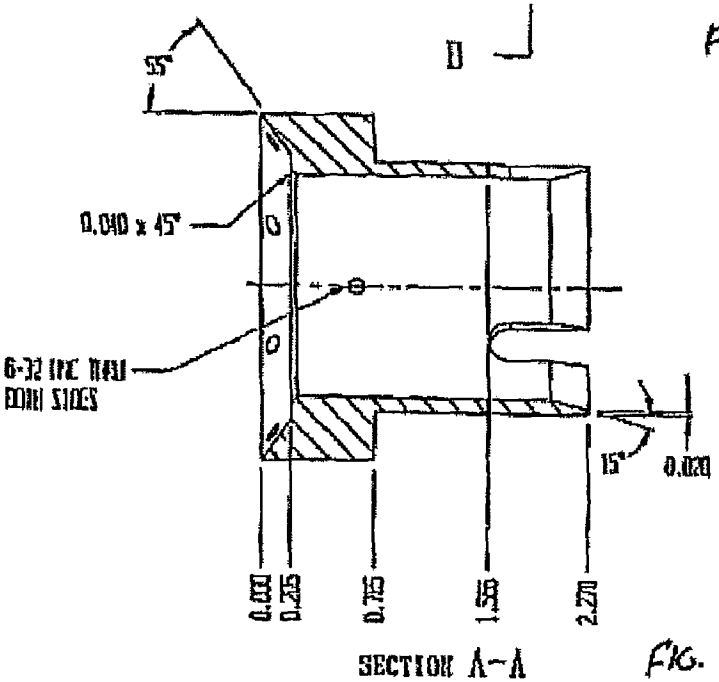
FIG. 27A

A
B
.105
1510-040 SET SCREW -
HALL SEEKER
1/4-20 UNC x 1/4 - MODIFIED
STAINLESS STEEL
(1 REQ'D)

A
B
.750
.500
Φ.100
1510-042 SET SCREW -
NOSE CONE BODY
1/4-20 UNC x 7/8 - MODIFIED
STAINLESS STEEL
(3 REQ'D)

A
B
.500
.102
Φ.100
BREAK OUTS x 45°
1510-041 SET SCREW -
NOSE CONE BODY
1/4-20 UNC x 7/8 - MODIFIED
STAINLESS STEEL
(3 REQ'D)

A
B
Φ.274
.500
.100
1510-007 SET SCREW - COIL
3/8-24 UNF x 1/2 - MODIFIED
STAINLESS STEEL
(3 REQ'D)

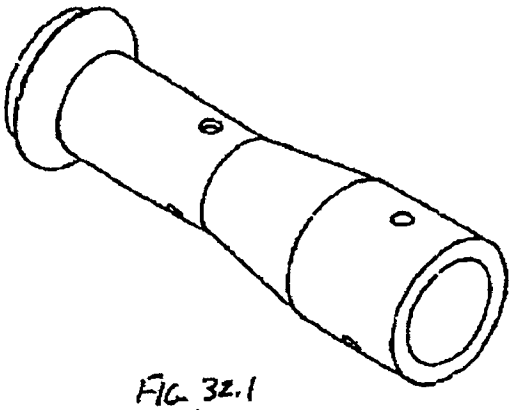
FIG. 32.1
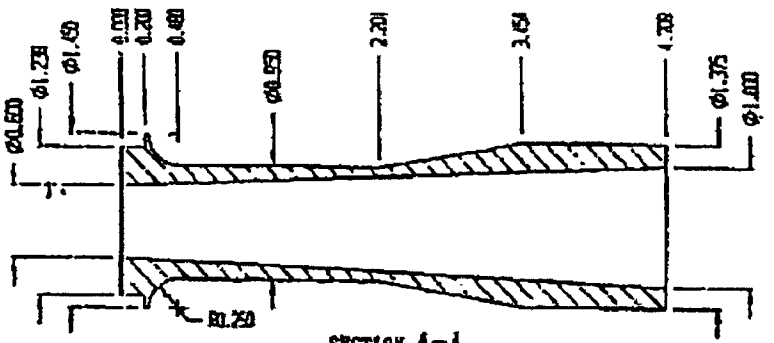
FIG. 32A
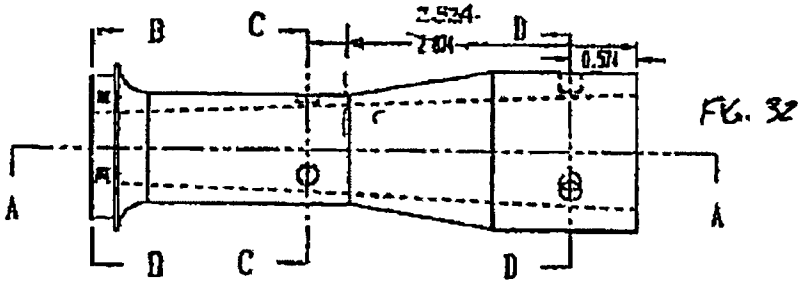
FIG. 32
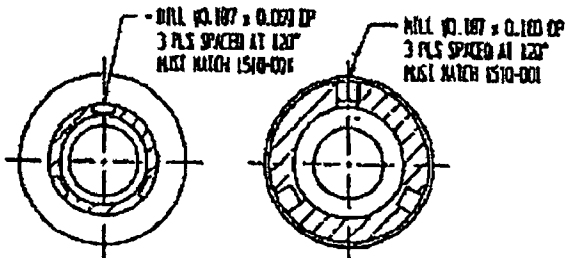
FIG. 32.D
FIG. 32C
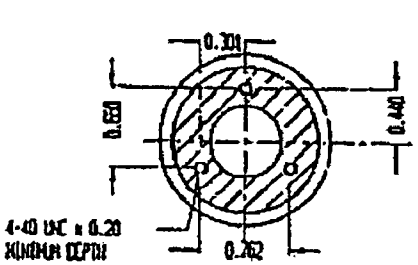
FIG. 32B

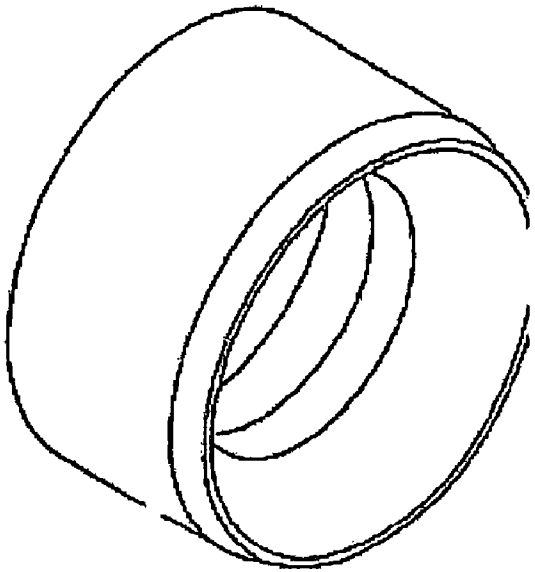
FIG. 33.1
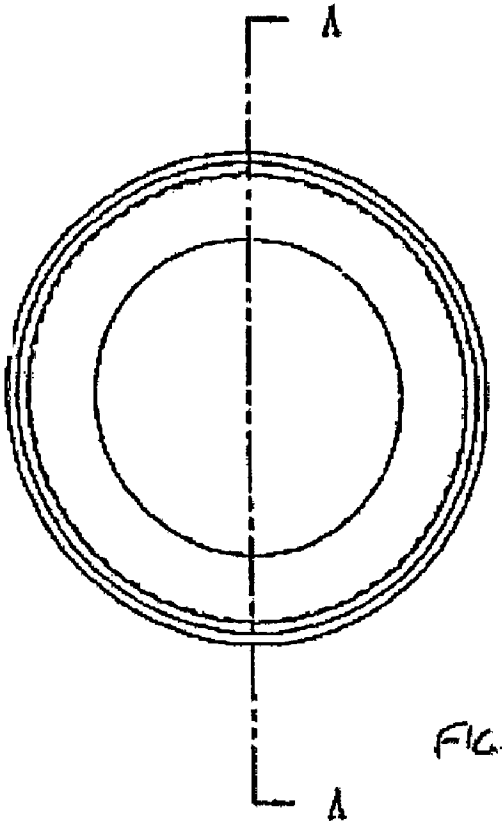
FIG. 33

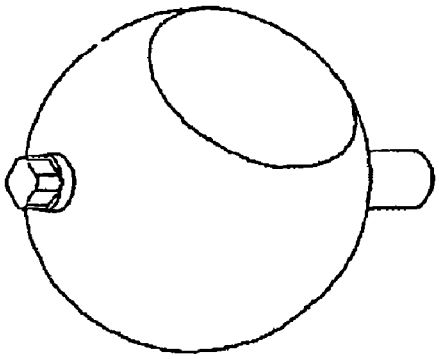
FIG. 34.2
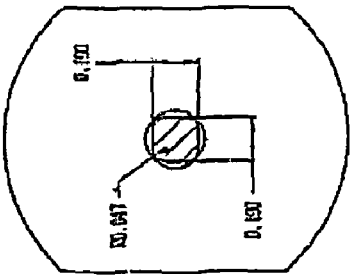
FIG. 34A
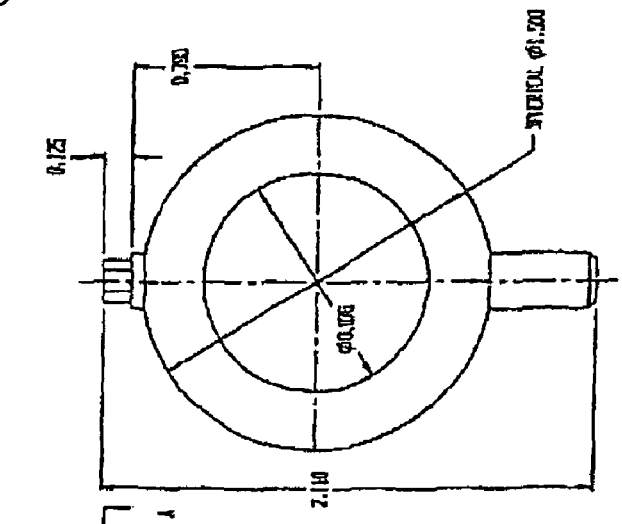
FIG. 34.1
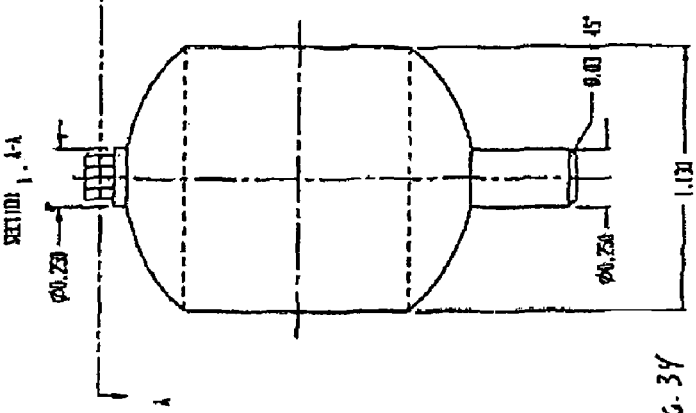
FIG. 34

The 3-series has a center baffle the can be made to independently block the center of the stream that is not blocked by the tri-baffle. This allows all the expelled water to be shaped into a traditional fog pattern.

This variant eliminates the tri-baffle with a fixed doughnut baffle. This design will have a constant fog stream that can be shaped from wide to straight

SECTION A-A

FULL OPEN POSITION

FULL CLOSED POSITION

SECTION 8-8

HOSE NOZZLE APPARATUS AND METHOD

CROSS-REFERENCE TO RELATED APPLICATIONS

This application is a continuation of U.S. patent application Ser. No. 11/456,839, filed on Jul. 11, 2006, which is a continuation application of U.S. patent application Ser. No. 10/306,273, filed on Nov. 27, 2002, which claimed the benefit of U.S. Provisional Patent Application No. 60/334,376 filed on Nov. 29, 2001 entitled "HOSE NOZZLE APPARATUS AND METHOD"; U.S. Provisional Patent Application No. 60/338,609 filed on Dec. 5, 2001 entitled "HOSE NOZZLE APPARATUS AND METHOD"; U.S. Provisional Patent Application No. 60/338,612 filed on Dec. 5, 2001 entitled "METERING VALVE"; U.S. Provisional Patent Application No. 60/338,787 filed on Dec. 5, 2001 entitled "HOSE NOZZLE APPARATUS AND METHOD"; U.S. Provisional Patent Application No. 60/339,526 filed on Dec. 7, 2001 entitled "HOSE NOZZLE APPARATUS AND METHOD"; U.S. Provisional Patent Application No. 60/346,452 filed on Jan. 4, 2002 entitled "SMOOTH BORE HOSE NOZZLE APPARATUS AND METHOD"; and U.S. Provisional Patent Application No. 60/346,320 filed on Jan. 4, 2002 entitled "HOSE NOZZLE APPARATUS AND METHOD"; all of which are incorporated herein by reference in their entirety.

FIELD OF THE INVENTION

This invention relates to a hose nozzle apparatus and method for controlling and adjusting the flow of a liquid stream at a nozzle using manually adjustable flow controls to adjust the flow rates of two types of available flows from a single nozzle. Although presented herein to focus on fire fighting equipment, the present invention may be used where ever nozzles are utilized to apply a fluid. With regard to fire fighting equipment, this invention relates to a fire fighting hose nozzle apparatus and method for providing a deluge stream, a fog spray, or both to a fire at manually adjustable flow rates.

BACKGROUND OF THE INVENTION

Fire hose nozzles are used by fire fighters for supplying water or other liquids to extinguish fires. A common method of extinguishing fires is to direct a flow of liquid, usually water, onto the fire and often the surrounding area. The flow rate may have to be reduced, or increased, depending on the changing character of the fire. The flow is typically delivered in a deluge, also known as a smooth bore flow, or in a fog spray. Typically two separate nozzles are required to achieve these distinct flow types. The deluge provides a straight and solid stream, with maximum reach and penetration. A deluge can be delivered in a relatively precise area thus providing a maximum amount of water into a specific location. The fog spray provides a pattern which can be a straight, aspirated spray, or a wide, aspirated spray with less reach and penetration than a deluge at equivalent supply pressure.

Fire fighters may use the fog to cover a wider area and without the force of a deluge which might scatter burning materials before they are extinguished, thus spreading a fire. They may also use the spray in a very wide pattern to create a shield from the intense heat of a fire. The wide fog pattern also creates a back draft which brings cooler, cleaner air from behind the fire fighter. A wide fog will more quickly lower the heat of a fire by flashing into steam.

Fire fighters may ideally need both flow types for the same fire and may prefer to move from deluge to fog and back. To accomplish this, it has traditionally been necessary to stop the flow and change nozzles.

Certain nozzles in the prior art, hereinafter referred to as combination nozzles, include both a deluge and a spray. Combination nozzles of the prior art were intended to overcome the limitations of having to change single nozzles or use two different hoses simultaneously when two patterns were needed. However, combination nozzles of the prior art have several drawbacks. Most combination nozzles of the prior art have a fixed fog pattern around a fixed deluge. They cannot produce a straight fog spray, nor can the fog and deluge operate independently of each other. The most critical drawback affects all combinations of the prior art. They are simply two nozzles stuck together. Due to the limitations of this design, when the second nozzle is enabled after the first nozzle is flowing, the pressure to the nozzle instantly decreases to a level which significantly and negatively impacts the reach and stream quality of the nozzle. This dangerous condition for the nozzle operator can only be addressed by the pump operator. However, communication between the pump operator and the nozzle operator is not reliable during an emergency, and therefore, this dangerous situation can exist for long periods. Coordination between the pump operator and nozzle operator is further complicated by the presence of multiple nozzle operators connected to a common pump each capable of changing the hydraulic conditions the pump operator must overcome. Additionally, when one nozzle is shut down after both nozzles have successfully been adjusted for simultaneous operation, the result is a sudden and unwelcome rise in pressure that increases the nozzle reaction. This is a force the nozzle operator must combat to hold on to the nozzle. This too is a dangerous situation that must be addressed by the pump operator with the aforementioned communication and coordination difficulties.

Thus there exists a need for an apparatus and method which permits quick, efficient and convenient operation of a fire hose nozzle in deluge mode, fog mode, or both. Furthermore, it would be desirable for the fire fighter to be able to adjust the flow rates such that the flow rates can be reduced or increased to balance flow between the deluge and fog modes, thereby avoiding the previously described "dangerous conditions." The invention described herein provides such a nozzle.

SUMMARY OF THE INVENTION

The present invention offers the fire fighter the capability to apply a deluge stream in combination with a fog spray at the same time. Furthermore, the present invention allows the fire fighter to independently enable the deluge stream and the fog spray, plus adjust the total combined discharge, thereby regulating the pressure to maintain safe operation. Therefore, the present invention offers manual adjustment of two kinds of flow from the same nozzle. Accordingly, it is an aspect of the present invention to provide an apparatus and method for delivering two liquid streams for fire fighting where the flows are selectively variable.

It is a further aspect of the present invention to provide an apparatus and method for manually maintaining the flow of a liquid stream as pressure changes, or maintaining adequate and safe operating pressure by changing the total flow should it be necessary to do so.

It is a further aspect of the present invention to provide an apparatus and method for selectively varying the flow of a liquid stream and manually maintaining the selected flow as pressure changes.

It is a further aspect of the present invention to provide an apparatus and method for delivering two liquid streams for fire fighting.

It is a further aspect of the present invention to provide an apparatus and method for delivering either one or both of two liquid streams for fire fighting.

It is a further aspect of the present invention to provide an apparatus and method for delivering either one or both of two liquid streams for fire fighting where the flows are selectively variable and manually maintaining the flows as the pressure changes, or maintaining adequate and safe operating pressure by changing the total flow should it be necessary to do so.

It is a further aspect of the present invention to provide an apparatus and method for delivering two liquid streams for fire fighting, where a first stream is aspirated with air and the second stream is not aspirated with air.

It is a further aspect of the present invention to provide an apparatus and method for delivering either one or both of two liquid streams for fire fighting where an outer aspirated stream is coaxial with an inner stream.

It is a further aspect of the present invention to provide an apparatus and method for delivering either one or both of two liquid streams for fire fighting, where a first stream is aspirated with air and may be varied from a narrow to a wide flow pattern.

It is a further aspect of the present invention to provide an apparatus and method for delivering either one or both of two liquid streams for fire fighting, where a first stream is aspirated with air and may be varied from a narrow to a wide flow pattern, and where foreign materials may be flushed from the system with the first stream in a flush setting while the second stream remains functional.

It is a further aspect of the present invention to provide an apparatus and method for delivering two liquid streams for fire fighting, where a first stream is aspirated with air and is outwardly coaxial with an inner stream which is not aspirated with air.

It is a further aspect of the present invention to provide an apparatus and method for delivering two coaxial liquid streams for fire fighting, where a first stream is aspirated with air and is outwardly coaxial with an inner stream which is not aspirated with air and where air moves between the two streams.

It is a further aspect of the present invention to provide an apparatus and method for delivering either one or both of two liquid streams for fire fighting where an outer aspirated stream is coaxial with an inner stream, and where the axial distance between the inner stream and the outer stream decreases as the flows move outwardly from the apparatus.

It is a further aspect of the present invention to provide an apparatus and method for delivering two coaxial liquid streams for fire fighting, where a first stream is aspirated with air and is outwardly coaxial with an inner stream which is not aspirated with air, where the axial distance between the inner stream and the outer stream decreases as the flows move outwardly from the apparatus, where air moves between the two streams at a lower pressure than air outside the outer stream, and where the two streams are made more compact and aerodynamic by the lower pressure air moving between the two streams, thus increasing the distance the streams may travel to allow the fire fights to remain at a safer distance.

It is a further aspect of the present invention to provide an apparatus and method for delivering either one or both of two liquid streams for fire fighting, which are efficient and economical.

It is a further aspect of the present invention to provide an apparatus and method to provide a simple, quick and effective means to regulate the amount of flow, and thereby address changing fire conditions and immediately compensate for pressure changes up-line.

It is a further aspect of the present invention to provide an apparatus and method to provide a smooth shut off and turn on feature to avoid water hammering.

It is a further aspect of the present invention to provide an apparatus and method to provide a means of selectively supplying a fog spray which produces fine water droplets or larger water droplets.

The foregoing objects are accomplished in a preferred embodiment of the invention by a combination nozzle having a valve, a throttle, a smooth bore nozzle and an aspirated nozzle. The valve opens or closes the smooth bore nozzle. The throttle valve opens or closes the aspirated nozzle. Also, the throttle valve may be positioned to vary the flow rate. The flows from the smooth bore nozzle and the aspirated nozzle may be operated individually or together, and in varying sequences. Therefore, a deluge stream may be provided alone or in combination with fog spray, and fog spray may be applied alone or in combination with a deluge stream. As pressure changes in the water supply, the present invention allows the firefighter to manually adjust the fog spray throttle valve, thereby directly adjusting the fog spray flow, and indirectly adjusting the deluge stream flow. Specifically, by adjusting the fog spray throttle valve while the deluge stream flow is being applied, the deluge stream either receives more flow or less flow in inverse relation to the throttle position of the fog spray. For example, if the deluge stream is engaged, and the fog spray throttle slider valve is fully open, then the deluge stream is receiving the minimum available flow because the opening of the fog spray will decrease pressure to the nozzle. More flow will leave the fog tip despite the drop in pressure because the opening has been enlarged. The smooth bore opening remains constant but the pressure has dropped so the flow is less. Flow to the smooth bore will be restored if the pump operator adjusts the pump rate to build pressure back to the target pressure. Accordingly, one aspect of the present invention is to provide the firefighter with the means to quickly maintain safe operating pressure by adjusting the combined flow to be in optimum relationship with the available water supply (flow and pressure). Conversely, if the deluge stream is engaged but the fog spray throttle slider valve is fully closed or only barely opened, then the deluge stream will receive all or nearly all of the available flow, respectively. The present invention also allows the firefighter to quickly and easily adjust and regulate the flow using the manually adjustable slider throttle valve to compensate for changing fire conditions or pressure changes in the water supply source.

The present invention incorporates two flow paths, wherein a smooth bore provides a deluge stream flow and a second flow path provides a fog spray. The second flow path is located between the exterior of the smooth bore and the inner wall of the nozzle body. Therefore, the nozzle of the present invention advantageously provides an aspirated fog spray coaxial to a deluge stream when both flow paths are enabled. In addition, structural features of the nozzle allow the aspirated fog spray to be applied in a wide-angle spray or in a narrow-angle focused spray. Further structural features of the nozzle also allow the firefighter to manipulate the slider valve throttle control such that the second flow path can be opened wide or flushed to remove debris within the nozzle.

Further aspects of the present invention will be made apparent in the following Detailed Description of the Invention and the appended claims.

BRIEF DESCRIPTION OF THE DRAWINGS

FIGS. 9-12 depict a separate embodiment providing operation with single control handle for both the deluge stream and fog tips.

FIGS. 13-34.2 illustrate various views of an embodiment of the invention.

While the following disclosure describes the invention in connection with those embodiments presented, one should understand that the invention is not strictly limited to these embodiments. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION OF THE INVENTION

Figure 1:
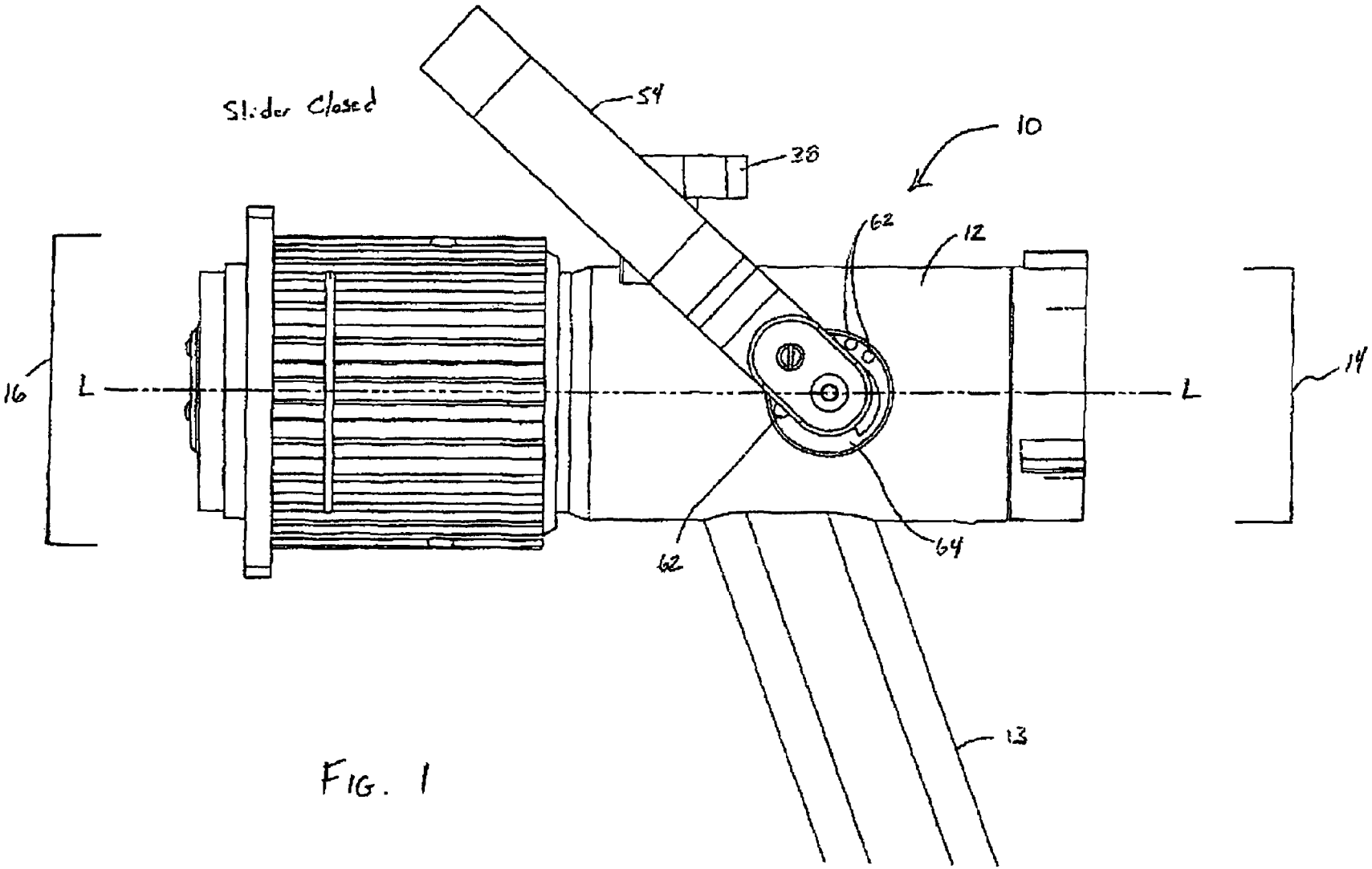
FIG. 1 is a side elevation view of the invention.

Typically, the nozzle of the present invention is attached to a hose. The upstream end of the hose may be connected to different types of fluid sources, including a fire hydrant, fire truck, submersible pump, or any number of alternate fluid sources. Now referring to FIG. 1 and FIG. 2, the nozzle 10 of the present invention includes a longitudinal flow chamber 12, which is generally cylindrical in shape. Nozzle 10 may include a nozzle handle 13 attached to nozzle 10 to assist a nozzle operator with holding and aiming the nozzle. The chamber 12 has an upgradient inlet end or position 14, and an exit or downgradient outlet end or position 16. Therefore, the fluid source, such as a hose, is connected to the upgradient inlet position 14 of nozzle 10 to provide a source of fluid to the nozzle 10. The connection of the hose to the nozzle 10 may be by any method known to those skilled in the art.

The longitudinal flow chamber 12 includes a longitudinal flow chamber wall 18, having a longitudinal flow chamber inner wall surface 20 and a longitudinal flow chamber outer wall surface 22. Therefore, a fluid entering the nozzle 10 at the upgradient inlet position 14 flows into the interior region of the longitudinal flow chamber 12 by way of the zone circumscribed by the longitudinal flow chamber inner wall surface 20.

Figure 2:
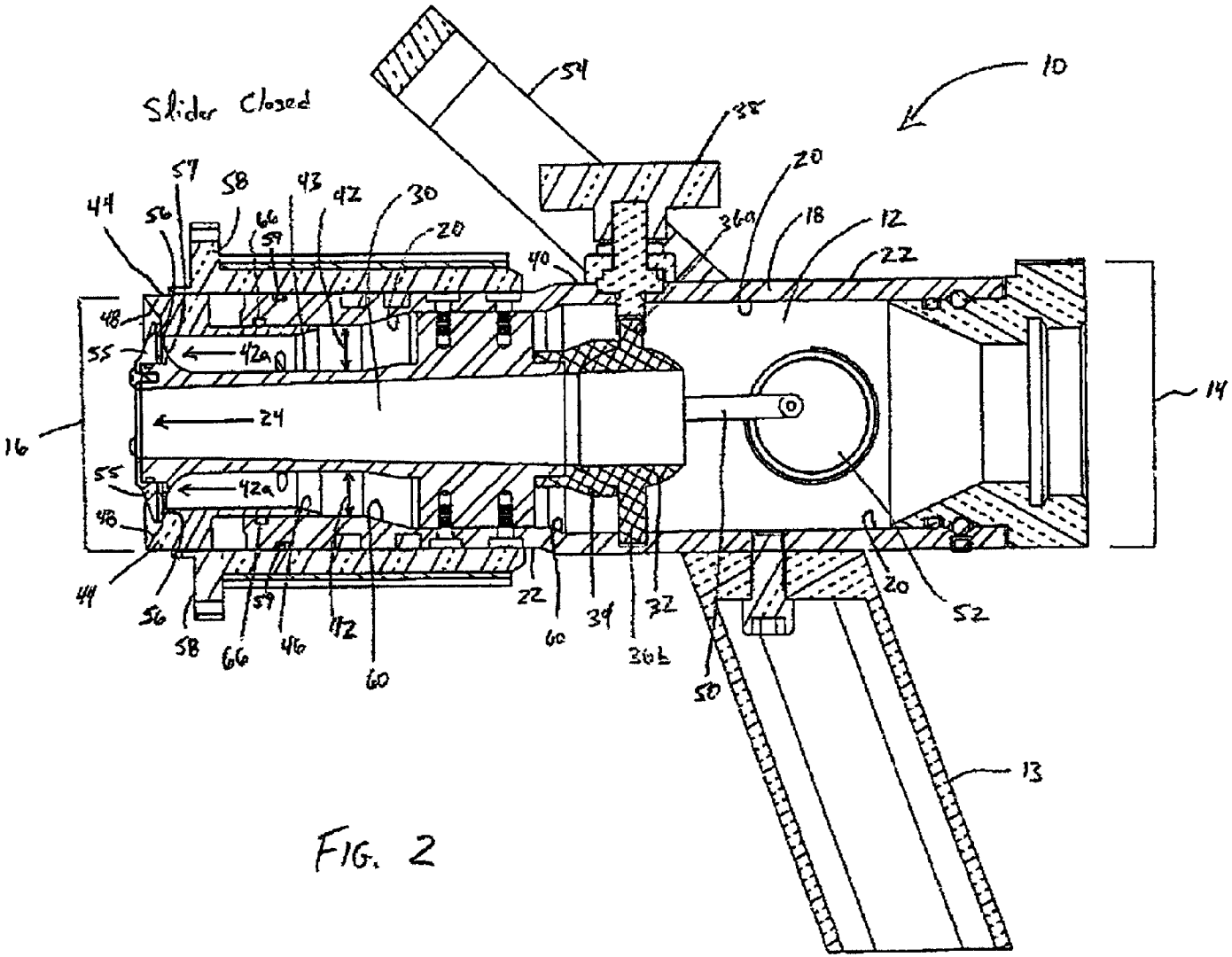
FIG. 2 is a side cross-sectional view of the invention.
Figure 4:
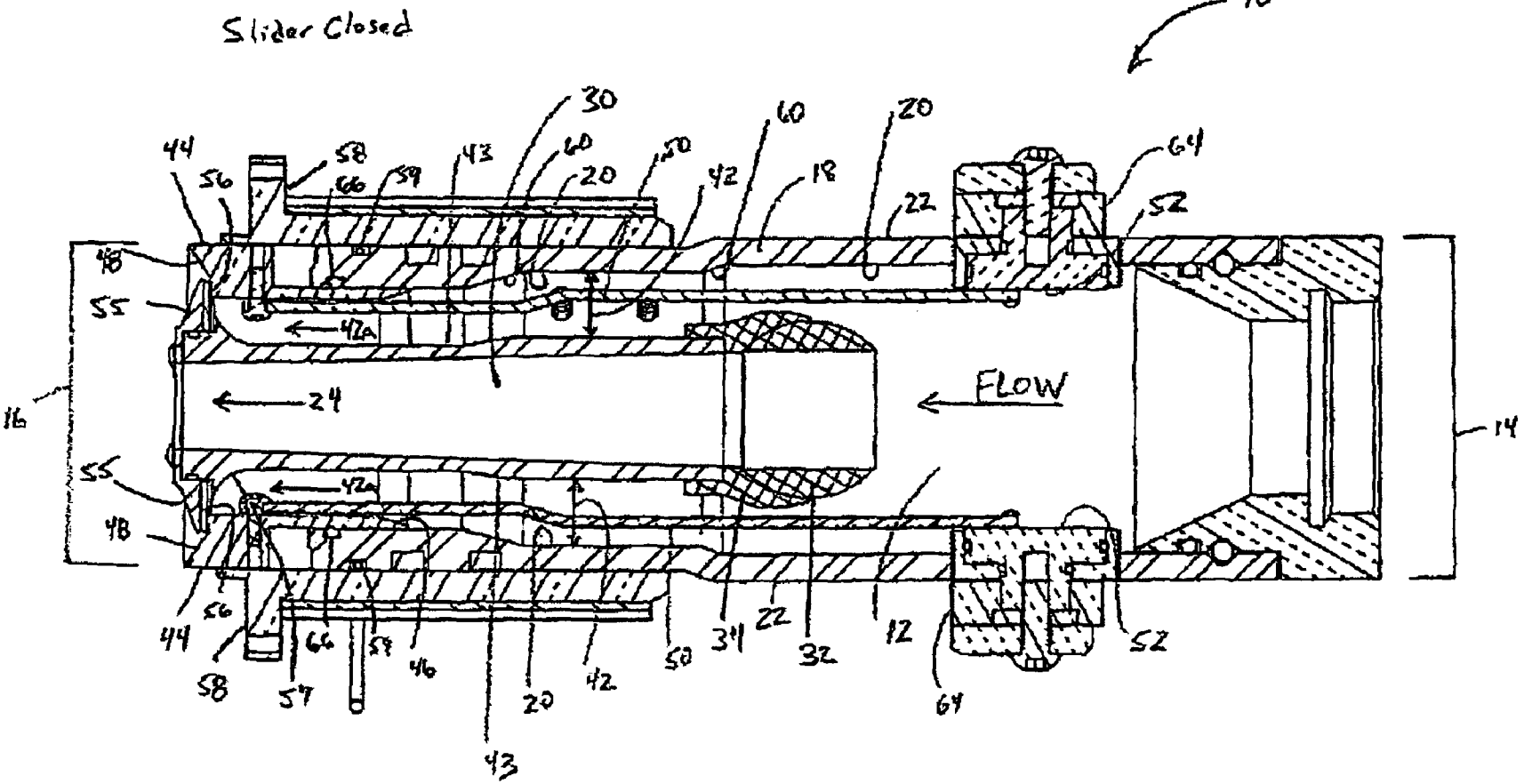
FIG. 4 is a top cross-sectional view of the invention.

Located predominantly within the distal half of the longitudinal flow chamber 12 is a smooth bore 30 for providing a first flow path 24 in the form of a deluge stream flow. A deluge stream flow is a non-aspirated solid stream of fluid. Therefore, in fighting a fire, a deluge stream provides a large amount flow in a concentrated stream. The smooth bore 30 is connected to the longitudinal flow chamber wall 18 using bolts or other securing means to solidly affix the smooth bore 30 within the longitudinal flow chamber 12. The smooth bore 30 is a tube-shaped structure forming a separate flow path within the longitudinal flow chamber 12. When viewed in cross section from the side or from the top, as illustrated in FIG. 2 or FIG. 4, respectively, the smooth bore 30 is cone-shaped with a truncated outlet end or orifice. Alternately, the smooth bore 30 may also be cylindrical-shaped in cross section.

The smooth bore 30 may be machined to different sizes depending upon the desired characteristics of the deluge stream portion of the flow. Therefore, different diameters of the smooth bore 30 component can be provided, depending upon an operator's requirements. Furthermore, separate flow control devices exist for placement in-line and upgradient of the nozzle 10 of the present invention. For example, the flow regulator device as disclosed in U.S. Pat. No. 6,089,474 may be adapted to an in-line, separate fitting (a non-nozzle fitting) and placed at some point upgradient of the nozzle 10 of the present invention. In so doing, a uniform smooth bore 30 may be manufactured of one or a limited number of diameters, with a relatively constant flow and pressure assured of entering the nozzle 10 due to the inclusion of an upgradient in-line automatic flow control device. Thereafter, the flow exiting nozzle 10 of the present invention may be manually adjusted using aspects of nozzle 10 described hereafter.

Figure 3:
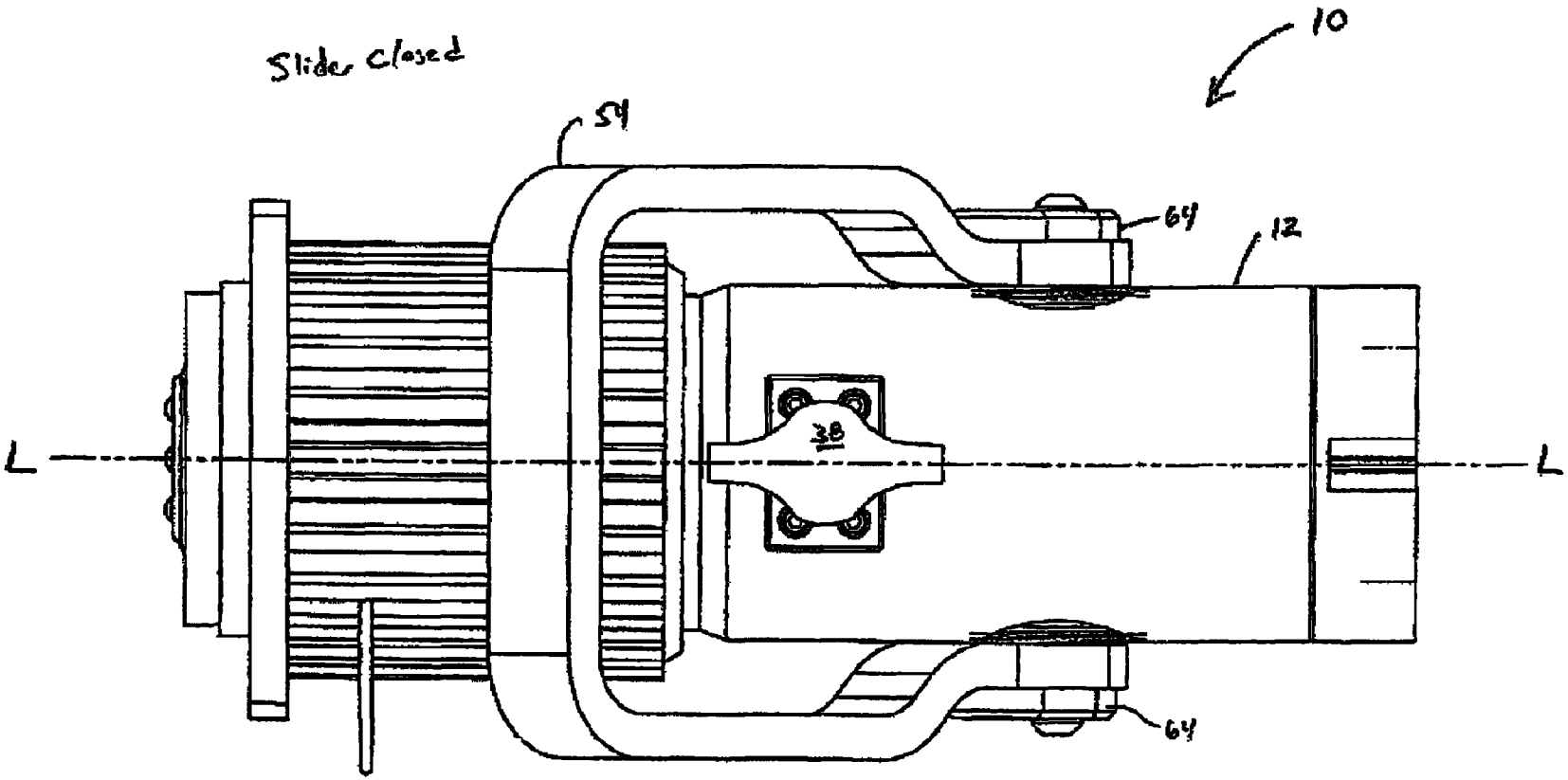
FIG. 3 is a top elevation view of the invention.

Referring now to FIG. 2 and FIG. 3, the upgradient end of the smooth bore 30 is fitted with a smooth bore flow control device. The smooth bore flow control device of the present invention is preferably a manually operated ball valve 32. However, it should be understood that the smooth bore flow control device may be a different kind of manually operated valve, or alternately, may be an automatic flow control valve with flow settings chosen by the operator of the nozzle. The smooth bore flow control device is preferably adjustable from a closed to a full-on, or wide open position, with partially open positions available in between. For example, a quarter turn will decrease the flow however it will destroy the straight, solid stream quality of the deluge tip. Nonetheless, firefighters do this with smooth bores to create a kind of fog, thereby allowing adjustment of flow into the smooth bore 30. For example, although a quarter turn of the ball valve 32 will result in disrupting the smooth bore flow, and thus the solid stream quality of the deluge stream, nonetheless, this option allows the firefighter to create a kind of fog spray using the smooth bore 30. As noted, a ball valve 32 is preferably employed, and although partial open positions are available, the ball valve 32 is typically positioned in either (1) a full-on or (2) a completely off, or closed position. When in the full-on position, a true deluge stream flow is provided.

The ball valve 32 is mounted at the upgradient inlet into the smooth bore 30, and includes a ball valve housing 34 that is affixed to the upgradient end of the smooth bore 30, and further includes a valve stem or an upper ball valve fastener 36*a*, and a lower ball valve fastener 36*b* that are used to secure the ball valve 32 to the longitudinal flow chamber wall 18. The upper ball valve fastener 36*a* penetrates the longitudinal flow chamber wall 18, and is interconnected to a ball valve control handle 38 situated on the top surface 40 of the nozzle 10. The ball valve control handle 38 is used by the nozzle operator to manipulate the ball valve 32 and control the flow through the smooth bore 30 portion of the nozzle 10.

Another aspect of the present invention is its ability to generate fog spray if the operator so desires. The present invention allows the nozzle operator to create a fog spray with either fine or large water droplets. In addition, the present invention also allows the operator to regulate the volume of water that is being used to create either fine or large water droplets.

The smooth bore 30 and longitudinal flow chamber 12 are of such different diameters that an annular space 42 exists between the longitudinal flow chamber inner wall surface 20 and the smooth bore outer wall surface 43. This annular space 42 defines a second flow path 42*a* to generate a fog spray at the downgradient outlet position 16 of the nozzle 10. The second flow path 42*a* is concentrically located relative to the first flow path 24, and each flow path is fed fluid independent of the other flow path. Therefore, fluid entering the first flow path 24 exits nozzle 10, and no portion of fluid within the first flow path 24 passes to the second flow path 42*a*.

Nozzle 10 includes a slider valve 44 located proximate the distal end or down gradient outlet position 16 of longitudinal flow chamber 12. The slider valve 44 is an adjustable feature that controls the release of fluid from the second flow path 42*a* that exits nozzle 10, thereby creating fog spray.

The slider valve 44 is a cylindrical, tube-shaped structure with a slider upgradient edge 46 and a slider downgradient surface 48. The slider valve 44 is adjustable or moveable in a direction parallel to the longitudinal axis L-L of the longitudinal flow chamber 12. The slider valve 44 is interconnected to a slider valve linkage control system 50, that in turn, is interconnected to a slider valve cam shaft 52. The slider valve cam shaft 52 penetrates the longitudinal flow chamber wall 18 and is interconnected to a slider valve control handle 54 on the exterior of nozzle 10.

Therefore, the ball valve 32 and ball valve housing 34 located at the upgradient end of the smooth bore 30 are sized so as to allow sufficient fluid flow around their outer surfaces to the annular space 42. Accordingly, a fluid entering the upgradient inlet position 14 of nozzle 10 flows through the upgradient portion of the longitudinal flow chamber 12 until it reaches a point where it meets the ball valve 32 which serves as the available fluid inlet to the smooth bore 30. If the ball valve 32 is in an open position and adequate fluid pressure exists, then a portion of the fluid that had entered the longitudinal flow chamber 12 will flow through the smooth bore 30 and exit the nozzle 10 at the downgradient outlet position 16 along the first flow path 24 as deluge stream flow. In addition, provided slider valve 44 is in an open position, a portion of the fluid supply entering the longitudinal flow chamber 12 will flow around the ball valve 32 and ball valve housing 34 into the annular space 42 and move down the longitudinal flow chamber 12 via the second flow path 42*a* toward the downgradient outlet position 16 and exit nozzle 10 as fog spray. Accordingly, nozzle 10 possesses two outlet tips within one longitudinal flow chamber 12: (1) a deluge stream tip fed by the first flow path 24, and (2) a fog tip fed by the second flow path 42*a*.

The slider valve control handle 54 can be adjusted by the operator of the nozzle 10, thereby adjusting the longitudinal position of the slider valve 44, and thus, the amount of flow through the fog tip portion of the nozzle 10. In its closed position, the slider valve 44 is at its most distal position, and is situated such that a portion of the slider downgradient surface 48 contacts a slider seal 56 that is interconnected to a smooth bore distal flange flow shaper or baffle 55. The baffle 55 acts as a flow shaper, outwardly diverting water within the second flow path 42*a*. The baffle 55 is interconnected to the distal or outlet end of the smooth bore 30. The smooth bore outer wall surface 43 of the smooth bore 30 may possesses a outer shaped region 57 that is curved outward near baffle 55 to further deflect fluid in an outward direction away from nozzle 10. The slider seal 56 is a resilient rubber, plastic, neoprene or other suitable material used to create a hydraulic seal when in compression. Therefore, a portion of the slider downgradient surface 48 compressingly contacts the slider seal 56 and prevents flow through the fog tip portion of the nozzle 10 when the fog tip is closed. When the slider valve 44 is in a closed position, the slider valve design benefits from the fluid pressure acting on the slider valve 44 to assist with compressing the slider downgradient surface 48 with the slider seal 56. It should be understood that an alternate configuration entails the positioning of the slider seal 56 on the slider valve 44 itself, rather than on the baffle 55.

When flow through the fog tip is desired, the slider valve 44 is opened by moving the slider valve control handle 54 to a plurality of positions that allow the nozzle operator to manually control the flow through the fog tip. When moving the slider valve control handle 54 to one of the open positions, the slider valve 44 moves in an upgradient direction away from baffle 55 and the slider seal 56. The leverage advantage provided by the slider valve control handle 54 assists the nozzle operator when opening the slider valve 44, such that the nozzle operator is capable of comfortably overcoming the frictional fluid forces acting on the slider valve 44 that are tending to maintain the slider valve 44 in a downgradient closed and sealed position.

The farther the slider valve 44 moves upgradient, the more flow is allowed to pass through the fog tip. The plurality of positions of the slider valve 44 allow it to behave as a throttle, making nozzle 10 a selectable gallonage nozzle. Prior art selectable gallonage nozzles require a main shut off valve, such as a ball valve, and a separate component that is rotatable around the main body to adjust the orifice, and thus the flow rate of the fog tip. The present invention simplifies the controls the nozzle operator must manipulate. The slider valve control handle 54 is especially useful when both the fog tip and smooth bore tips are enabled, because by manipulating the slider valve control handle 54 and adjusting the flow of the fog tip, the other portion of the flow that is passing through the smooth bore 30 is thereby also regulated or adjusted. Accordingly, this gives the nozzle operator the ability to regulate the volume or amount of water being expelled from the nozzle 10, and thereby react quickly to changes in the water supply and changes in the demands of fighting the present fire.

The slider downgradient surface 48 possesses an angled or sloped surface. This angled surface provides two desired affects. First, fluid expelled through the second flow path 42*a* of nozzle 10 impacts the angled surface, thereby creating a force on the slider valve 44 in an upgradient direction. This force tends to counteract the fluid frictional forces on the slider valve 44 that tend to move the slider valve 44 in a downgradient or closed position. Second, the angled surface of the slider downgradient surface 48 directs the expelling fluid forward. Accordingly, fluid deflecting off of baffle 55 moves past and contacts the slider downgradient surface 48, and subsequently exits the nozzle 10 and creates a fog spray. The pattern of the fog spray from the fog tip is influenced by the position of a circumferential flange or bell 58. Bell 58 is threadably mounted on the periphery of the distal end of the longitudinal flow chamber outer wall surface 22. One or more o-rings 59 may be used between the bell 58 and the longitudinal flow chamber outer wall surface 22 to prevent fluid from moving between the bell 58 and the longitudinal outer wall surface 22. The bell 58 is longitudinally adjustable with respect to the exterior surface of the longitudinal flow chamber 12, and therefore, its position can be changed relative to the fixed location of baffle 55. Accordingly, if slider valve 44 is open to one of its flow positions, and if the bell 58 is rotated by the nozzle operator such that the bell 58 is in a downgradient or forward position, the fluid traveling through annular space 42 will exit the fog tip, and the pattern of the fog spray is influenced by the angle of the slider downgradient surface 48 and the relative position of bell 58 in the path of the fluid. Thus, the angle and surface texture of the slider downgradient surface 48, and the angle and surface texture of the exit region of bell 58 tend to influence the characteristics and width of the spray exiting the fog tip. The more forward or distally positioned bell 58 is located, the narrower the fog spray pattern. Conversely, the further back or more upgradient bell 58 is located, the wider the fog spray pattern.

Figure 5:
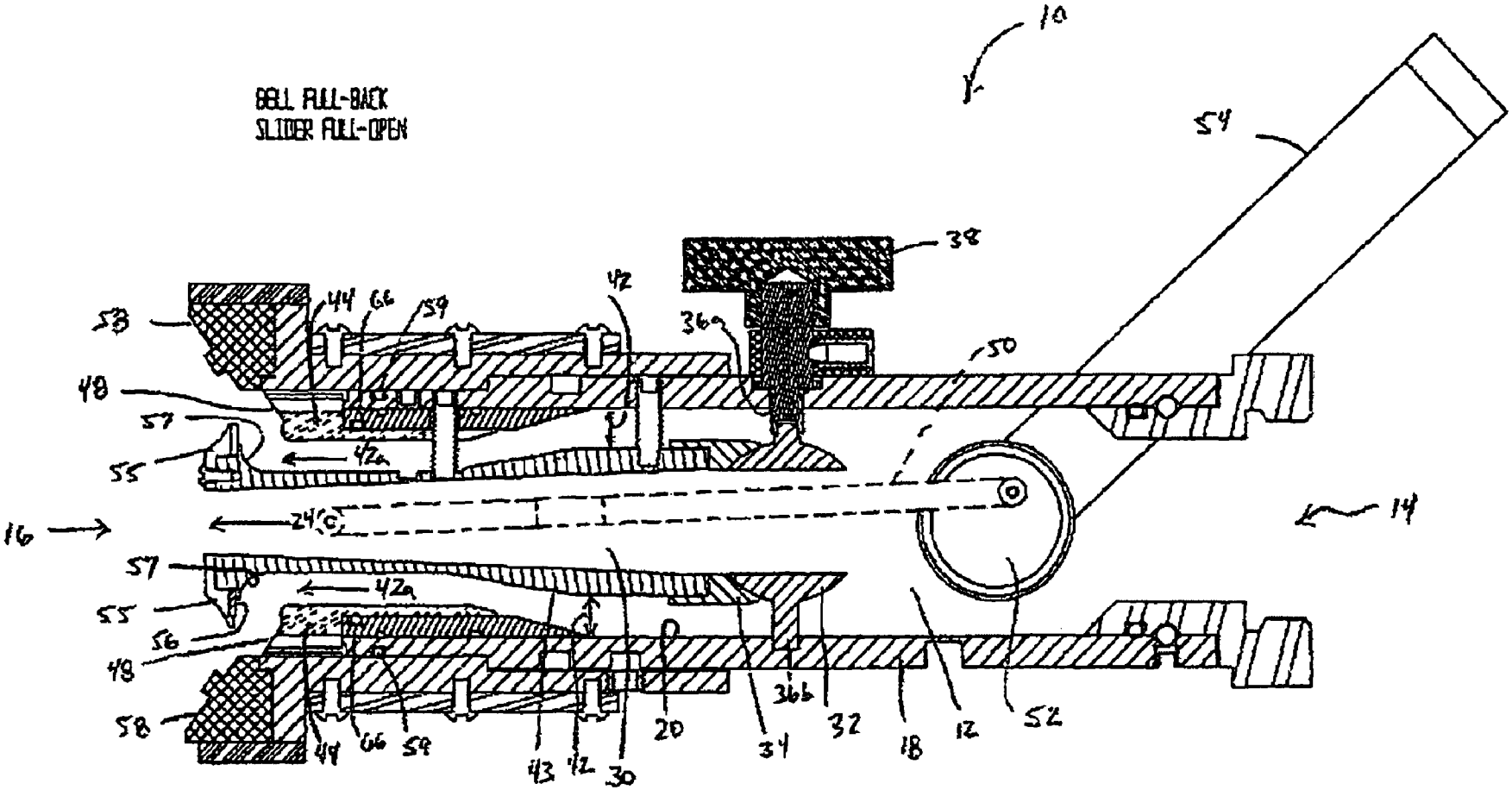
FIG. 5 is a side elevation view of the invention with the slider valve in a full-open position and the bell in a full-back position.

FIGS. 5-8 illustrate various positions of the bell 58 and the slide valve 44. FIG. 5 depicts bell 58 in a full-back position. Accordingly, bell 58, as shown in FIG. 5, depicts the nozzle adjusted to produce a relatively wide-angle fog spray from the second flow path 42*a* that is formed by annular space 42. In generating a fog spray, fine water droplets are useful to readily create steam and starve the fire of heat. Fine water droplets are created in wide-angle operation. FIG. 5 also illustrates that the slider valve control handle 54 is adjusted to a full-back position, thereby positioning slider valve 44 in its full-open position, as is evidenced by the relatively large spacial separation between slider seal 56 and slider valve 44. Accordingly, a maximum fog spray in a wide pattern is generated by this combination of slider valve 44 and bell 58 settings.

Figure 6:
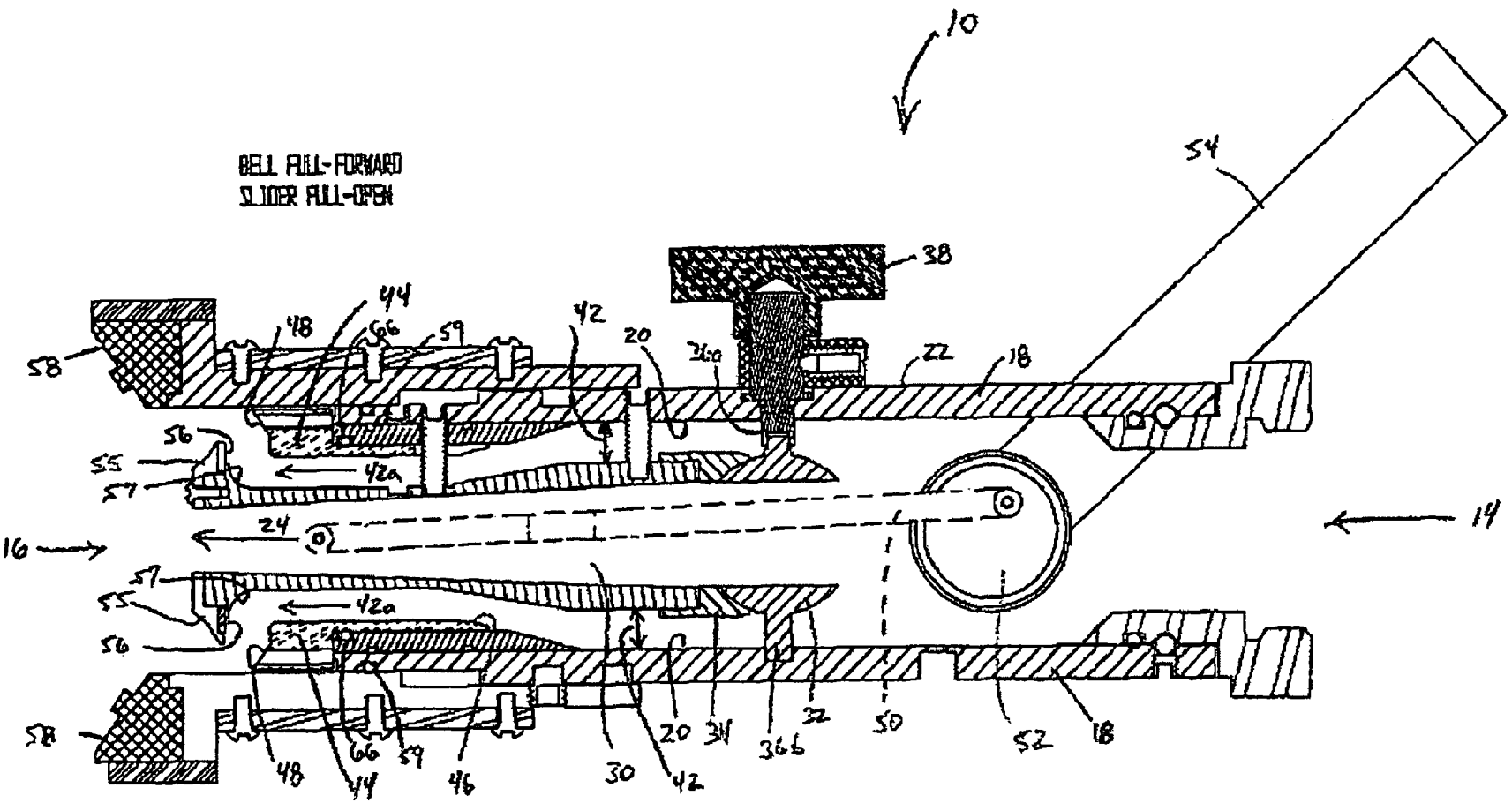
FIG. 6 is a side elevation view of the invention with the slider valve in a full-open position and the bell in a full-forward position.

In contrast to FIG. 5, FIG. 6 illustrates bell 58 in a full-forward position. Accordingly, bell 58 as shown in FIG. 6, depicts nozzle 10 adjusted to produce a relatively focused or narrow-angled fog spray from the second flow path 42*a* that is formed by annular space 42. Large water droplets are useful in avoiding quick steam production and in avoiding burns to firefighters if they are in a small room. Large water droplets are produced with a narrow-angle setting, and are preferably generated with simultaneous use of the deluge tip. In the full-forward position, bell 58 deflects fluid in a forward direction, as opposed to allowing the fluid to spray laterally away from nozzle 10, and thereby create a wide fog spray pattern. Consistent with FIG. 5, FIG. 6 also illustrates that the slider valve control handle 54 is adjusted to a full-back position, thereby positioning slider valve 44 in its full-open position. As a result, FIG. 6 illustrates slider valve 44 in a full-open position, which again is evidenced by the relatively large spacial separation between slider seal 56 and slider valve 44. Accordingly, a maximum fog spray in a focused or narrow pattern is generated by this combination of slider valve 44 and bell 58 settings.

Figure 7:
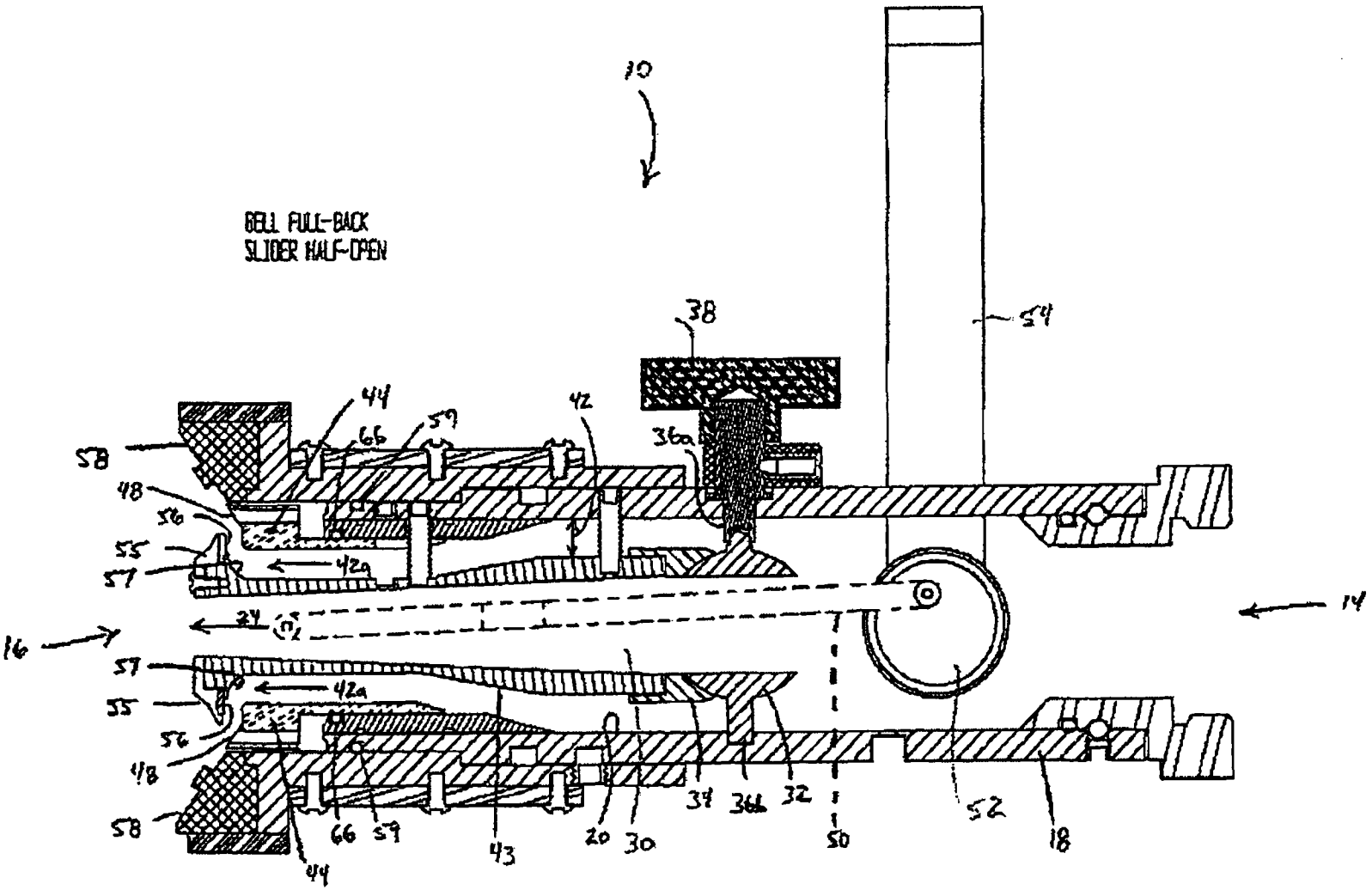
FIG. 7 is a side elevation view of the invention with the slider valve in a half-open position and the bell in a full-back position.

Consistent with FIG. 5, FIG. 7 illustrates bell 58 in a full-back position. Accordingly, bell 58, as shown in FIG. 7, depicts nozzle 10 adjusted to produce a relatively wide-angle fog spray from the second flow path 42*a* that is formed by annular space 42. However, in contrast to FIGS. 5 and 6, FIG. 7 illustrates slider valve 44 in a half-open position. This is evidenced by the significantly smaller spacial separation between slider seal 56 and slider valve 44 as compared to the full-open position of slider valve 44 depicted in FIGS. 5 and 6. The half-open slider valve 44 position is achieved by positioning slider valve control handle 54 to a half-back position.

Figure 8:
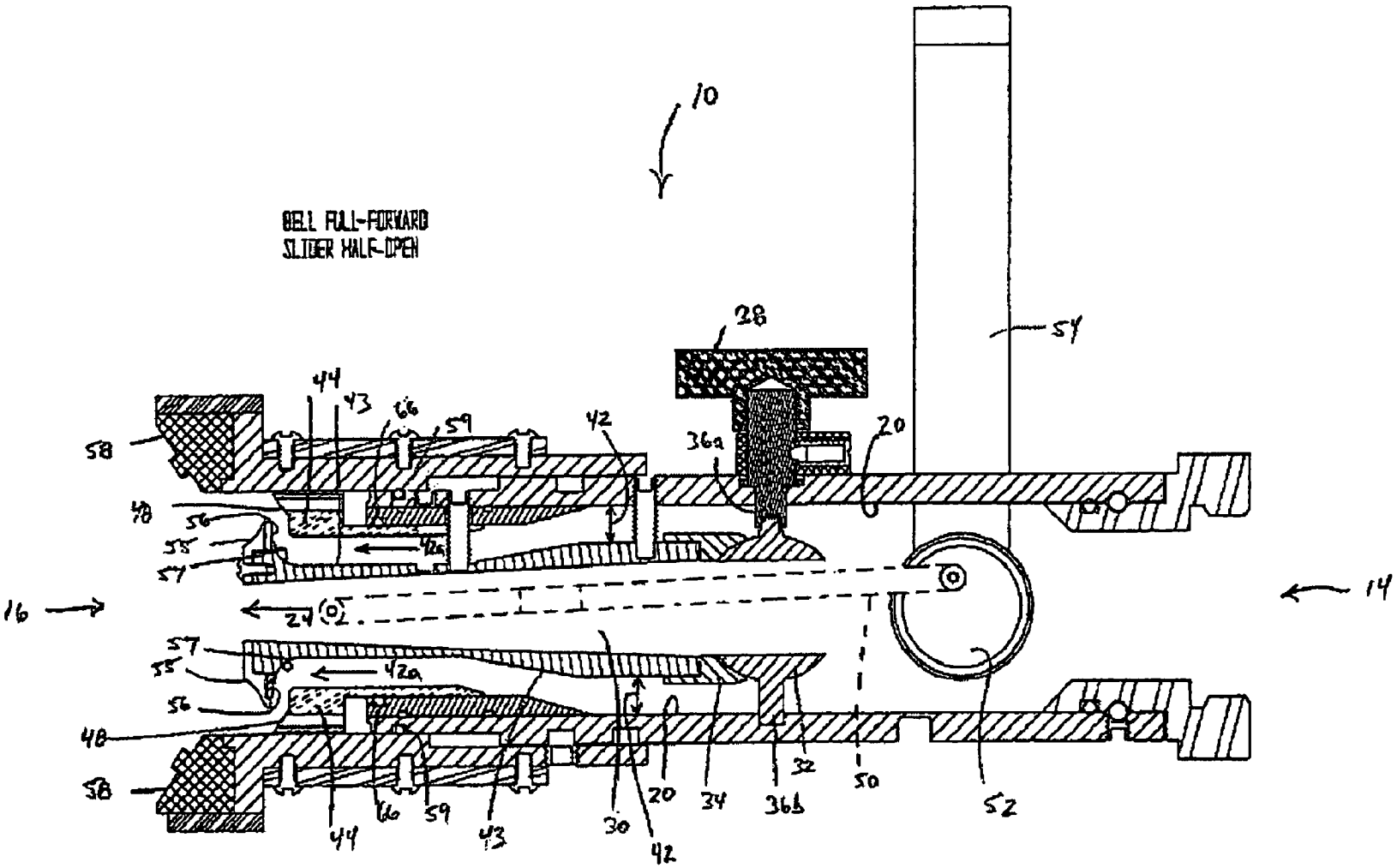
FIG. 8 is a side elevation view of the invention with the slider valve in a half-open position and the bell in a full-forward position.
Figure 11:
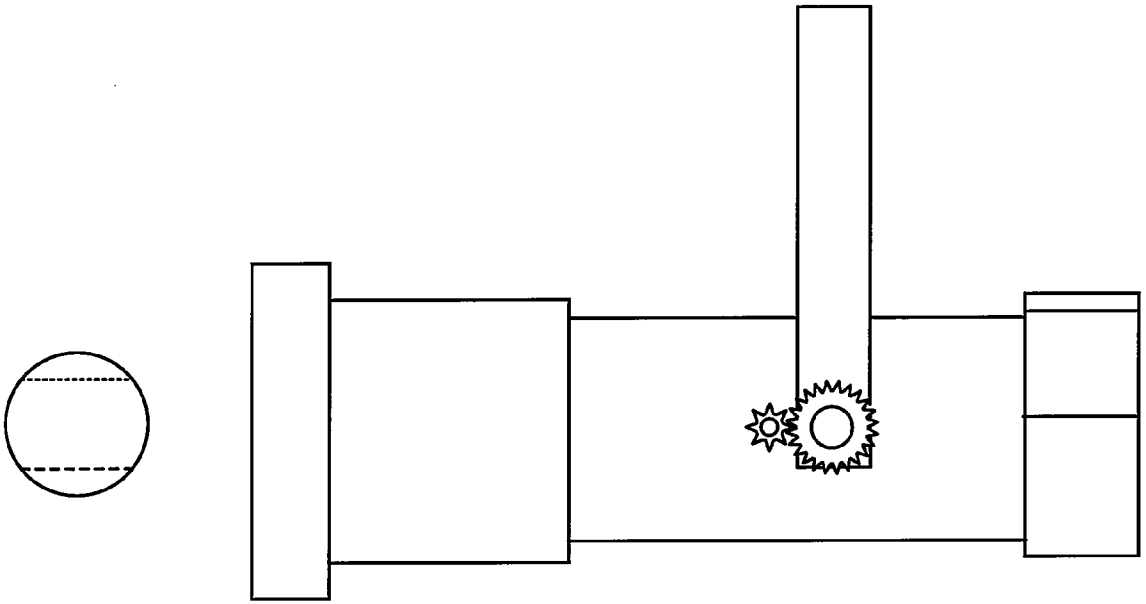
Figure 12:
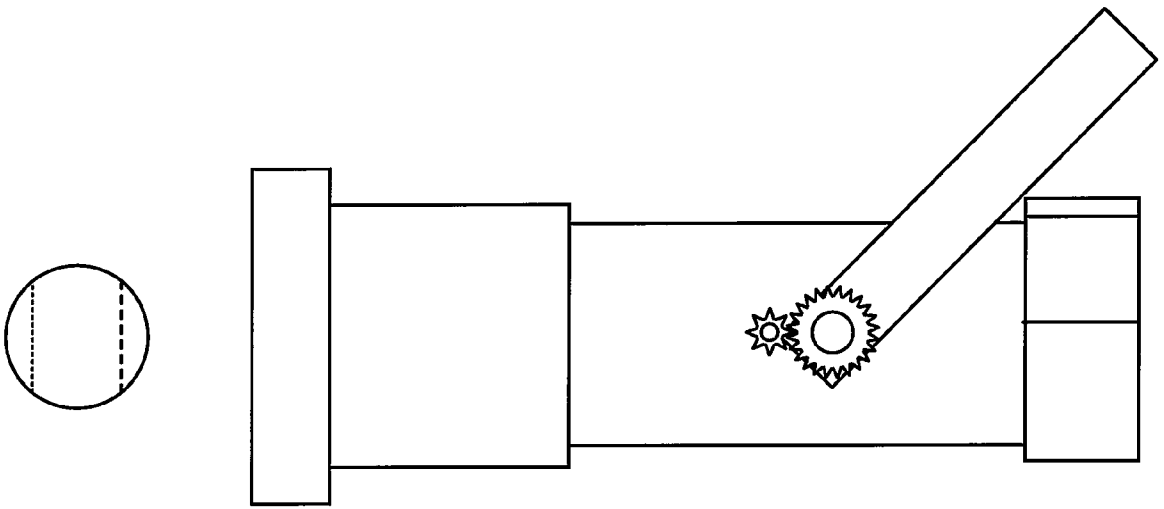
Figures 13A, 13B:
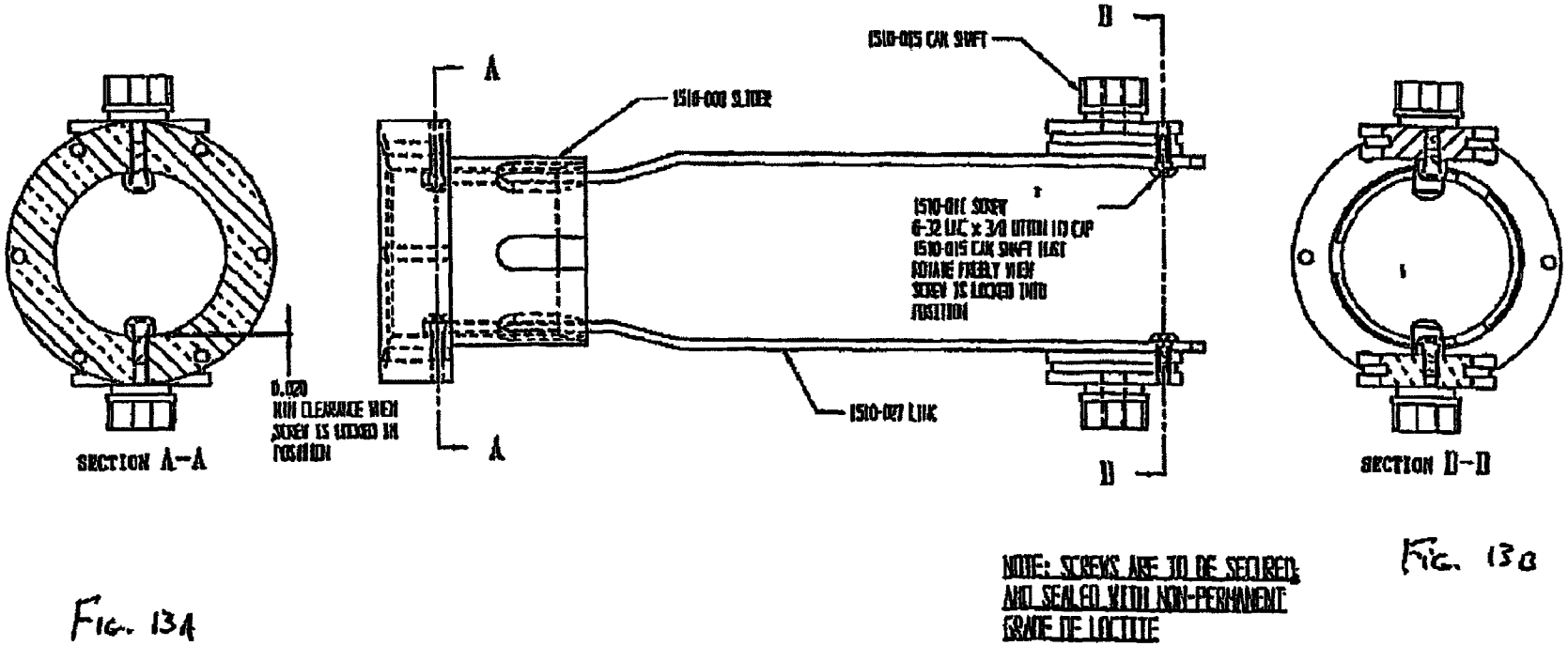
Figure 14:
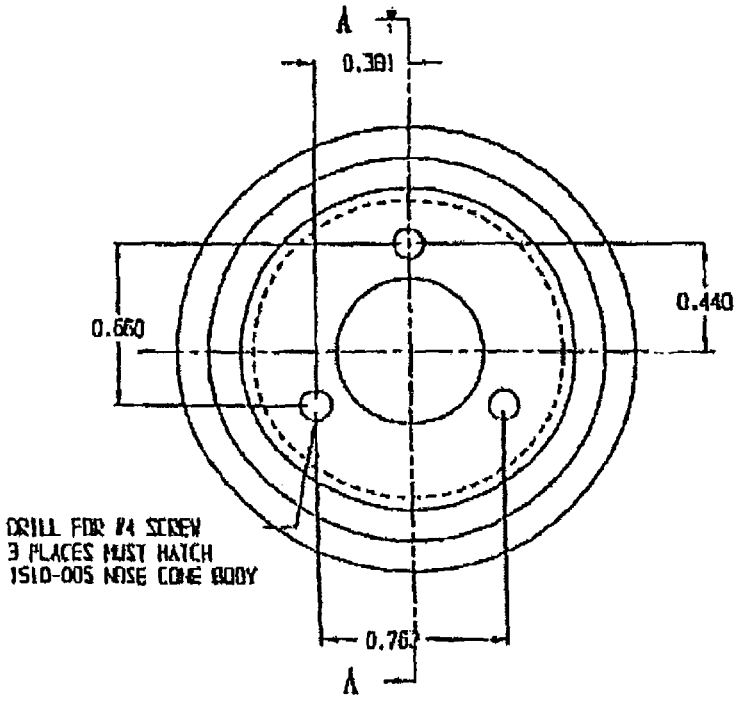
Figure 14A:
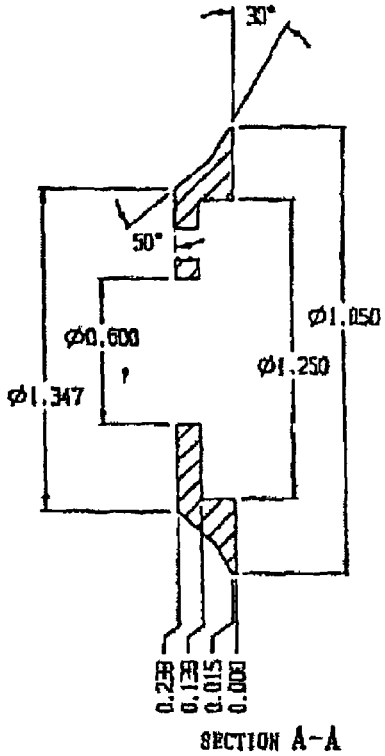
Figure 15:
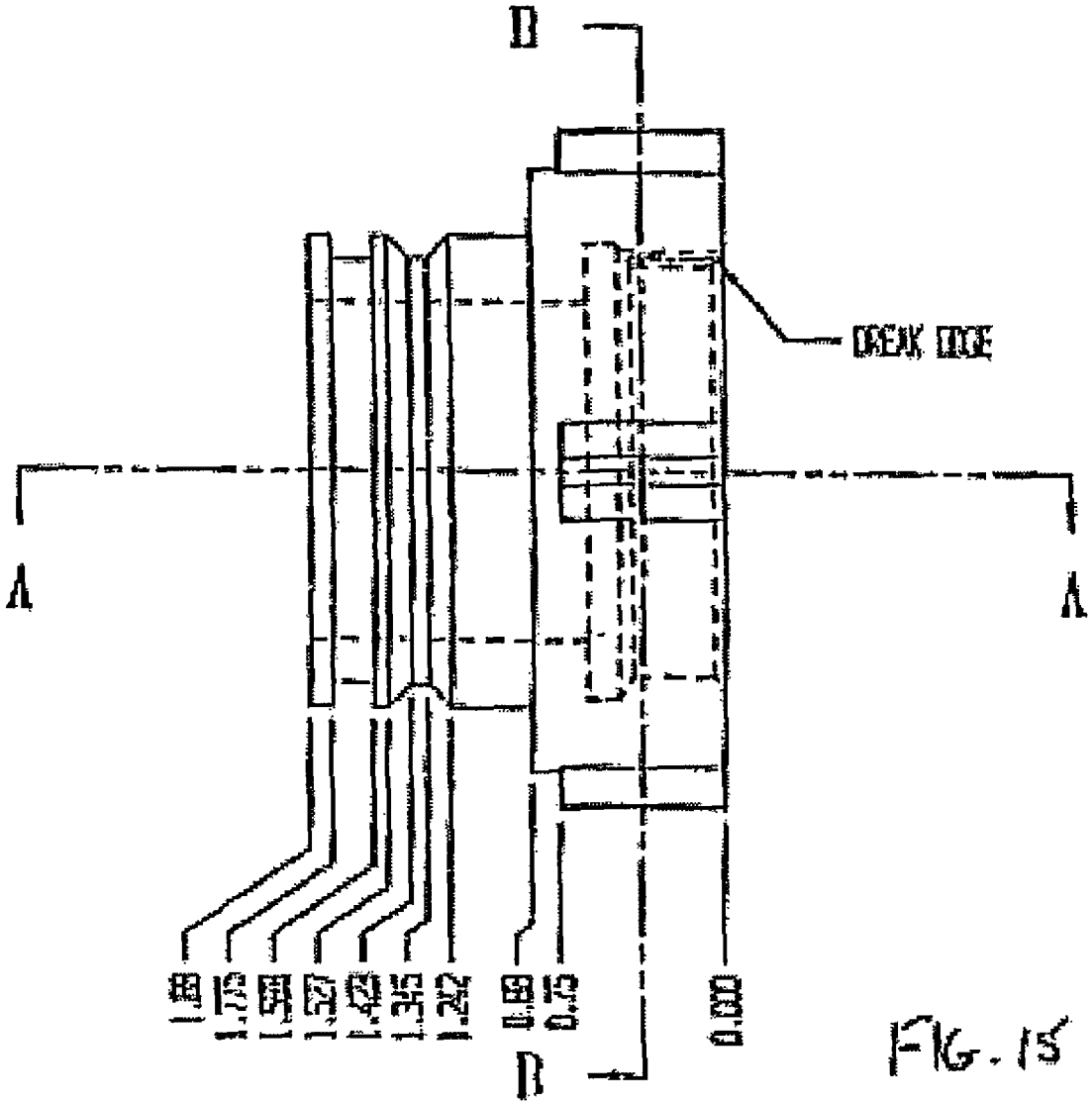
Figure 15A:
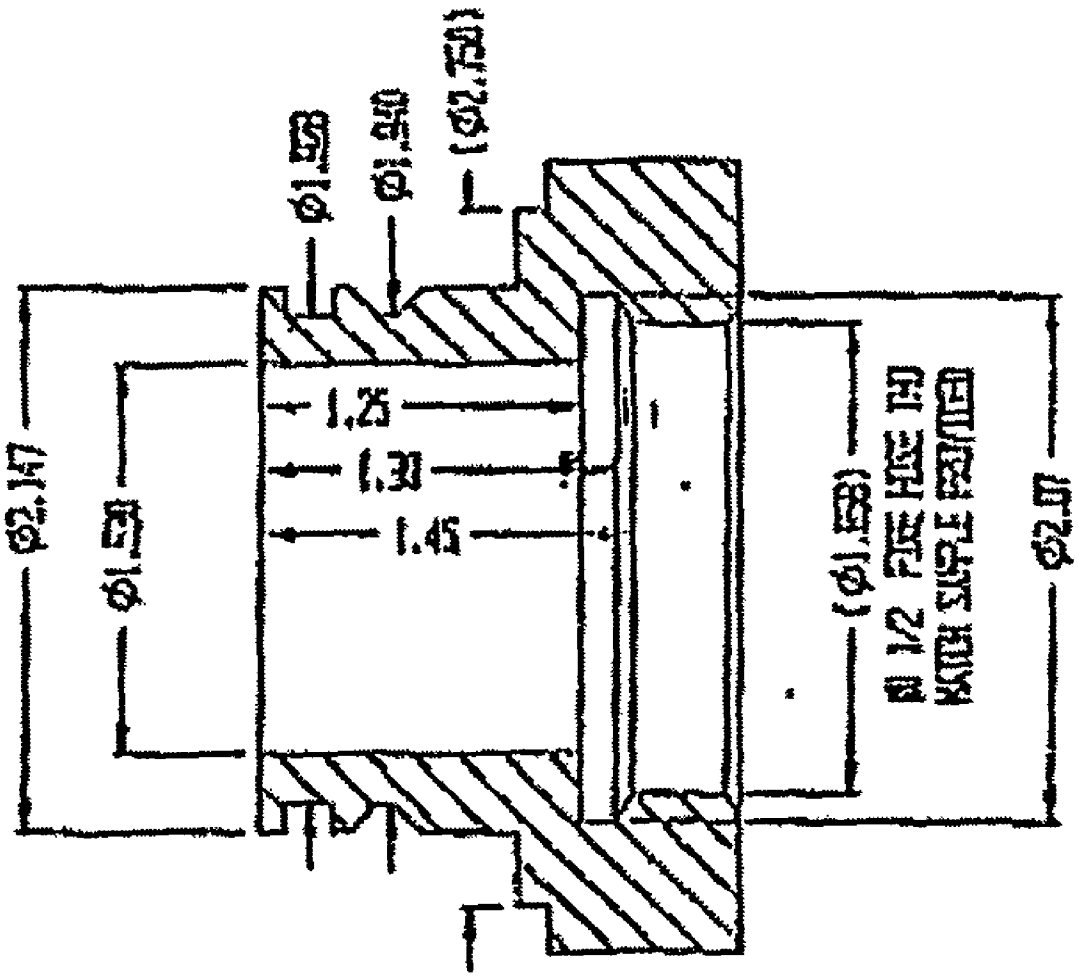
Figures 16, 16A, 16B:
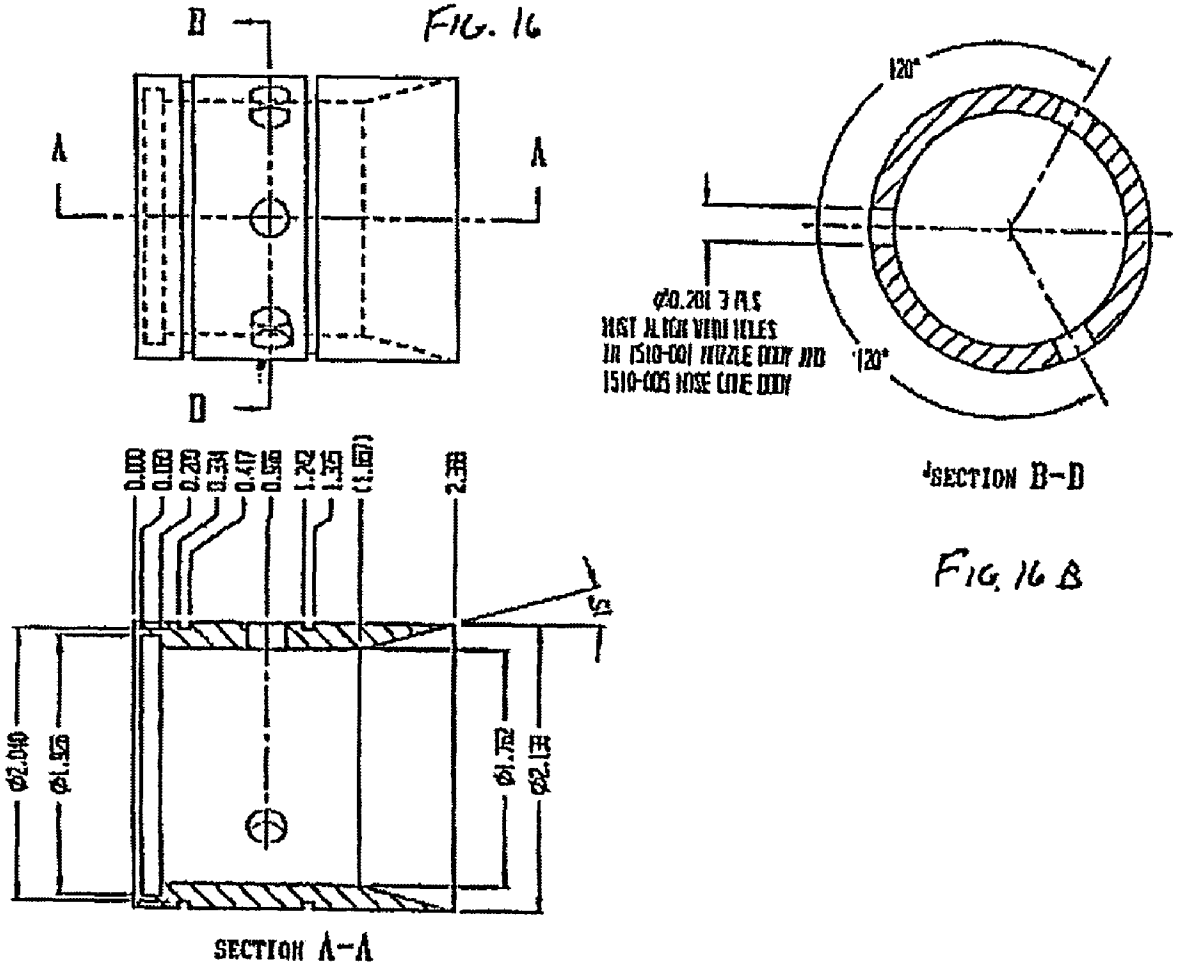
Figure 18:
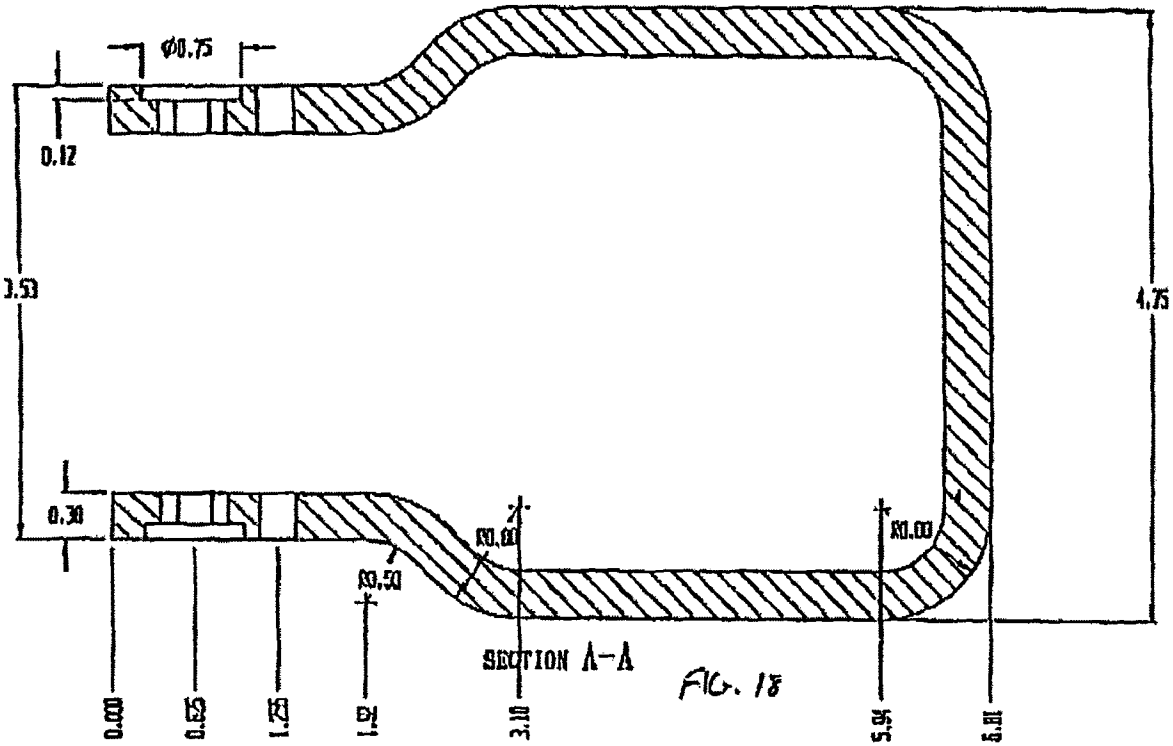
Figure 18A:
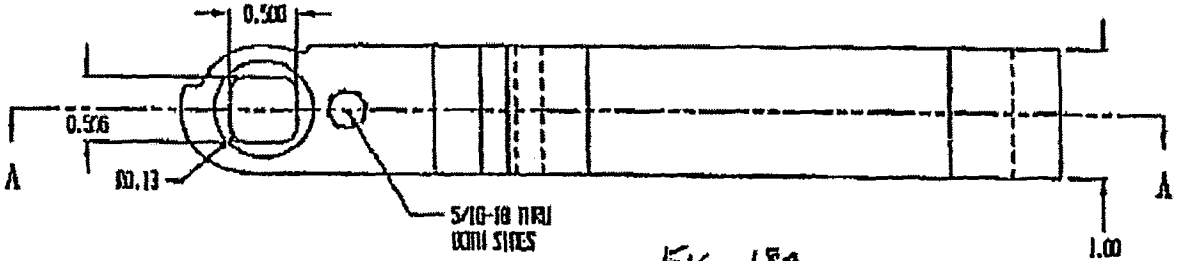
Figures 24, 24A:
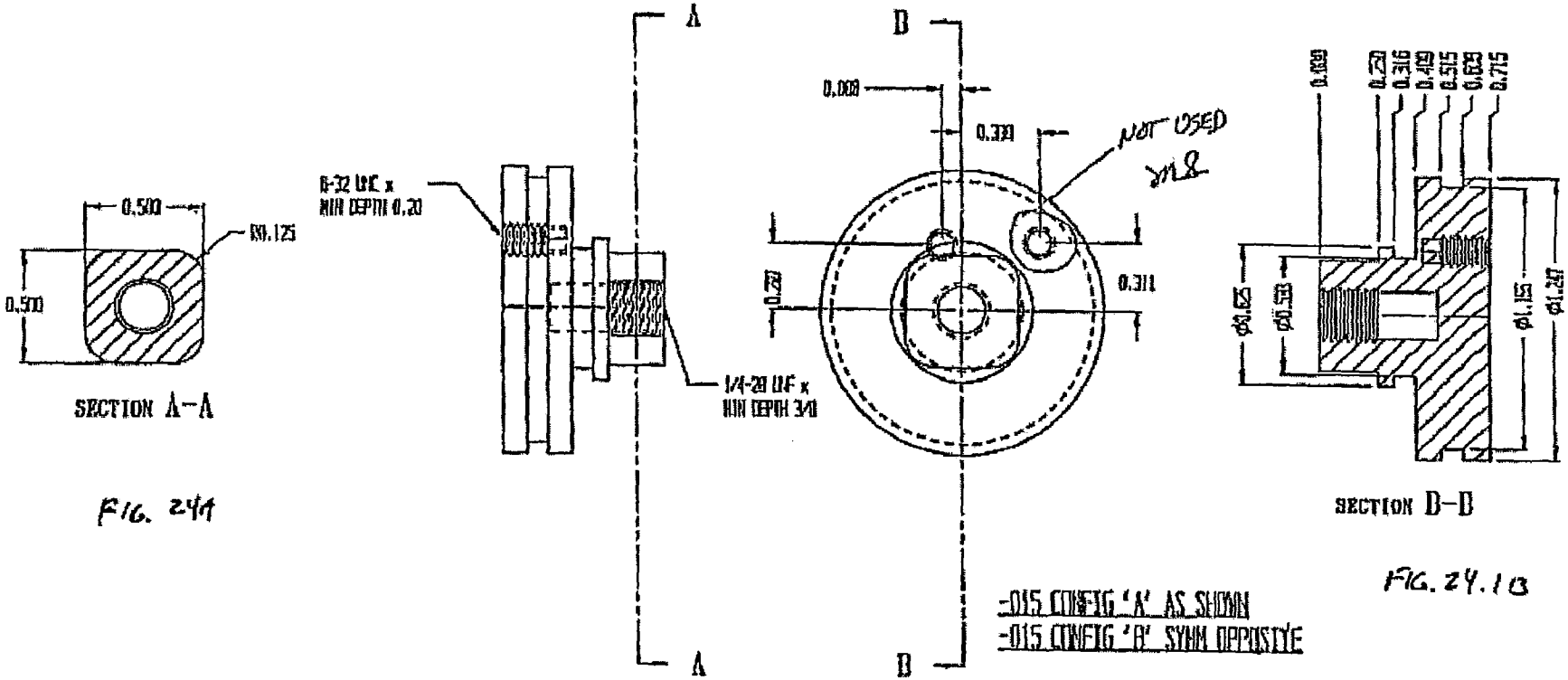
Figures 28, 29, 30, 31:
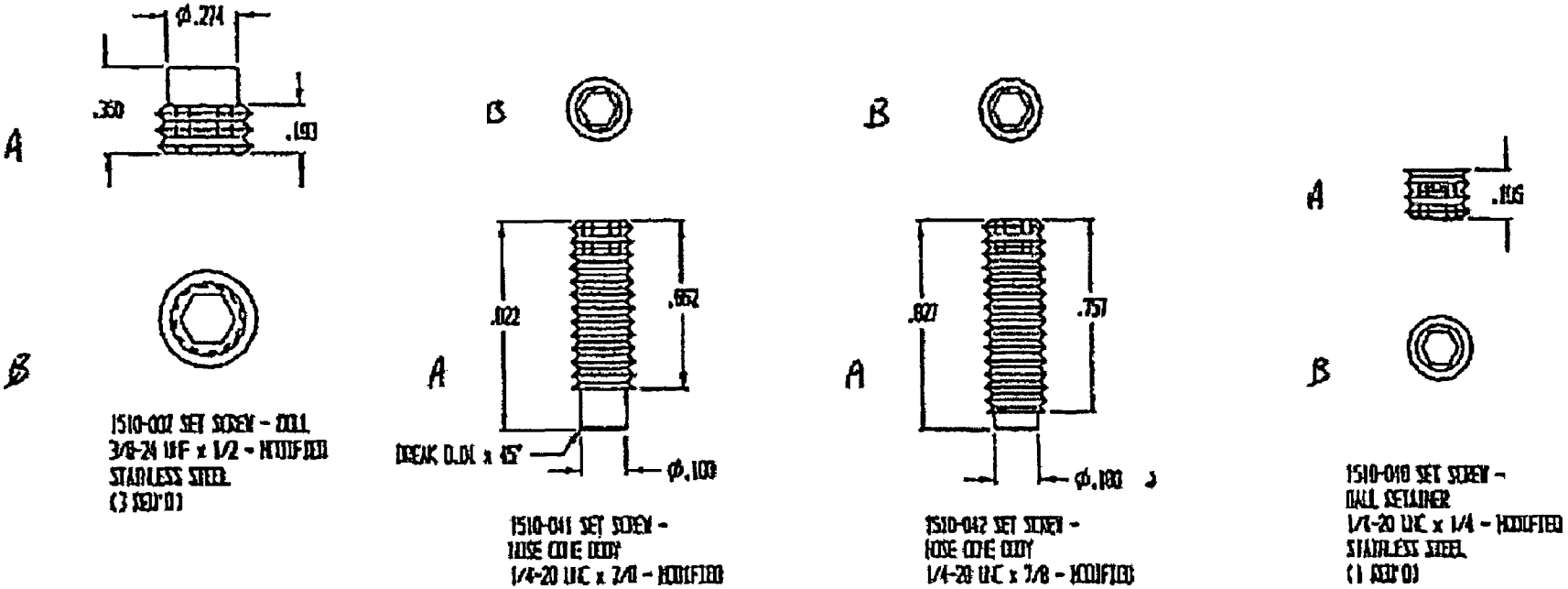
Figure 334:
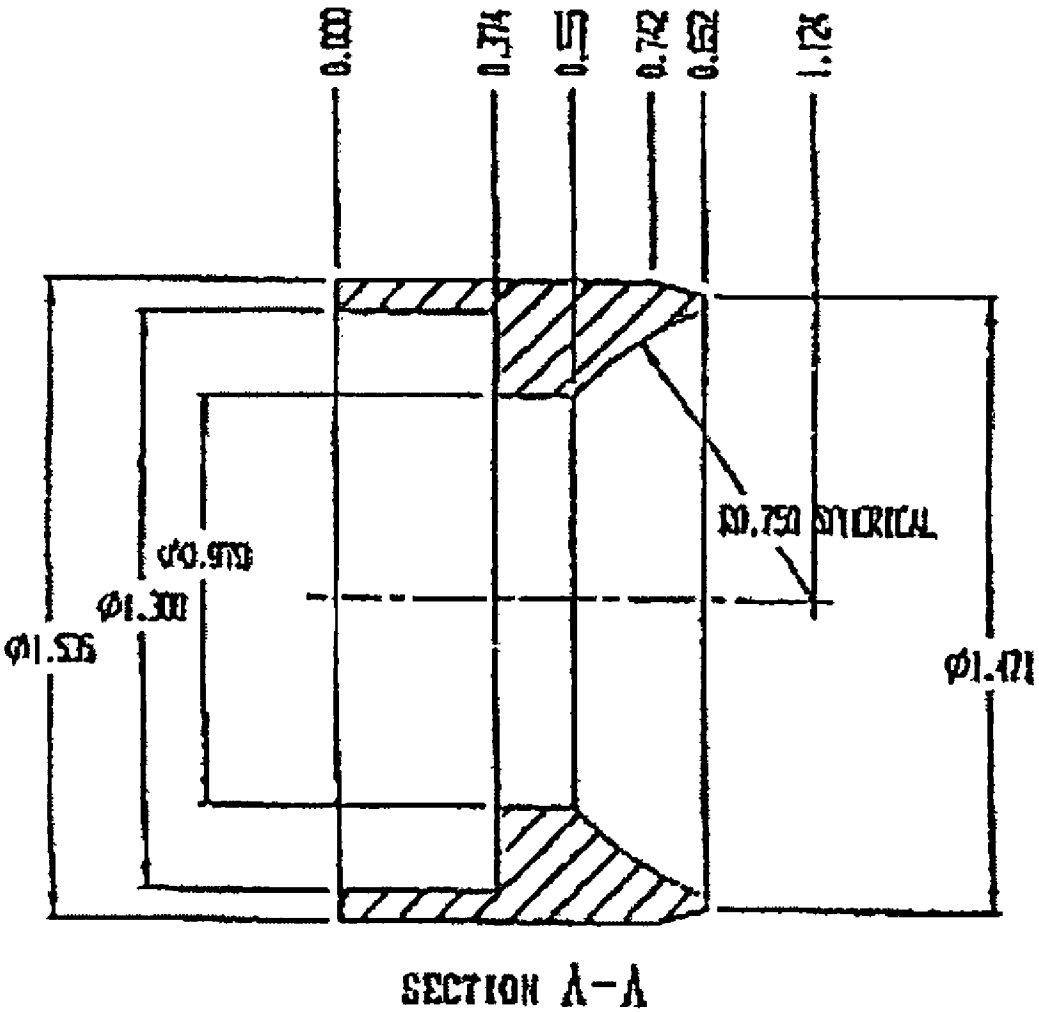
Figure 35:
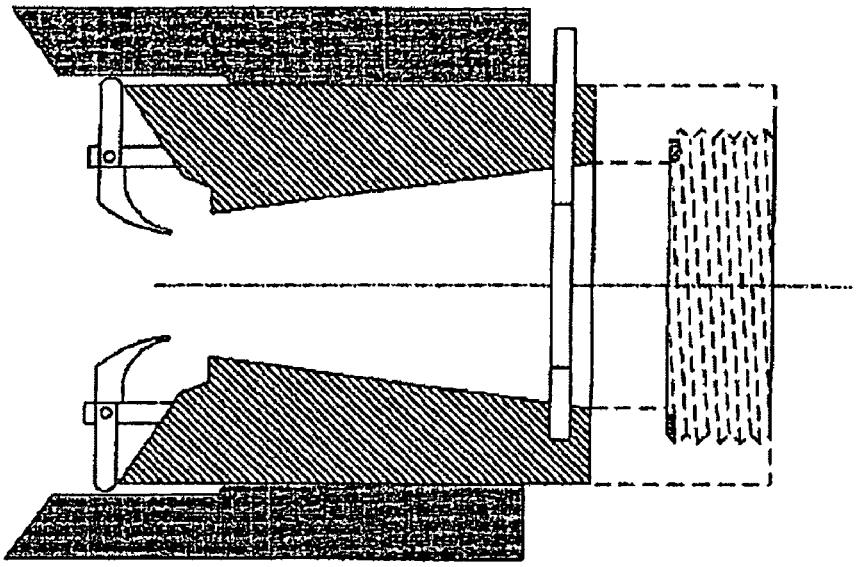
FIGS. 35-49 illustrate various views of different aspects and embodiments of a separate design of a dual flow nozzle invention.
Figure 36:
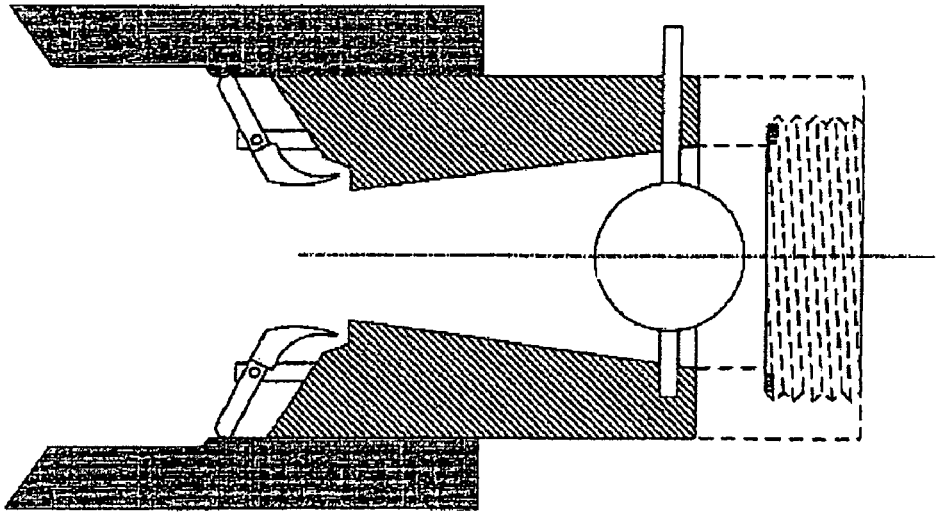
Figure 37:
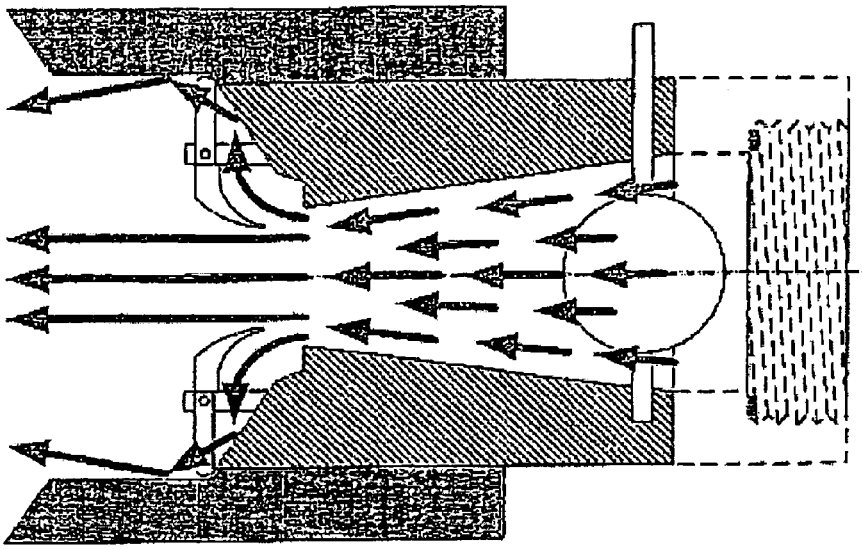
Figure 38:
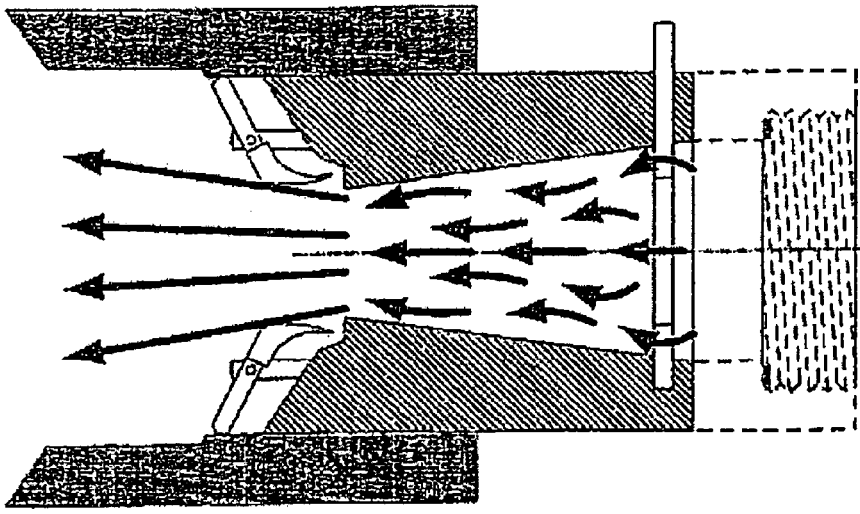
Figure 39:
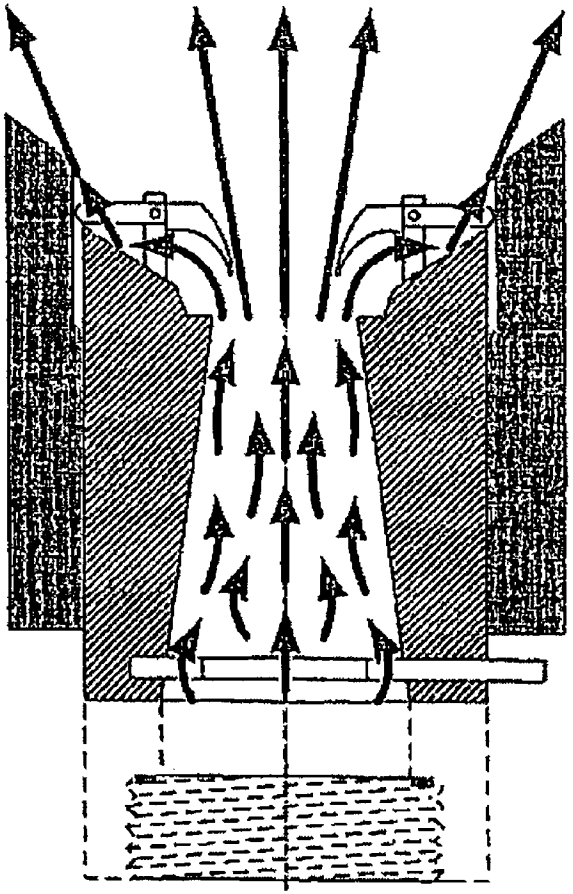
Figure 40:
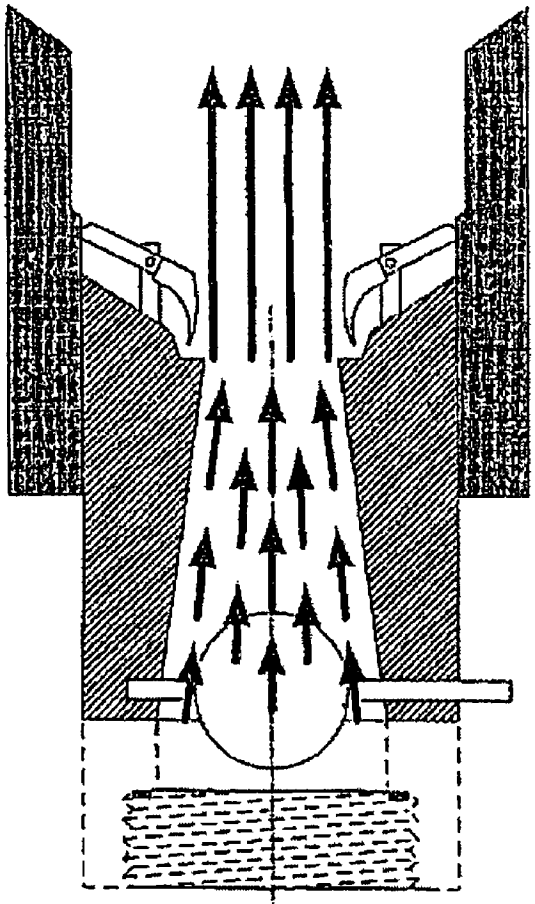
Figure 41:
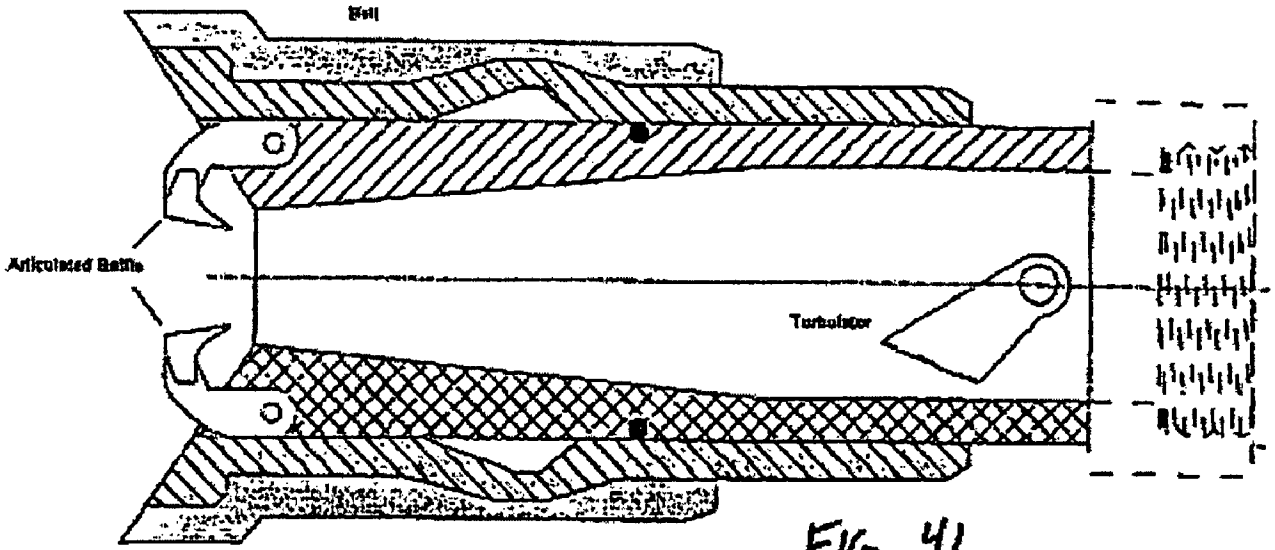
Figure 42:
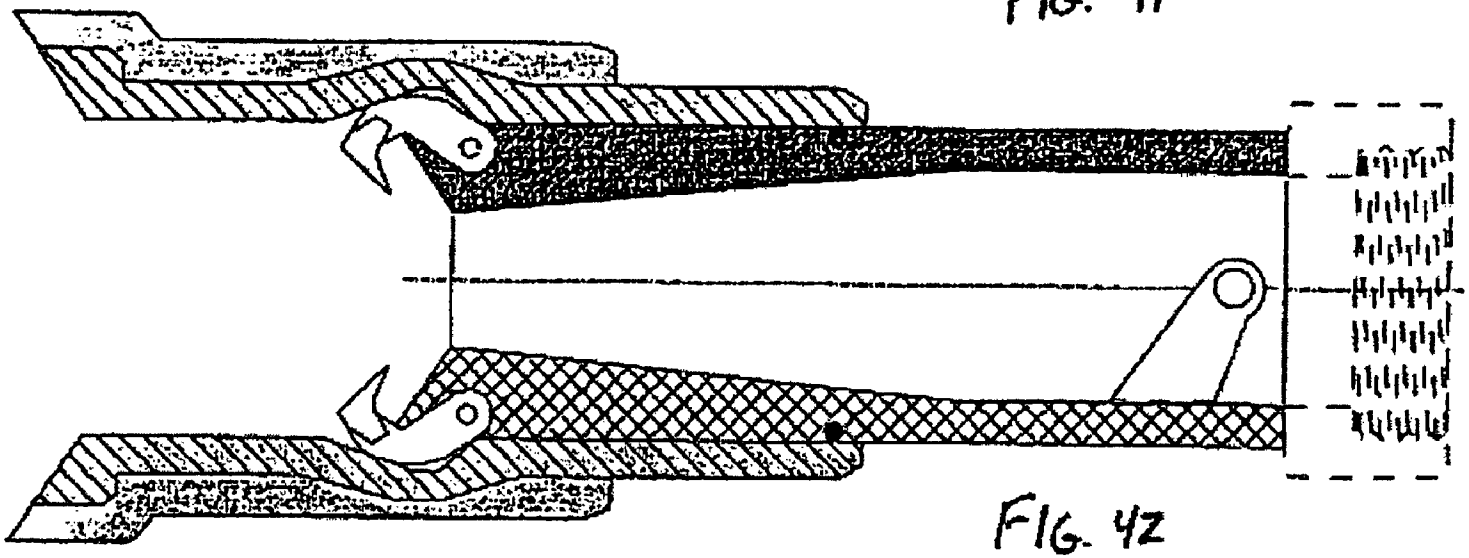
Figure 43:
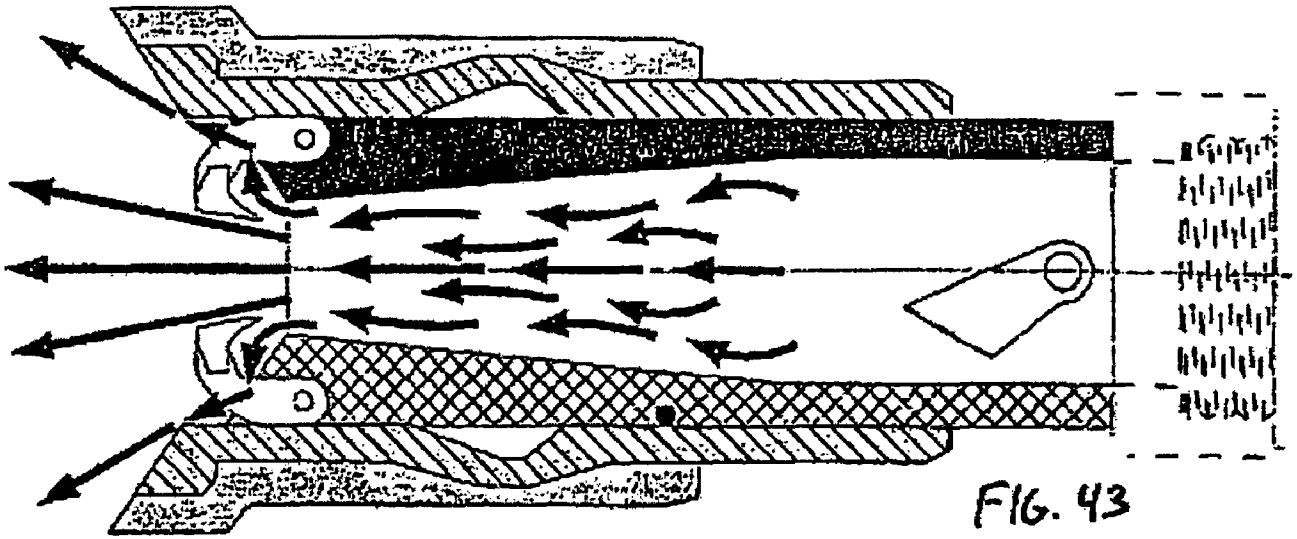
Figure 44:
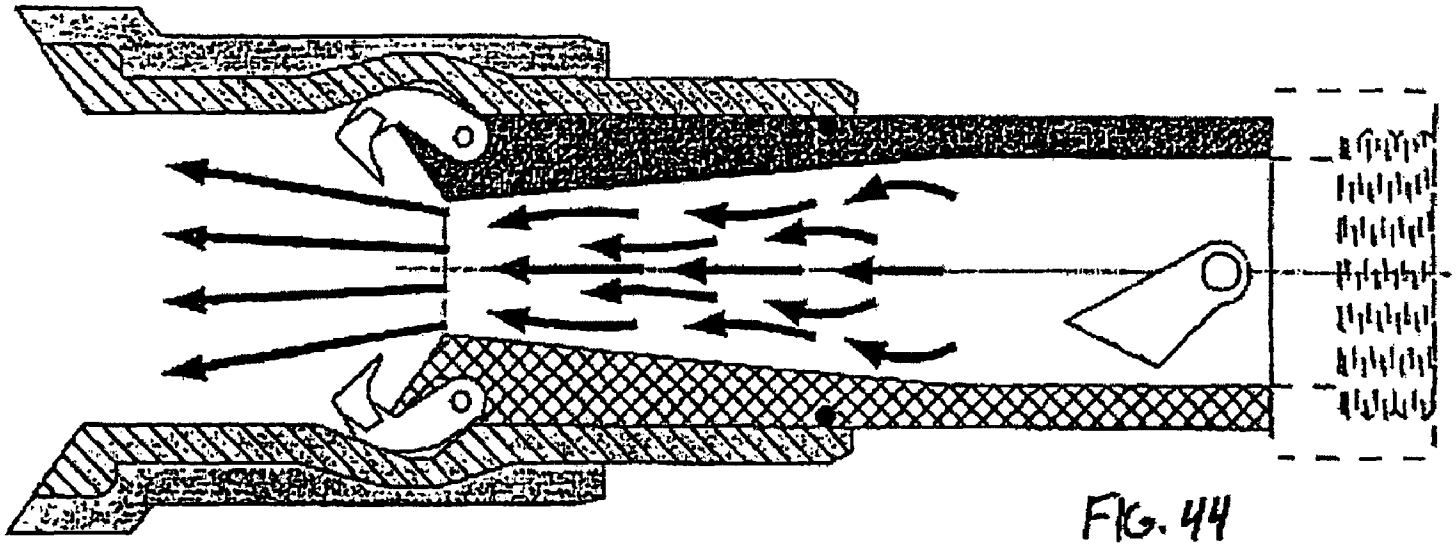
Figure 45:
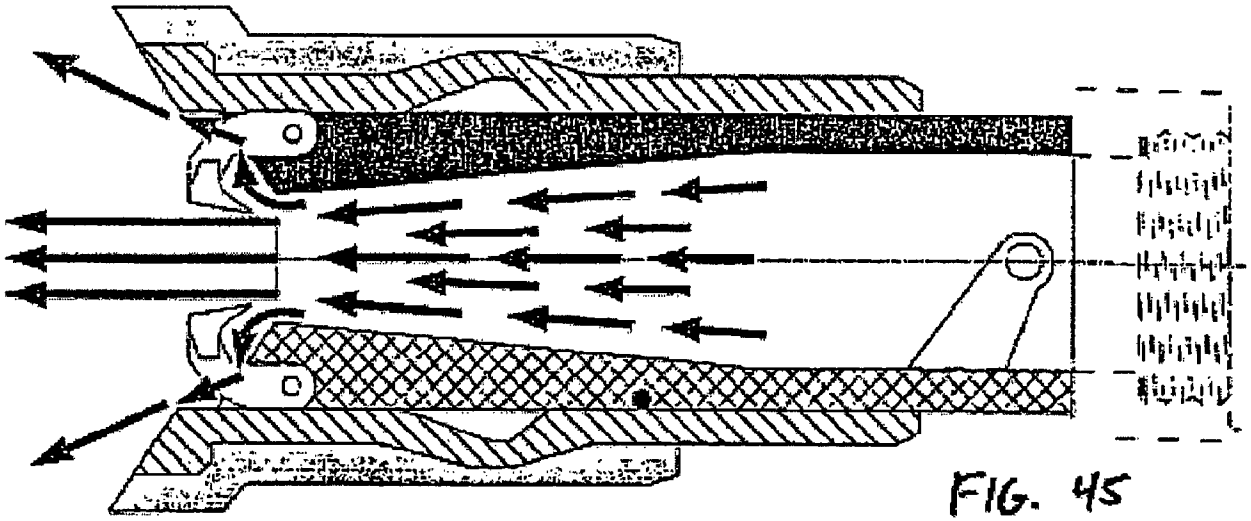
Figure 46:
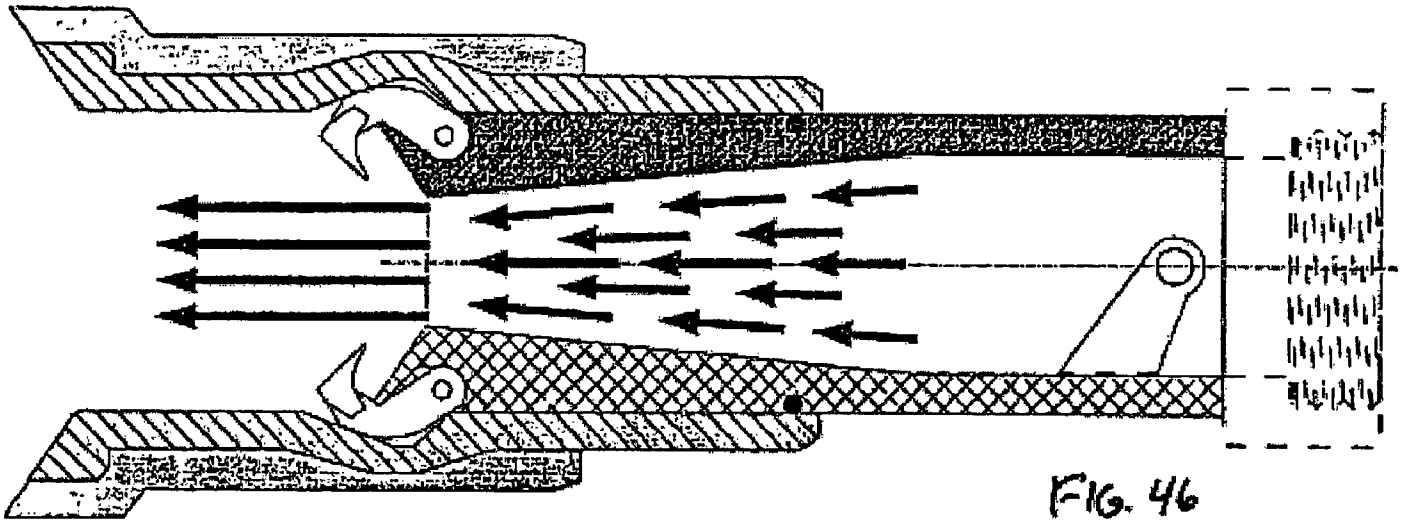
Figure 46A:
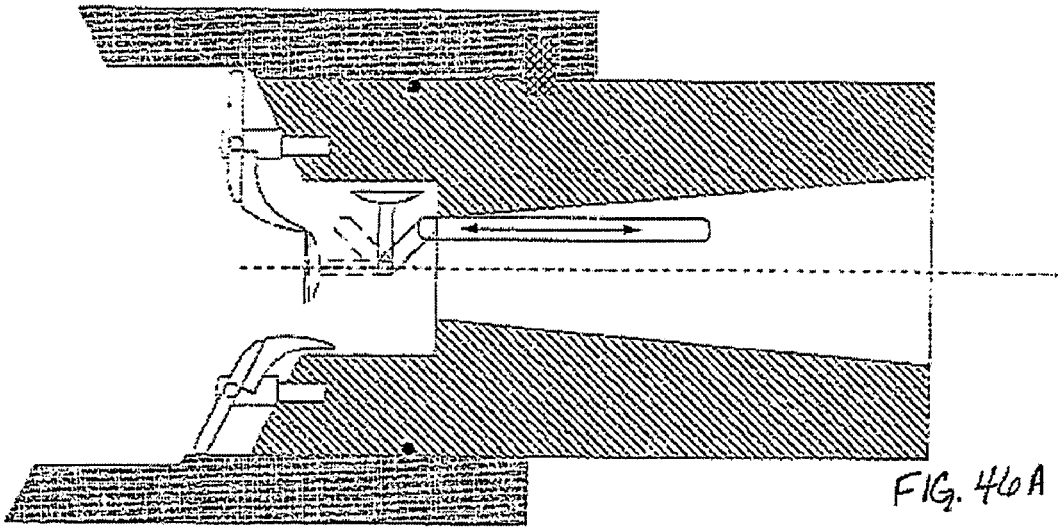
Figure 47:
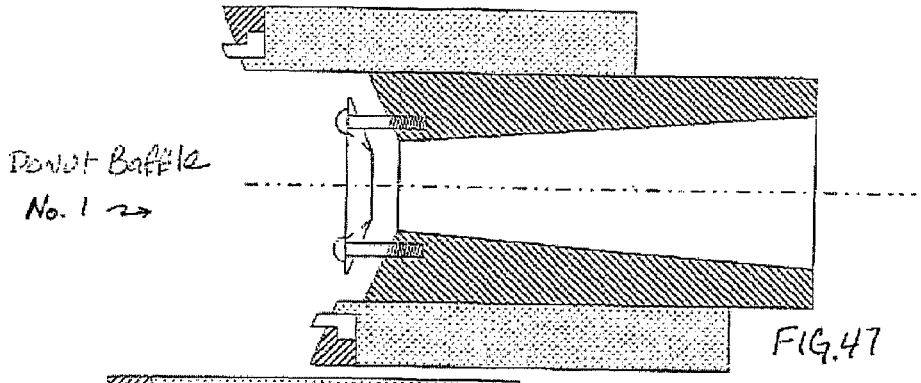
Figure 48:
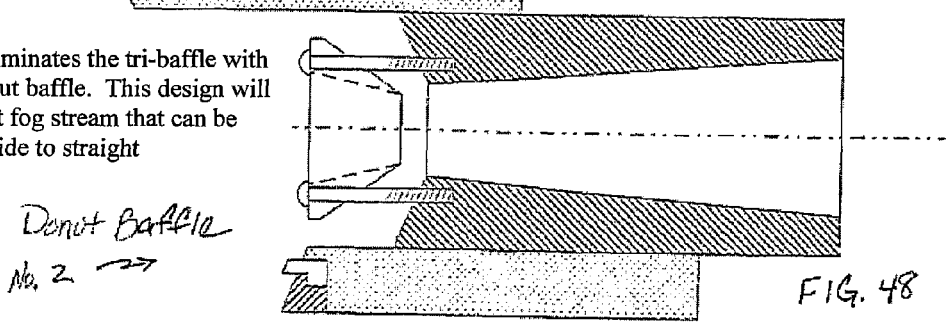
Figure 49:
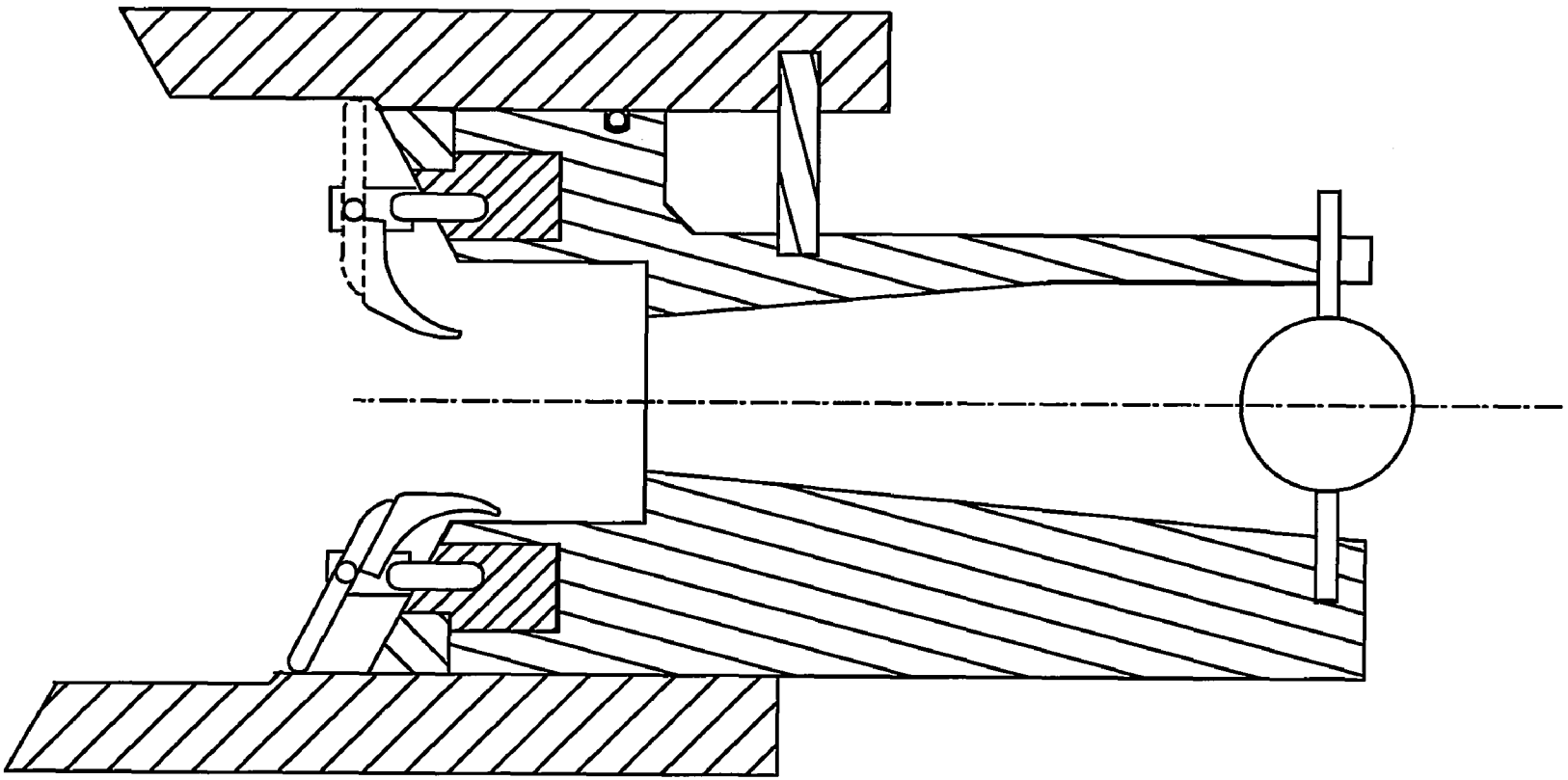

Consistent with FIG. 6, FIG. 8 depicts nozzle 10 with bell 58 in a full-forward position. Accordingly, bell 58, as shown in FIG. 8, depicts nozzle 10 adjusted to produce a relatively narrow-angle fog spray from the second flow path 42*a* that is formed by annular space 42. However, consistent with FIG. 7, but in contrast to FIG. 6, FIG. 8 illustrates slider valve 44 in a half-open position. This is evidenced by the significantly smaller spacial separation between slider seal 56 and slider valve 44 as compared to the full-open position of slider valve 44 depicted in FIGS. 5 and 6. As with FIG. 7, the half-open slider valve 44 position is achieved by positioning slider valve control handle 54 to a half-back position. Obviously, a plurality of positions exists for positioning of the slider valve control handle 54, depending upon the desired amount of flow to be generated in the form of fog spray. Furthermore, bell 58 is used to shape the flow of the fog spray independent of the position of slider 44.

As previously noted, the area between the surfaces circumscribed by the smooth bore outerwall surface 43 and the longitudinal flow chamber inner wall surface 20 defines annular space 42. Annular space 42 is smaller than the discharge orifice between the baffle 55 and the slider valve 44 when the slider valve 44 is in the most-rearward or flush position. This means the flow is normal even in the flush position. This causes the fluid to induce more air into the flow and the flow becomes more turbulent. When a full, wide-angle fog is desired, the turbulence created with the slider valve 44 in this position will cause the wide-angle fog spray stream quality to improve. This additional turbulence, combined with the fog teeth (not shown) present on bell 58 creates a superior wide-angle fog quality. When flowing a water/foam solution, this setting's additional turbulence will mix the solution while incorporating air. Furthermore, the most rearward position of slider valve 44 allows for the flushing of large debris that may have been carried in the fluid supply. Alternately, nozzle 10 may incorporate an annular space 42 that is greater than the discharge orifice between the baffle 55 and the slider valve 44 when the slider valve 44 is in the most-rearward position. This alternate arrangement allows the flow quality to remain unchanged, with respect to turbulence and not flow rate, no matter what position the slider valve 44 is placed in.

In yet another aspect of the present invention, slider valve 44 preferably possesses slider upgradient edge 46 that is advantageously beveled, or otherwise has a narrow or low profile in terms of its exposure to the fluid flowing radially to the interior of the slider valve 44. This feature greatly reduces the blunt surface area of the slider valve 44 that is impacted by the rushing fluid that is exiting nozzle 10. Accordingly, the friction forces applied to slider valve 44 are reduced, and therefore, slider valve 44 has a reduced tendency to close as a result of fluid flowing through the fog tip.

Also aiding in reducing the frictional fluid forces on the slider valve 44 is the presence of inner wall contours 60 along the longitudinal flow chamber inner wall surface 20. The inner wall contours 60 serve to guide the fluid around the leading edge or slider upgradient surface 46 of the slider valve 44, thereby reducing friction forces applied to slider valve 44. Accordingly, slider valve 44 has a reduced tendency to close as a result of fluid flowing in nozzle 10.

Further assisting with countering the frictional fluid forces on the slider valve 44 is the presence of detents 62 in the slider valve control handle connection 64. The detents 62 are indentations in the slider valve control handle connection 64 that receive a spring-loaded ball (not shown) incorporated in the slider valve control handle 54. The detent position not only assist in countering the frictional fluid forces acting on the slider valve 44, but also serve to indicate to the nozzle operator the flow position for the fog tip. Therefore, the a plurality of detents 62 can be provided that range from completely off to full-on. Also assisting with countering the frictional forces on the slider valve 44 is the friction between it and the o-ring seal 66 located between the 44 and the main nozzle body. More and tighter o-ring seals 66 could be used.

In another aspect of the present invention, air moving in the space between the deluge and fog spray streams is at a lower pressure than the static air outside the fog spray stream, which is at atmospheric pressure. The air at atmospheric pressure outside the stream spray acts to prevent both streams from broadening outwardly as they travel away from nozzle 10, and makes both more aerodynamically efficient. With adequate supply pressure, the two streams flowing simultaneously will each travel further than the flow from smooth bore 30 alone.

An additional separate embodiment comprises a valve that automatically adjusts the flow. More particularly, the valve can be placed at any location along a flow path, and compensates for changes in the fluid supply pressure so as to automatically maintain a constant pressure, provided the supply pressure always exceeds the desired flow that is set by the valve operator.

Although present invention has been presented and discussed to relate primarily to fire fighting nozzles, the nozzle embodiments presented herein are also applicable to lawn and garden nozzles, sprinkling equipment, snow making equipment, power washing equipment, fuel injectors, perfume sprayers, and other types of spray applicators. Furthermore, while the above description and the drawings disclose and illustrate numerous alternative embodiments, one should understand, of course, that the invention is not limited to these embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments as incorporate those features which constitute the essential features of this invention.

Dual flow nozzles of the prior art are capable of producing a fog stream pattern and/or a smooth bore pattern. (The two flows can be independent or simultaneous).

Normally, fire nozzles are attached to hoses which are fed water by a pump. The pressure at the nozzle inlet will govern the amount of flow in gallons per minute (GPM) that will be expelled from the nozzle. The inlet pressure to the nozzle is a function of the relationship between the area(s) of orifice through which the water is expelled and the pump rate. For example, if the exit orifice increases while the pump rate is maintained, the inlet pressure will drop. The GPM will increase due to the increased area of the exit orifice. However, this GPM increase will be tempered by the decrease in inlet pressure. In another example, the exit orifice is held by a constant area and the pump rate is increased. In this example, the flow (GMP) will increase due to the increase in nozzle inlet pressure.

Dual flow nozzles of the prior art are subject to changes in GPM when various combinations of flow types are selected. A nozzle flowing water through just the smooth bore tip will experience difficulties once the second fog tip is engaged. Once the second tip is engaged, the exit orifice is immediately enlarged (combination of the exit orifice of the smooth bore and that of the fog tip). The pump rate, remaining unchanged, is now inadequate to maintain the inlet nozzle pressure. This results in a nozzle, which flows more water, but lacks the pressure to expel the water with effective reach. The pump operator will/should eventually notice the loss in pressure. He/she will then increase the pump rate to re-build pressure. Once this occurs, the nozzle operator will have a difficult task. The reach is restored, but the GPM has now increased again due to the increase in pressure. The nozzle operator will now have to overcome the additional force to hold onto the nozzle. If the nozzle operator then shuts off one tip, the pump rate which has not yet been adjusted down, will cause an immediate and unsafe increase in inlet pressure.

The 2 series design operates with a unique principle. The principle is to maintain a constant flow (GPM) with a constant inlet pressure when operating one or two tips. This is done by manipulating the exit orifices so that the total area of discharge remains relatively unchanged when switching from 1 to 2, or 2 to 1 tips. This is accomplished by adjusting the area of the fog tip's orifice. The fog tip area of discharge is decreased when the smooth bore is in simultaneous operation and increases when the smooth bore is off. Therefore, the total flow (GPM) is maintained as well as the pump rate and inlet pressure. The hydraulics are constant without adjustment of the pump.

The total exit orifice area is slightly greater when just the fog tip is enabled. This is because the fog tip orifice is slightly less efficient than that of the smooth bore. This additional area is therefore necessary to maintain a constant GPM and inlet pressure when just the fog tip is enabled.

Fog tip orifices are donut shaped and smooth bore orifices are a simple round hole.

Overview of 2-Series Improvement

The 2-series design represents an improvement over all single tip designs (most common nozzle) by allowing for independent or simultaneous flow of two tips; a smooth bore and fog style tip.

The existing 2-series design represents an improvement over other dual flow nozzles (SaborJet and all other dual flow designs of the past) by featuring a throttle valve that allows nozzle operators to maintain flow and pressure when switching between 1 and 2 tip operation. The existing 2-series design has separate controls for the smooth bore tip and the fog tip. With the existing design, nozzle operators maintain flow and pressure when switching from one tip operation to two-tip operation by adjusting the throttle valve. For example, if a firefighter was using just the fog tip and then enabled the smooth bore as well, he/she would have to diminish the flow out of the fog tip (via the throttle operated by the handle) so that the combined gpm was approximately equal to the flow rate of just the fog tip. If the firefighter did not maintain the same gpm (approximate), the supply pressure to the nozzle would drop. This unwelcome drop in pressure would diminish the reach and efficacy of the stream(s) until the pump operator noticed the change and compensated the pump rate to restore the desired pressure. Conversely, if both flows were full open and then the nozzle operator shut off one of the tips, a sudden, unwelcome rise in pressure would exist until the pump operator noticed the change and compensated the pump rate to restore the desired pressure.

Starting with the fog tip enabled, the nozzle operator must turn the knob to turn on the smooth bore tip and then immediately adjust the handle to throttle down and reduce the gpm of the fog tip. Thus, the firefighter must manipulate two control devices (knob and handle), to correctly make the transition from 1 tip to 2 tips or from 2 tips to 1 tip. The improved design eliminates the knob, plus takes the guesswork out of the placing the handle in the correct position to maintain flow and pressure. This is accomplished by linking the operation of the ball valve and the throttle to the same control device—the handle.

Description of 2-Series Design Operation with Single Control Handle

FIG. 9

Depicts the dual flow nozzle with a separate on/off control for the ball valve (knob) of the smooth bore and on/off/throttle control (lever handle) for the fog tip.

FIG. 10

Depicts a gear drive system that allows a single control (lever handle) to operate both the on/off/throttle of the fog tip and the on/off ball valve of the ball valve. The large gear is affixed to the handle lever and the small gear is attached to the axis of the ball valve. In this embodiment, the ball valve's knob has been eliminated and it's axis of rotation has been shifted 90 degrees so that this axis of rotation is parallel to the axis of rotation of the lever handle. The gears are shown to be external but they can be internal as well. Hidden from view are detent positions to accurately position the lever handle between three positions—full forward; vertical; and full aft. The small gear is ½ the diameter of the large gear. This relationship provides twice the rotation of the small gear vs. the rotation of the large gear. Therefore, when the handle is turned 45 degrees the small gear turns 90 degrees. Both the fog tip and the smooth bore are in the off position in FIG. 10. The ball valve of the smooth bore is symbolically portrayed to the left of the nozzle so its movement can be easily tracked.

FIG. 11

This handle position turns the ball valve of the smooth bore full open and the fog tip partially open. A certain linkage relationship to the internal slider valve (not shown) allows the fog tip to be in the partially open position. For this example lets assign gpm values of 100 gpm@65 psi for the ball valve and 75 gpm@65 psi for the fog tip for a total of 175 gpm@65 psi. The vertical handle position provides for dual flow operation. However, a simple twist shut off position of the bell (common feature of many existing nozzles) would allow the nozzle to operate with the fog tip shut off and only 100 gpm@65 psi expelled by the smooth bore only. This method of twist shutoff would provide for smooth bore flow operation only. The 65-psi would have to be achieved by the pump operator's manipulation of the pump to lesson the flow of water to the nozzle when the bell is twisted to off (shutting off the fog). If the pump operator doesn't lesson the pump flow rate, the pressure will exceed 65 psi and allow more than 100 gpm to be expelled by the smooth bore. This would be an "automatic" way to maintain the higher rate of flow (approximately 175 gpm@a pressure greater than 65 psi).

FIG. 12

This handle position once again shuts the smooth bore tip's ball valve while placing the fog tip in full open. A certain linkage relationship to the internal slider valve (not shown) allows the fog tip to be in the full open position. The full aft handle position provides for fog tip operation only. The fog tip's full open position is designed to flow 175 gpm@65 psi, thereby maintaining a constant flow and pressure. The constancy of the hydraulics simplifies the pump operator's tasks at the fire scene.

FIGS. 13-34.2 illustrate various views of an embodiment of the invention.

In a separate embodiment of a hose nozzle apparatus, the 3-series design, another version of a dual flow nozzle, represents an improvement over all single tip designs (most common nozzle) by allowing for independent or simultaneous flow of two tips; a smooth bore and fog style tip.

The 3-series design represents an improvement over other dual flow nozzles (SaborJet and all other dual flow designs of the past) because it doesn't change its flow rate or operating pressure no matter which combination of tips/flows are selected. It achieves this by maintaining a constant size/shape exit orifice. Flow shaping is done after the water has been expelled. Therefore, all the energy supplied in the form of supply pressure is already converted to velocity at atmospheric pressure before any of the stream shaping is begun. All other fog capable style nozzles, redirect the water, via a baffle, in radial and perpendicular relation to the line of the hose and nozzle. The 3-series design allows the nozzle to operate with low supply pressure. This is advantageous for many reasons including:

- Less nozzle reaction (force required to hold back the nozzle).
- Operates well when water supply is limited.
- Fire departments with fewer personnel can limit the amount of staff dedicated to holding the hose.
- Water can be placed on the fire scene early with lower pressures and then as more firefighters arrive to hold the hose more pressure can be applied.
- Because this fog nozzle also has a smooth bore tip it will have greater reach at lower pressure than a fog nozzle in straight stream. This is due to the efficiency of the simple exit orifice (a simple round orifice). The expelling water leaves with more velocity than the water expelled by a fog tip (donut orifice) at equivalent pressure.

Flow shaping is done by two components—a tri-baffle and a turbulizer. The tri-baffle (can be two or more segments) enables an outer fog pattern and the turbulizer creates an internal fog pattern. The tri-baffle can be made to separate in three different components and fold out of the path of the expelled water. The three components can also unfold and form a tri-baffle that is in the path of the expelled water. Rotating the bell controls the tri-baffle. The rotation of the bell moves the bell forward and aft.

In an alternate embodiment, an iris valve is used in place of the tri-baffle. Rotating the bell controls the iris valve. In a manner similar to that previously noted, rotation of the bell moves the bell forward and aft.

A knob controls the turbulizer. The knob of the 3-series design, has 90 degrees of rotation but it can rotate more. The turbulizer maintains non-turbulent flow in one setting. In other settings, the turbulizer creates varying degrees of turbulent flow.

FIG. 35

Depicts the bell in a position that enables the outer fog pattern and shapes the outer fog into a straight stream. This bell position allows the spring-biased (bias is to the position shown) tri-baffle segments to fold down, forming the tri-baffle. This position of the tri-baffle will peel off and the outer radial column of the expelled water. The "peeled" water will form a fog pattern. The upper arms of each of the three segments of the tri-baffle, is skinny to minimize its interaction with the water. The turbulizer (looking like an upside down lollipop) is in the non-turbulent flow position. The non-turbulent position will allow the center column of the expelled water to form a smooth bore stream.

FIG. 36

Depicts the bell in the most forward position. The small shoulder along the ID of the bell impacts the upper arms of the tri-baffle segments. This shoulder pushes the tri-baffle segments out of the path of the expelled water. The turbulizer is in a turbulent flow setting. Therefore all water expelled will leave in a fog-type pattern.

FIG. 37

Depicts the flow of water and the stream shapes when the bell is adjusted to produce a straight fog pattern and the turbulizer is set in the non-turbulent flow position.

FIG. 38

Depicts the bell in the position which folds the tri-baffle segments up and out of the way of the expelled water. The turbulizer is set in a turbulent position. This type of stream will produce a forceful, somewhat narrow fog comprised of big water droplets. Big water droplet fog patterns are useful to firefighters when battling interior fires. The larger droplets limit the amount of steam generation and reduce the risk of burns due to steam contact.

FIG. 39

Depicts the flow of water and the stream shapes when the bell is adjusted to produce a wide fog pattern and the turbulizer is set it a turbulent flow position. This produces a full fog, as the center of the stream also contains a fog pattern. This is an improvement over ordinary fog nozzles that produce a hollow cone of fog.

FIG. 40

Depicts the bell in the position which folds the tri-baffle segments up and out of the way of the expelled water. The turbulizer is set it the non-turbulent flow position. This arrangement produces a full smooth bore stream.

Additional Discussion

In the above preferred embodiment, a non-pressure method is presented wherein the distance of the tri-baffle from the expelled water allows for debris of up to ¼ inch in diameter to pass.

In a separate embodiment, the tri-baffle is located closer to the discharge orifice so that when the tri-baffle is in the closed position, pressure builds behind it and it begins to behave like a rigid baffle.

All FIGS. (35-40) show nozzles designs without a main ball valve shut-off. All embodiments can either have a main ball valve incorporated (not shown) between the turbulizer and threaded hose connector, or a detachable main ball valve can be connected between the nozzle (as shown) and the hose.

Additional 3 Series Nozzle Embodiments:

This nozzle design allows for independent or simultaneous operation of a fog tip and smooth bore tip. A throttle is not needed since the area of discharge remains unchanged. Therefore the hydraulics remains constant with any and all stream pattern selections.

FIG. 41

The articulated baffle strips water from the periphery of the column of water expelled out of the smooth bore tip. The articulated baffle shown would have four individual segments (although our prototypes have ideally three). The bell is position to its most aft setting. This setting will produce a wide-angle fog with the peripheral water while the articulated baffle will not impact the center of the column of water.

The turbulator is set in a position that will disrupt the normal, laminar flow through a smooth bore. With this turbulence, even the center of the expelled column of water will be expelled in a narrow fog pattern. This narrow fog pattern is comprised of relatively large water droplets. The larger water droplets are useful for fighting interior fires. Larger water droplets minimize steam generation. Scalding from steam generation is a concern for fire fighters when battling interior fires.

FIG. 42

The bell has been rotated to its most forward position. This position aligns interior recesses in the ID of the bell with the spring biased baffle segments. The spring bias and the force of the water propel the baffle segments to lift out of the path of the expelling water column. The water stripped by the articulated baffle was shaped in a progressively narrower pattern as the bell was rotated forward.

The turbulator is set in a position, which preserves the laminar flow of the smooth bore. Thus the water is expelled in a solid, straight stream.

FIG. 43

Shown are deployed articulated baffle, the bell in a straight stream position and the turbulator in the "fog" setting. The resulting flows are a wide-angle, fog stream surrounding a narrow fog stream with large water droplets. This better than a traditional fog pattern since traditional nozzles have a hollow fog pattern.

FIG. 44

The bell is positioned to allow the articulated baffle segments to be raised out of the path of the expelled water. The turbulator is set in the "fog" position. The resulting stream is a narrow fog with larger water droplets.

FIG. 45

The Turbulator is set in the straight stream position. The bell is positioned to a wide-angle setting. The resulting flows are a center, straight, solid stream surrounded by a wide-angle fog pattern. This combination of stream types allows for simultaneous, maximum penetration to the source o the fire with fog protection for the fire fighter.

FIG. 46

The Turbulator is set in the straight stream position. The bell is positioned to allow the articulated baffle segments to be raised out of the path of the expelled water. The resulting flow is a solid, straight stream.

FIGS. 46A-49

Alternate series 3 embodiment are depicted in FIGS. 46A-49.

Additional Improvements of the 3 Series Design:

Unlike prior twin tip nozzles (2 series and the SaborJet), this design allows for complete nozzle shut down utilizing one control—a traditional handle or bail controlling an a valve (not shown). Ideally, this would be an integrated ball valve. However, the valve is not limited to a ball type and doesn't have to be integrated.

Supplemental Description

In a separate embodiment, the nozzle includes a smooth bore for generating a deluge stream flow within the center of the ejected fluid stream. In addition, this embodiment includes fog teeth posts that spin when engaged by the fluid stream. Accordingly, when the fog teeth posts are positioned within the flight path of the deluge stream leaving the nozzle, the fog teeth strip away the outer portions of the deluge stream, thereby creating a fog spray. As a result, the present embodiment allows two types of streams to be ejected from a single flow path within the same nozzle. Specifically, the smooth bore constitutes a single flow path for fluid to exit the nozzle. The flow is ejected from the smooth bore as a deluge stream. However, just beyond the exit orifice from the smooth nozzle are positioned the fog teeth, which may or may not be engaged. If the fog teeth are moved by the nozzle operator to one of a plurality of positions of engagement, then both a deluge stream and a fog spray are simultaneously created. If the fog teeth are not engaged, then just a deluge stream flow is generated from the nozzle. As noted, the fog teeth are maneuverable to any one of a plurality of positions, depending upon the amount of fog spray desired. More particularly, the fog teeth may be positioned to disrupt only the very outer portions of the flow ejected from the smooth bore, thereby creating a relatively small amount of fog spray. Alternatively, the fog teeth may be positioned to disrupt all or nearly all of the flow ejected from the smooth bore, thereby creating a relatively large amount of fog spray. The fog spray may be further modified by a circumferential bell or flow shaper that serves to allow the fog spay to spread out laterally if not forwardly engaged. Alternately, the bell may be forwardly positioned, thereby forcing the fog spray into a relatively narrow dispersive pattern. These bell features are applicable to all nozzles discloses herein.

As a separate aspect of the invention, a ball valve may be fitted at the inlet or upgradient end of the smooth bore. The ball valve allows the nozzle operator to control the flow through the nozzle.

In yet a separate aspect of the invention, the ball valve may be adjusted to about a 90 degree position, thereby creating a disruption in the fluid flow into the smooth, and thus creating a kind of fog spray with large water droplets as the fluid exits the smooth bore itself. The fluid stream thus ejected may then be further modified by the fog teeth, if the fog teeth are placed in a position to engage the outer portions of the ejected fluid stream.

In yet a separate aspect of this embodiment, a turbulizer may be placed near the inlet end of the smooth bore. The edges of the turbulizer may be textured or jagged to further aid in disrupting and aspirating the flow if placed in a position of greater than 0 degrees and up to 180 degrees, where 90 degrees creates the maximum aspiration, and 0 and 180 degrees creates none or a negligible amount of disruption in the flow. (A setting of 45 degrees is essentially equivalent to a setting of 135 degrees in terms of disrupting the flow stream.) When engaged, the turbulizer creates a kind of fog spray with large water droplets as the fluid exits the smooth bore itself. The fluid stream thus ejected may then be further modified by the fog teeth, if the fog teeth are placed in a position to engage the outer portions of the ejected fluid stream. Pure deluge stream flow remains possible when desired, by setting the turbulizer to its 0 or 180 degree position. Of course, if desired, the turbulizer may be restricted to rotation between 0 and 90 degrees of rotation, whereby the 0 degree setting essentially creates no disruption in the flow stream, and the 90 degree setting creates the maximum disruption in the flow stream.

Description of Constant Flow Principle

Overview:

Dual flow nozzles of the prior art are capable of producing a fog stream pattern and/or a smooth bore pattern. (The two flows can be independent or simultaneous).

Normally, fire nozzles are attached to hoses which are fed water by a pump. The pressure at the nozzle inlet will govern the amount of flow in gallons per minute (GPM) that will be expelled from the nozzle. The inlet pressure to the nozzle is a function of the relationship between the area(s) of orifice through which the water is expelled and the pump rate. For example, if the exit orifice increases while the pump rate is maintained, the inlet pressure will drop. The GPM will increase due to the increased area of the exit orifice. However, this GPM increase will be tempered by the decrease in inlet pressure. In another example, the exit orifice is held by a constant area and the pump rate is increased. In this example, the flow (GMP) will increase due to the increase in nozzle inlet pressure.

Dual flow nozzles of the prior art are subject to changes in GPM when various combinations of flow types are selected. A nozzle flowing water through just the smooth bore tip will experience difficulties once the second fog tip is engaged. Once the second tip is engaged, the exit orifice is immediately enlarged (combination of the exit orifice of the smooth bore and that of the fog tip). The pump rate, remaining unchanged, is now inadequate to maintain the inlet nozzle pressure. This results in a nozzle, which flows more water, but lacks the pressure to expel the water with effective reach. The pump operator will/should eventually notice the loss in pressure. He/she will then increase the pump rate to re-build pressure. Once this occurs, the nozzle operator will have a difficult task. The reach is restored, but the GPM has now increased again due to the increase in pressure. The nozzle operator will now have to overcome the additional force to hold onto the nozzle. If the nozzle operator then shuts off one tip, the pump rate which has not yet been adjusted down, will cause an immediate and unsafe increase in inlet pressure.

Fog tip orifices are donut shaped and smooth bore orifices are a simple round hole.

The 3 Series Solution:

This design maintains a constant orifice size and shape. This obviously maintains constant hydraulics. Flow selection and shaping is done after the water has been expelled by this orifice.

Summary

The 3 series design achieves constant hydraulics when selecting 1 or 2 tips. The specific mechanical means of doing so may not be limited to this design. The principle of adjusting the exit orifice to maintain constant hydraulics is unique.

In a separate embodiment, a selectable smooth bore hose nozzle apparatus is described. The following description and drawings cover a smooth bore only nozzle. Specifically, a smooth bore that allows firefighters to manually maintain desired nozzle inlet pressure as well as a means to increase/decrease the flow rate in gallons per minute (GPM) when desired without stopping and changing tips.

Smooth bores of the prior art are simple, conical lengths of pipe. To change the GPM of these nozzles, one would have to perform one of two undesirable tasks:

1. Increase/decrease the nozzle inlet pressure by calling for more/less GPM from the pump. This would alter the GPM but undesirably change the reach, stream quality and nozzle reaction (force required to hold back the nozzle).

2. Shut down the nozzle and change the tip with a larger/smaller orifice; and communicate to the pump operator to provide the appropriate GPM, which corresponds to the tip size and desired nozzle inlet pressure. This level of coordination is difficult to achieve at a fire scene, plus it can be unsafe to temporarily shut off the nozzle.

Description of the Figures

Figure 50:
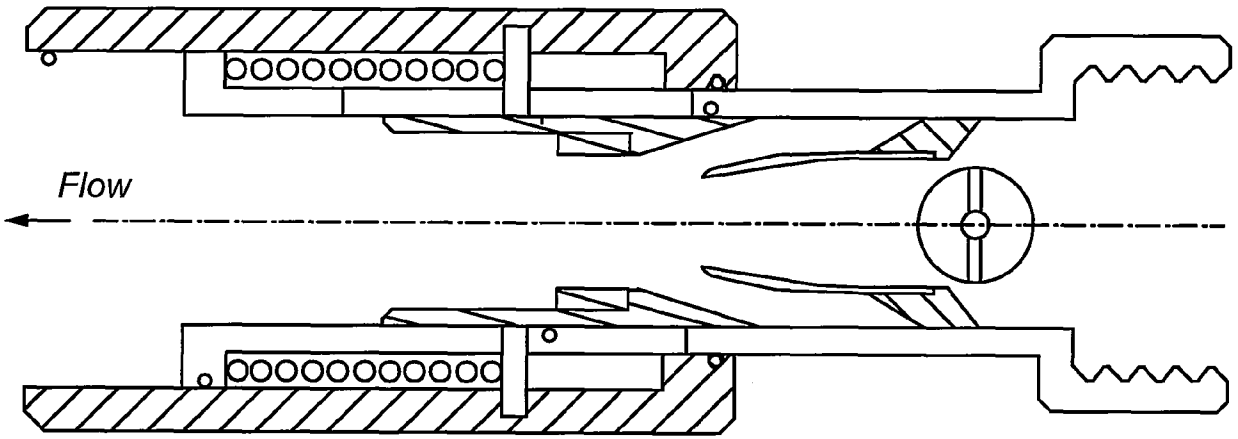
FIGS. 50-57*a* illustrate various views of different aspects and embodiments of a smooth bore barrel nozzle.

Water can flow through the small bore and large bore simultaneously (FIG. 50). The small bore is fixed and always open if the on/off valve (not shown) is on. The sliders proximately to the fixed, small bore form the large bore. This nozzle, like all smooth bores operates best at nozzle inlet pressure between 50 and 70-psi. I have selected 60 psi as the optimum inlet pressure for this nozzle. Therefore, the upstream profile (area in inches) of the slider times 60 psi equals the force of the pre-loaded spring acting upon the slider in a direction opposite the flow of water. The spring's left end is fixed, while its right end is allowed to move. This movement pushes against the pegs, which are positioned through slotted holes of the nozzle body and anchored into the slider. Further, the pegs ride in a spiral groove of the bell ID. When the bell is rotated counterclockwise (looking at the outlet end of the nozzle), the slider will move to the left and increase the area of water discharge. When the bell is rotated clockwise, the slider moves to the right and decreases the area of water discharge. This increases and decreases the GPM, respectively.

Figure 51:
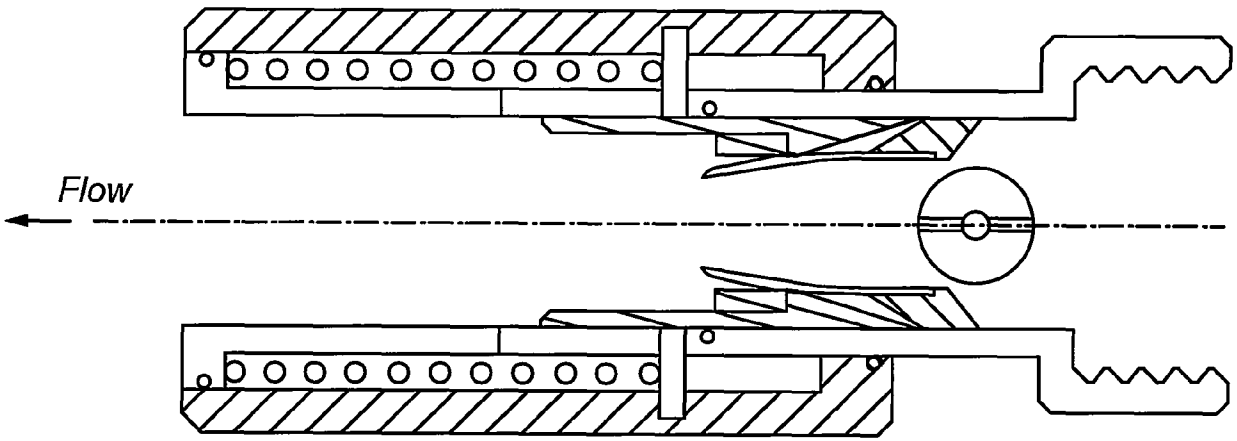

When the pump supplies the appropriate GPM, just the small bore will expel water (FIG. 51). A nozzle inlet pressure of 60 psi will also be achieved. Rotating the bell counterclockwise will be progressively more difficult it this situation—a good thing. This movement would increase the area of discharge. If this were done without changing the pump rate, the inlet pressure would drop. The lower pressure would no longer be in equilibrium with the opposite force exerted by the spring. Rotation of the bell will be difficult. Again, this is good since it will let the firefighter know that there is insufficient water supply to increase the area of discharge. The inadequacy of the supply would negatively impact reach and stream quality if the firefighter continues to increase the exit orifice.

As the pump rate is increased, the inlet pressure will begin to rise. This rise in pressure will allow the firefighter to easily rotate the bell counterclockwise and appropriately increase the exit orifice and therefore the GPM, while returning the inlet pressure to the target 60 psi.

The clutch is used when the firefighter wants to "flush" water-borne debris out of the nozzle. The clutch is ordinarily in the setting depicted in FIG. 51. The clutch is shaped like the fins of a dart. In the normal setting, the fins are aligned with the direction of flow. These fins create a wall affect in the center of the flow, which matches the wall affect of the ID of the small bore. The result is a column of water with more evenly matched velocity across the water column section. This uniformity of velocity improves the stream quality, as the expelled water tends to stay together and fragment less. When the firefighter turns the control knob (not shown) of the clutch 90 degrees, the fins are perpendicular to the flow. This blocks off the inlet to the small bore therefore minimizing the area of discharge. The decrease in exit orifice causes the inlet pressure to surge higher. This will allow the firefighter to easily turn the bell counterclockwise and allow the large bore to "flush" (the small bore is in continuous flush via its fixed design. Once finished, the firefighter returns the clutch to its normal position. The nozzle inlet pressure will now be lower than the target 60 psi and the firefighter can easily turn the bell clockwise, shutting off the large bore.

When more flow is desired, the firefighter communicates this desire to the pump operator. The increase in pump rate will increase the nozzle inlet pressure. The firefighter will then be able to easily rotate the bell counterclockwise to increase the GPM and return the nozzle inlet pressure to the target of 60 psi.

IV Automatic Smooth Bore:

The following description and drawings cover a smooth bore only nozzle. Specifically, a smooth bore that automatically maintains desired nozzle inlet pressure as well as a means to increase/decrease GPM (when desired) without stopping and changing tips.

Description of the Figures

Figure 52:
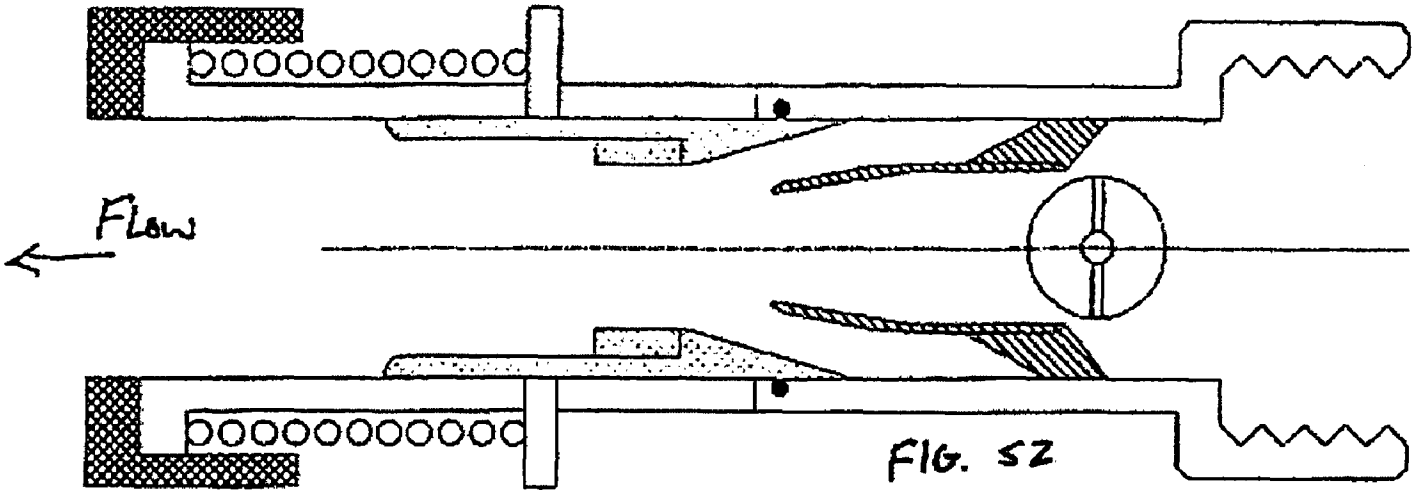

Water can flow through the small bore and large bore simultaneously (FIG. 52). The small bore is fixed and always open if the on/off valve (not shown) is on. The sliders proximately to the fixed, small bore form the large bore. This nozzle, like all smooth bores operates best at nozzle inlet pressure between 50 and 70-psi. I have selected 60 psi as the optimum inlet pressure for this nozzle. Therefore, the upstream profile (area in inches) of the slider times 60 psi equals the force of the pre-loaded spring acting upon the slider in a direction opposite the flow of water. The spring's left end is fixed, while its right end is allowed to move. This movement pushes against the pegs, which are positioned through slotted holes of the nozzle body and anchored into the slider. The bell has been removed. Now the slider can automatically respond to changes to pump rate. The response will come in the form of immediate equilibration and maintenance of the target nozzle inlet pressure of 60 psi.

Figure 53:
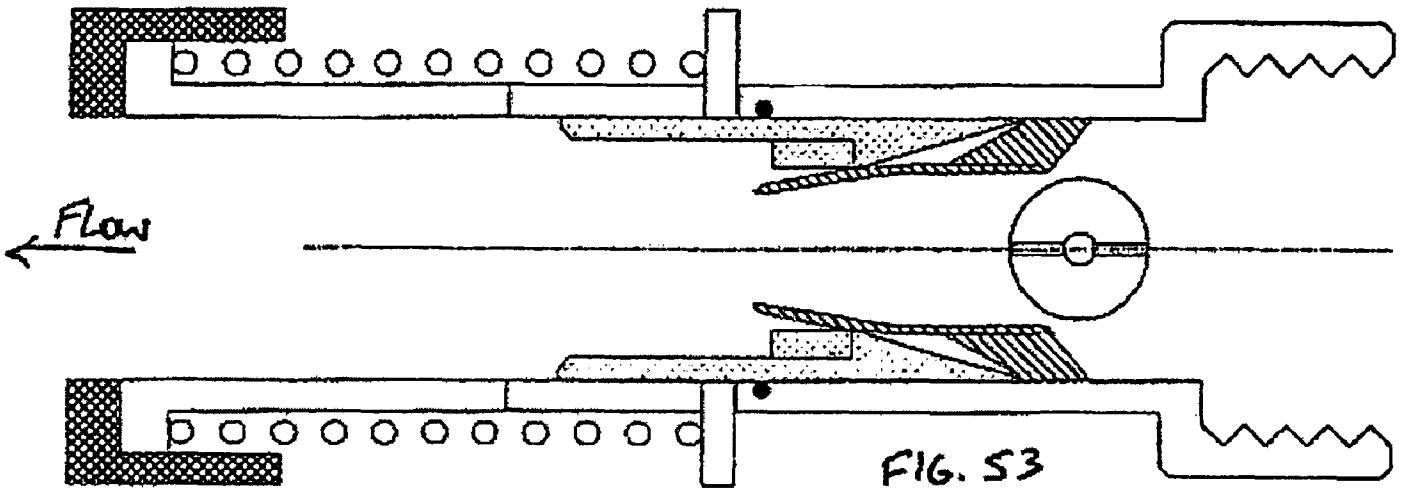

When the pump supplies the appropriate GPM, just the small bore will expel water (FIG. 53). A nozzle inlet pressure of 60 psi will also be achieved. An increase in pump rate will cause the slider to move to the left. This movement will increase the exit orifice thereby maintaining nozzle inlet pressure at 60 psi. If the pump rate decreases, the slider will automatically move to the right, decrease exit orifice and maintain target nozzle inlet pressure.

Operation of the clutch remains consistent with the Selectable Smooth Bore design.

Figure 54:
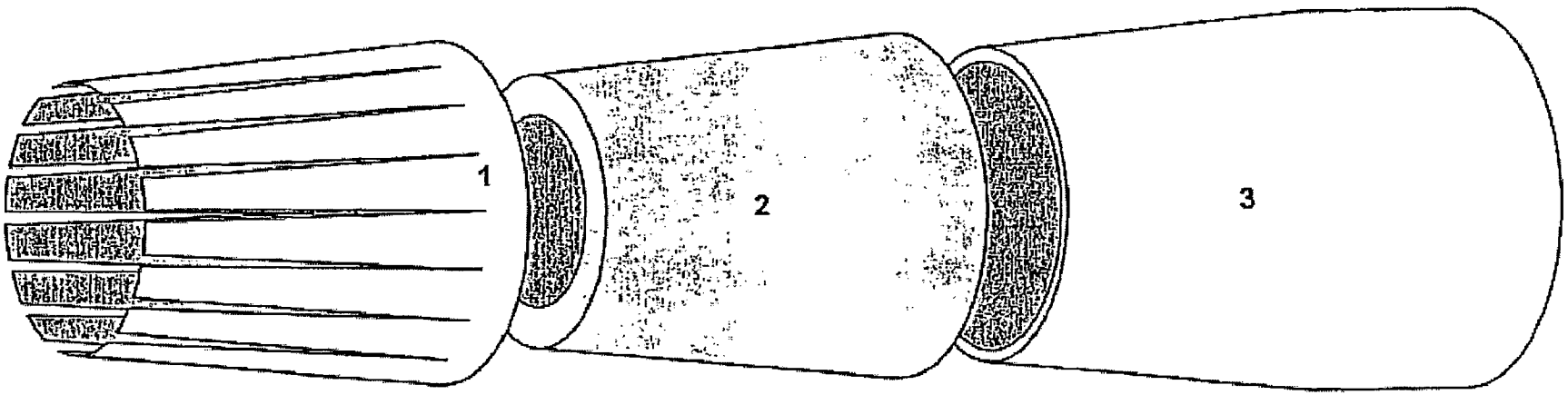

Alternate Selectable Smooth Bore and Automatic Smooth Bore:

The following are design(s) for an improved smooth bore fire nozzle that are useful for decreasing/increasing the GPM of the nozzle without altering the nozzle inlet pressure (FIG. 54). This constant pressure will minimize the change in nozzle reaction (force required to hold back the nozzle) vs. fixed exit area smooth bore nozzles when the GPM is varied. Furthermore, stream quality and reach will not be impacted as the GPM is varied.

Figure 54A:
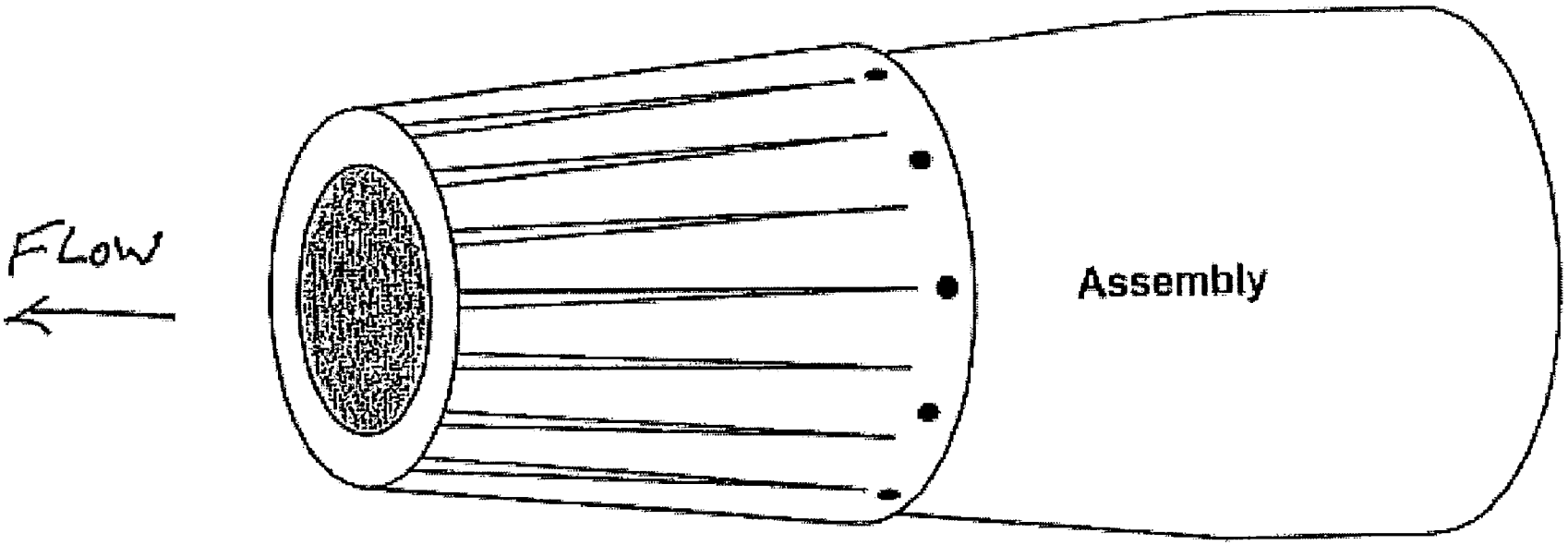

As depicted in FIG. 54, component 1 is a springy, non-rusting material such as stainless spring steel. It is tapered and has numerous, triangular sections cut horizontally from the left end. Component 2 is an elastic, water impervious material such as rubber and is also tapered. Its taper ideally matches that of 1, though this is not necessary. Component 3 is a rigid, non-rusting member suitably adapted on its right end (inlet end) for connection (usually threaded; not shown) to a hose (water supply). The outlet end of 3 is tapered to match and mate with 1&2. Component 1 is slipped over 2 and together they are riveted (or some other water-tight means of attachment) to 3. This then forms the throttle assembly. The assembled components are shown in FIG. 54*a*.

In this embodiment the nozzle will operate as an automatic smooth bore. The left end (outlet) of the assembly remains able to expand/constrict due to the ability of component 1 to increase/decrease its outlet diameter and the elasticity of component 2. For example, given a target nozzle inlet pressure of 60 psi, this nozzle will automatically expand/constrict its exit orifice area and equilibrates at this nozzle inlet pressure. An increase in GPM will cause the outlet to expand while a decrease in GPM will cause the outlet to constrict—both movements continuing until equilibrium is reached with a nozzle inlet pressure equal to 60 psi. This is achieved by matching the closing force of the assembly (additive forces of component 1's stainless spring steel plus the elasticity of component 2) with the opposing force caused by the nozzle inlet pressure, witch has a tendency to increase the area of the exit orifice. Once this equilibrium is achieved the throttle is "matched". The force required for the outlet end to expand can be modified by many means, such as the wall thickness of components 1 and 2 and the individual properties of the selected materials. This will facilitate the matching process.

This smooth bore embodiment automatically maintains the desired nozzle inlet pressure as well as provides a manual means to increase/decrease GPM (when desired) without stopping and changing tips.

Figure 55:
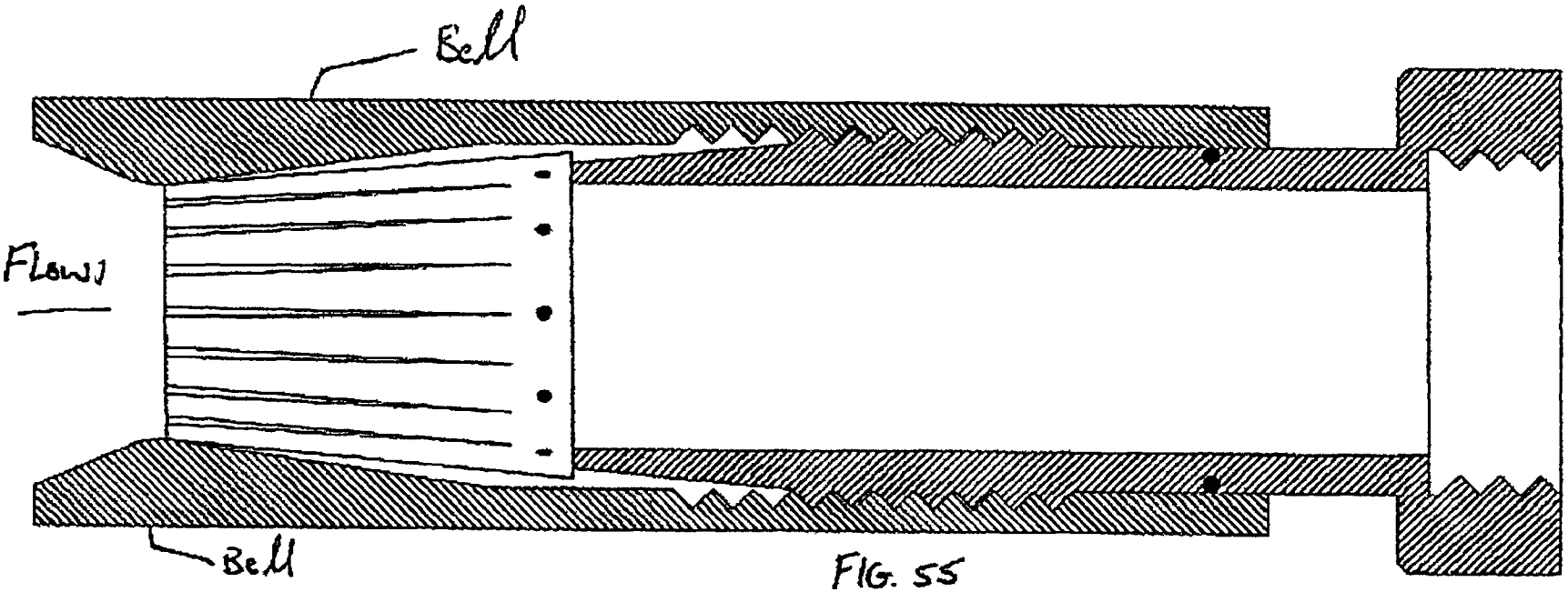
Figure 56:
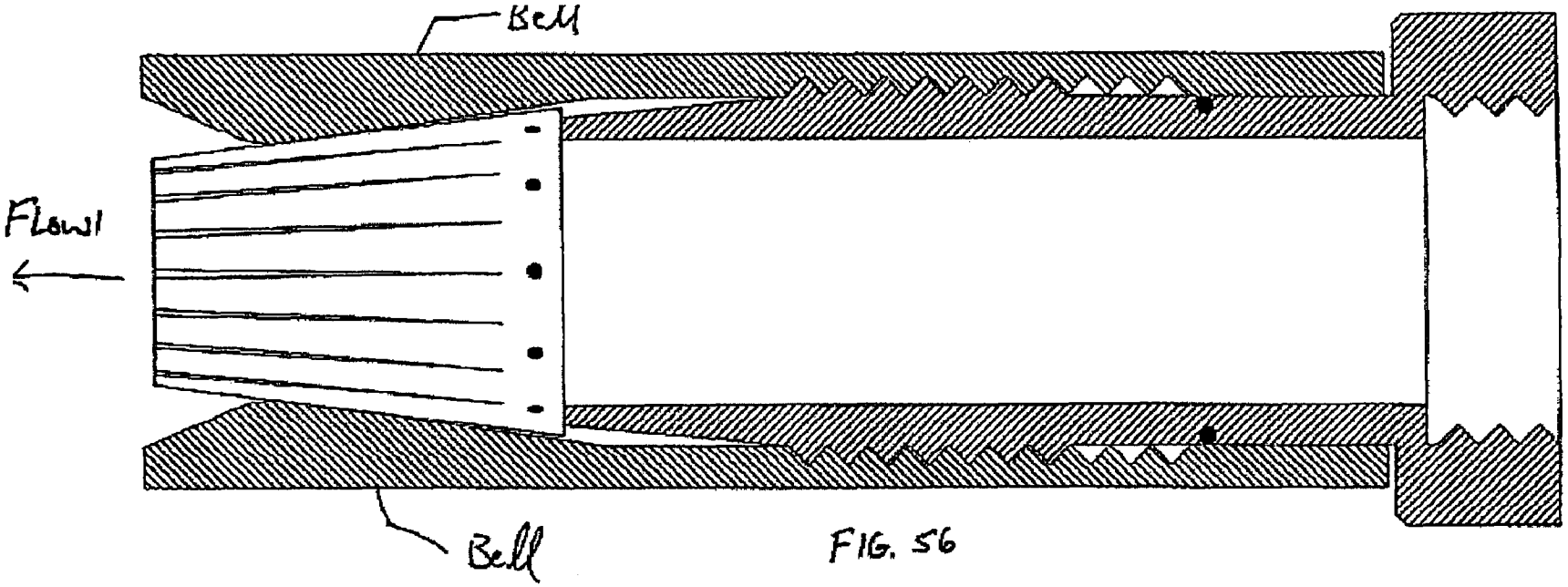

The throttle assembly can be bounded by a rotating outer body (bell; shown in FIGS. 55 and 56). This embodiment will cause the nozzle to operate as a selectable smooth bore. This will allow the nozzle operator to adjust the GPM of the nozzle within the limits of the available water supply.

In FIG. 55, the throttle assembly's discharge end (left end) is in its most open position. The exit orifice area is the greatest in this position. The supply water pressure exerts force along the assembly's ID. This force spreads the discharge end of the assembly against the ID of the bell, which limits the expansion of the throttle assembly. The bell is in its most forward position. If the throttle is "matched" then the throttle assembly will only expand if a nozzle inlet pressure is in excess of 60 psi. If the available water supply generates a nozzle inlet pressure less than 60 psi, the throttle assembly will not expand though the bell is rotated forward. This prohibits the firefighter from adversely impacting the reach and stream quality, if the bell is left full open when there is an insufficient water supply. With a sufficient water supply, a nozzle inlet pressure of 60 psi will be maintained. If the nozzle is purposefully not "matched" the firefighter will be able to increase the exit orifice and therefore the GPM whether or not the water supply can maintain a nozzle inlet pressure of 60 psi in the full open position. This is strictly a matter of preference for one type over another. Both types are possible with this one design.

In FIG. 56 the bell has been rotated to its most aft position. The contoured ID of the bell forces the throttle to its most closed position. This minimized the area of the exit orifice. The flight of threads which mate the bell with the nozzle body are sufficiently fine to allow easy bell rotation yet sufficiently coarse to allow for quick bell movement.

This selectable smooth bore allows firefighters to manually maintain desired nozzle inlet pressure as well as a means to increase/decrease GPM (when desired) without stopping and changing tips.

Figure 57:
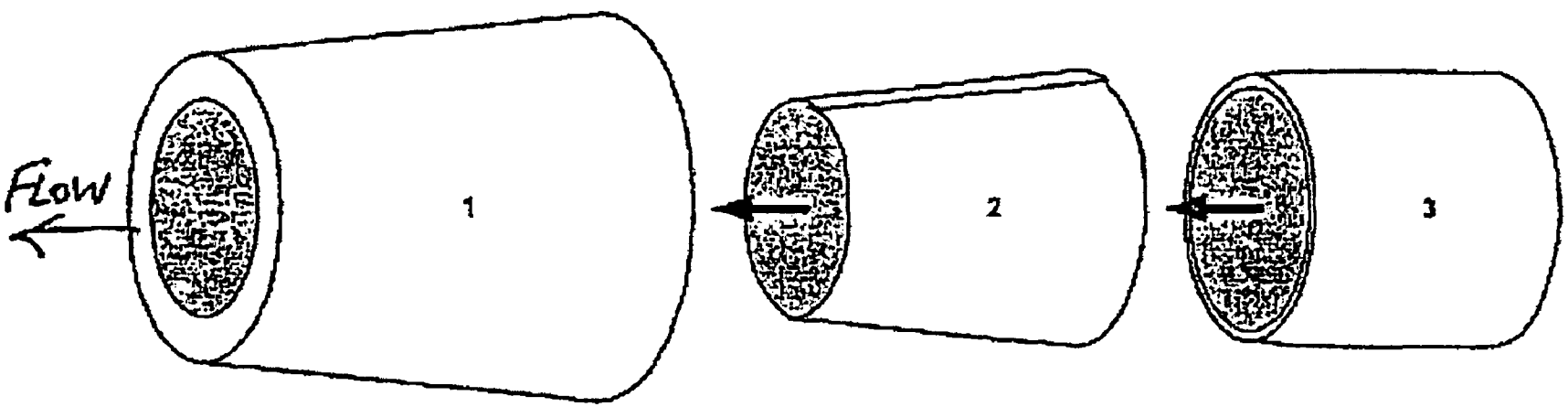

Alternate Automatic Smooth Bore:

FIG. 57 depicts a smooth bore nozzle that maintains a constant operating pressure despite an increase in GPM from the water supply (pump).

Figure 57A:
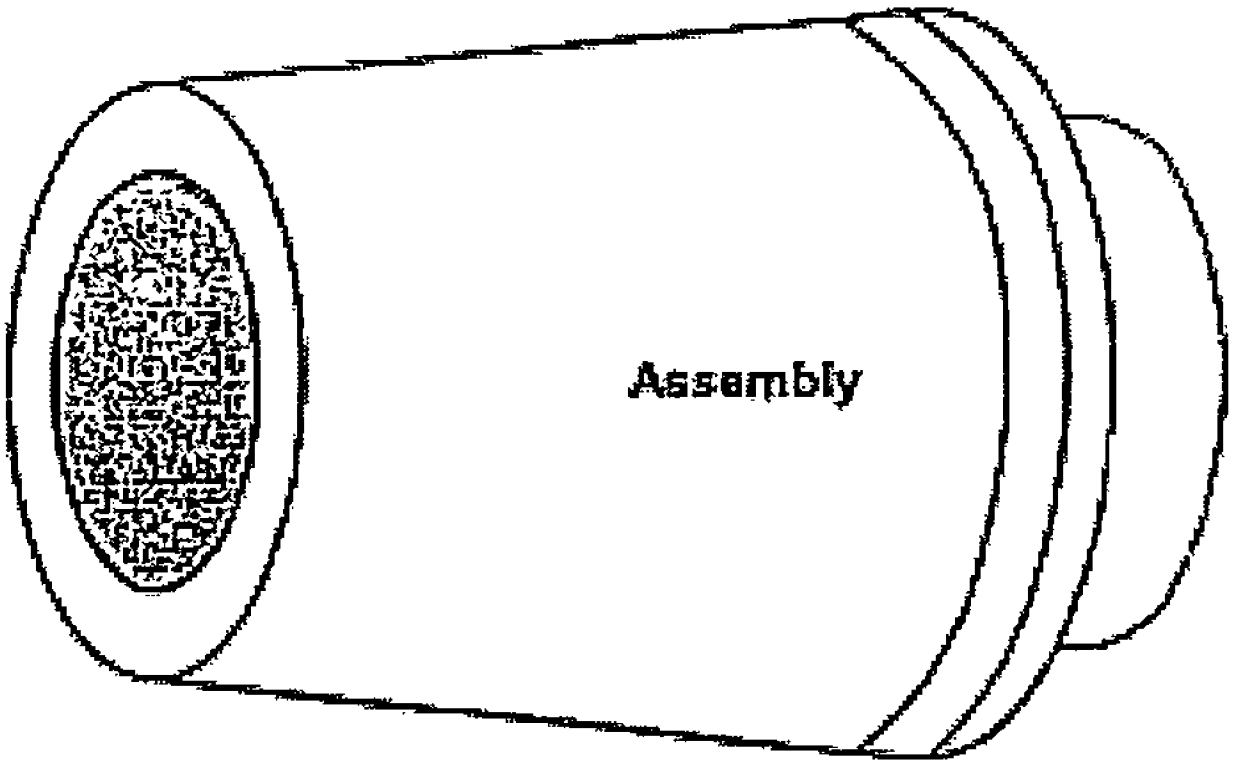
Figure 58:
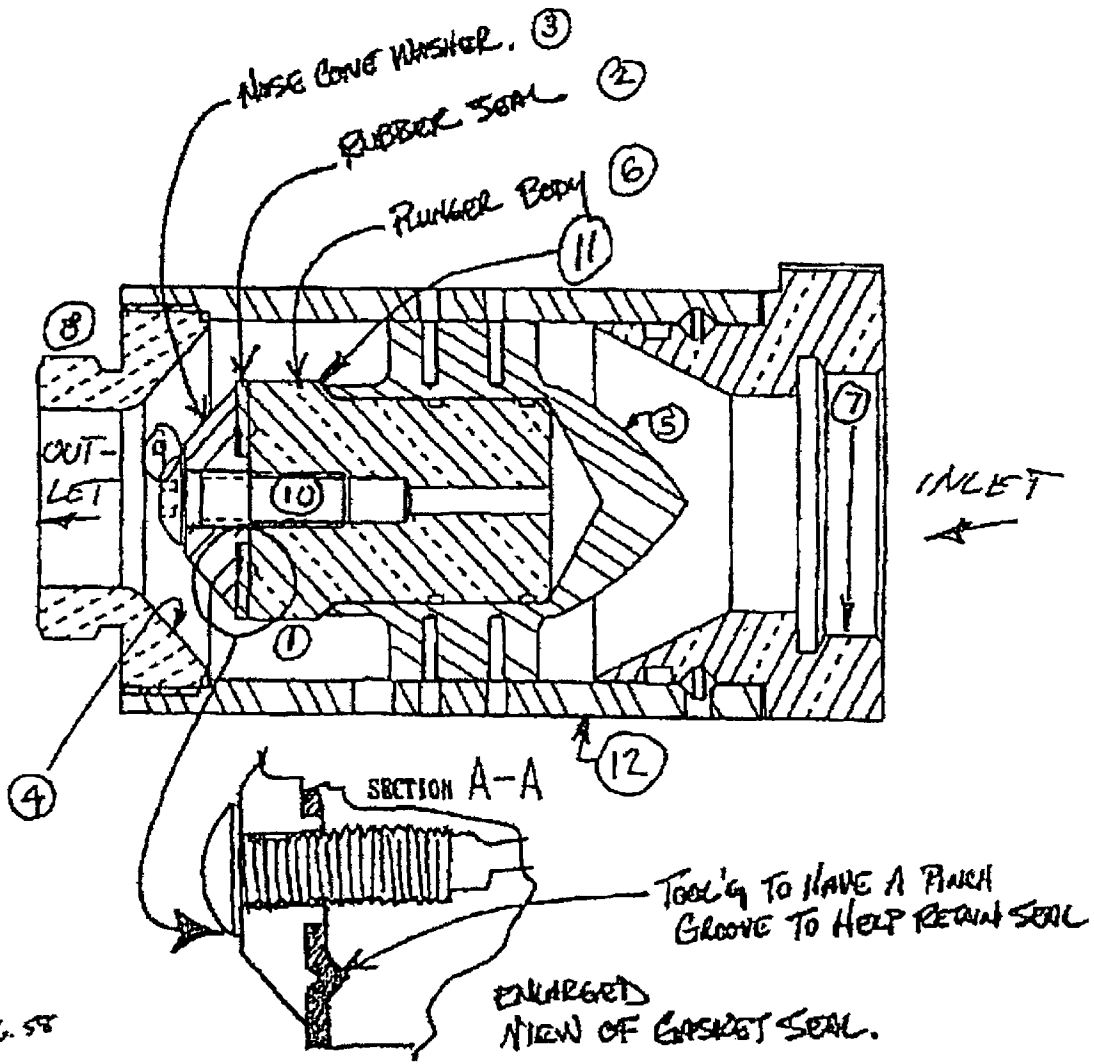
FIGS. 58-64 illustrate various views of different aspects and embodiments of a metering valve/nozzle.
Figure 59:
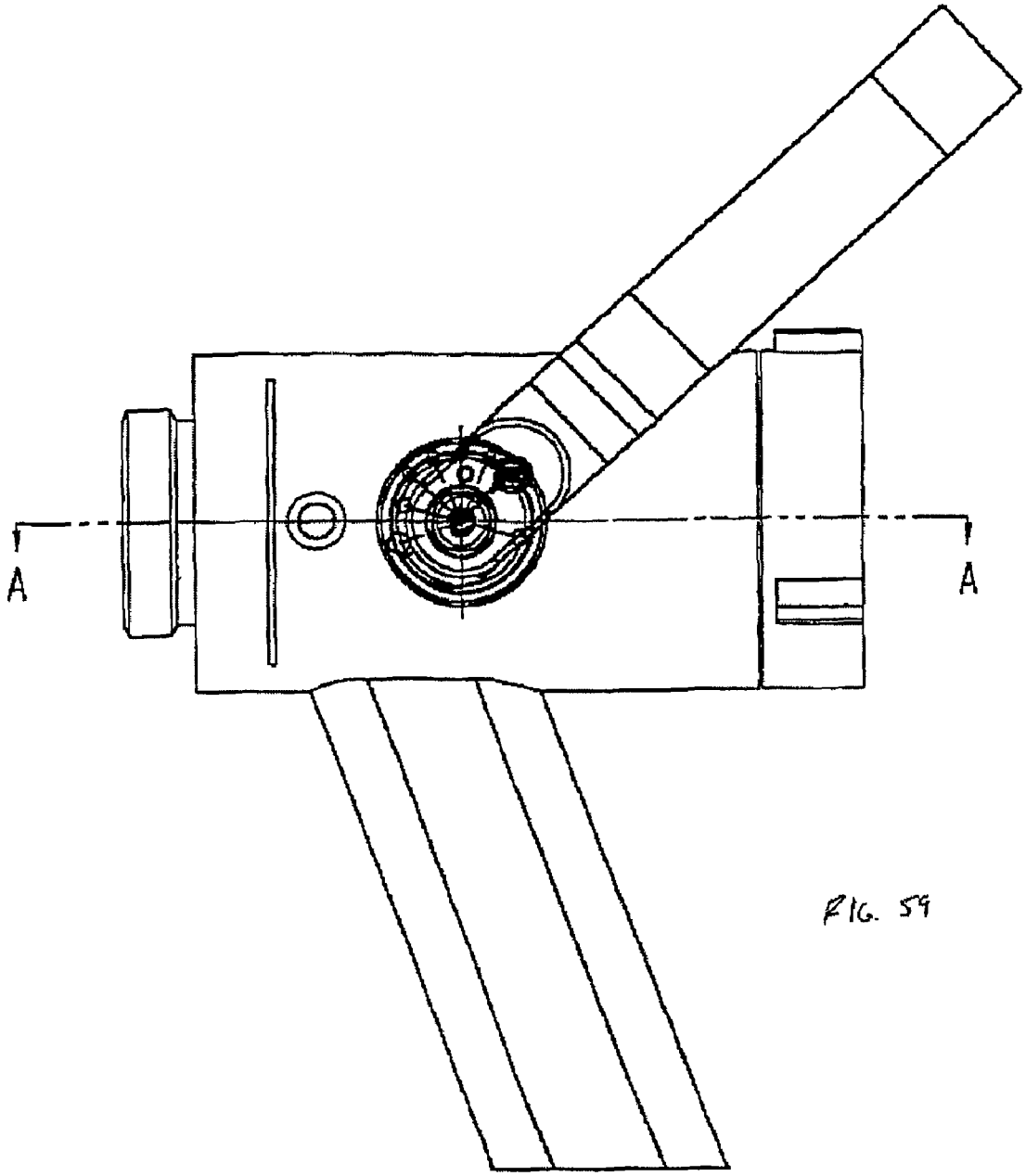
Figure 60:
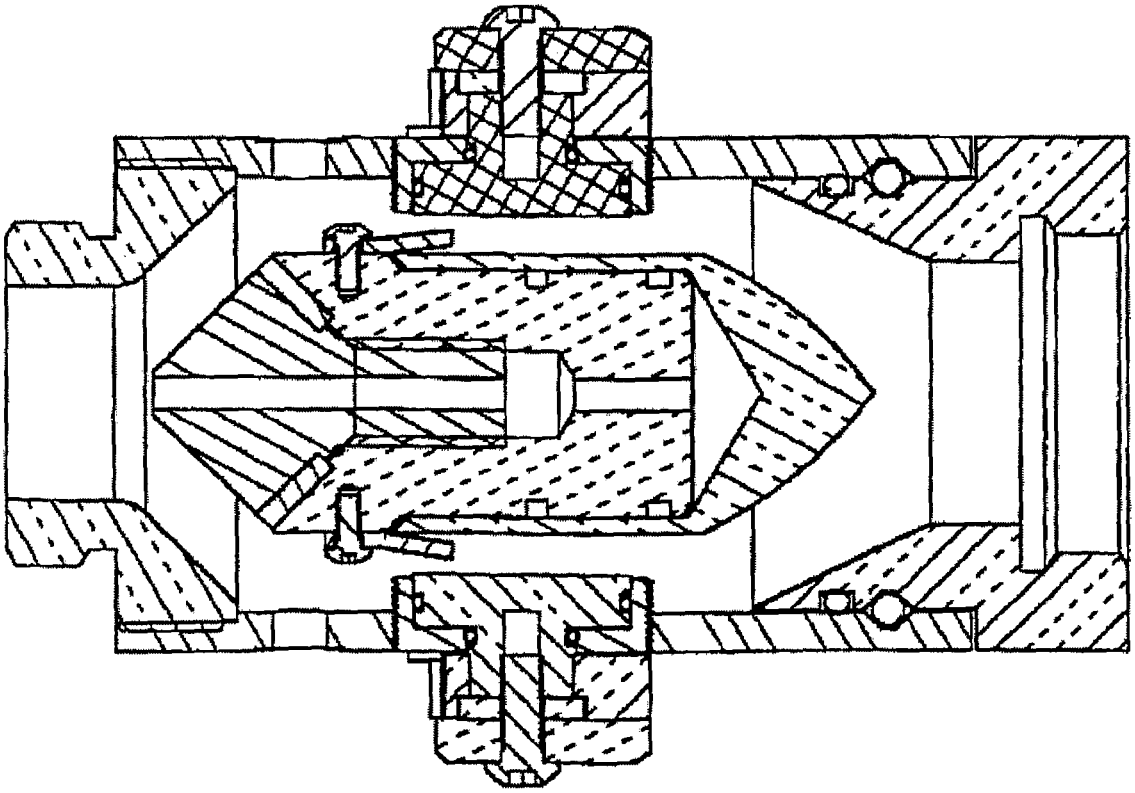
Figure 61:
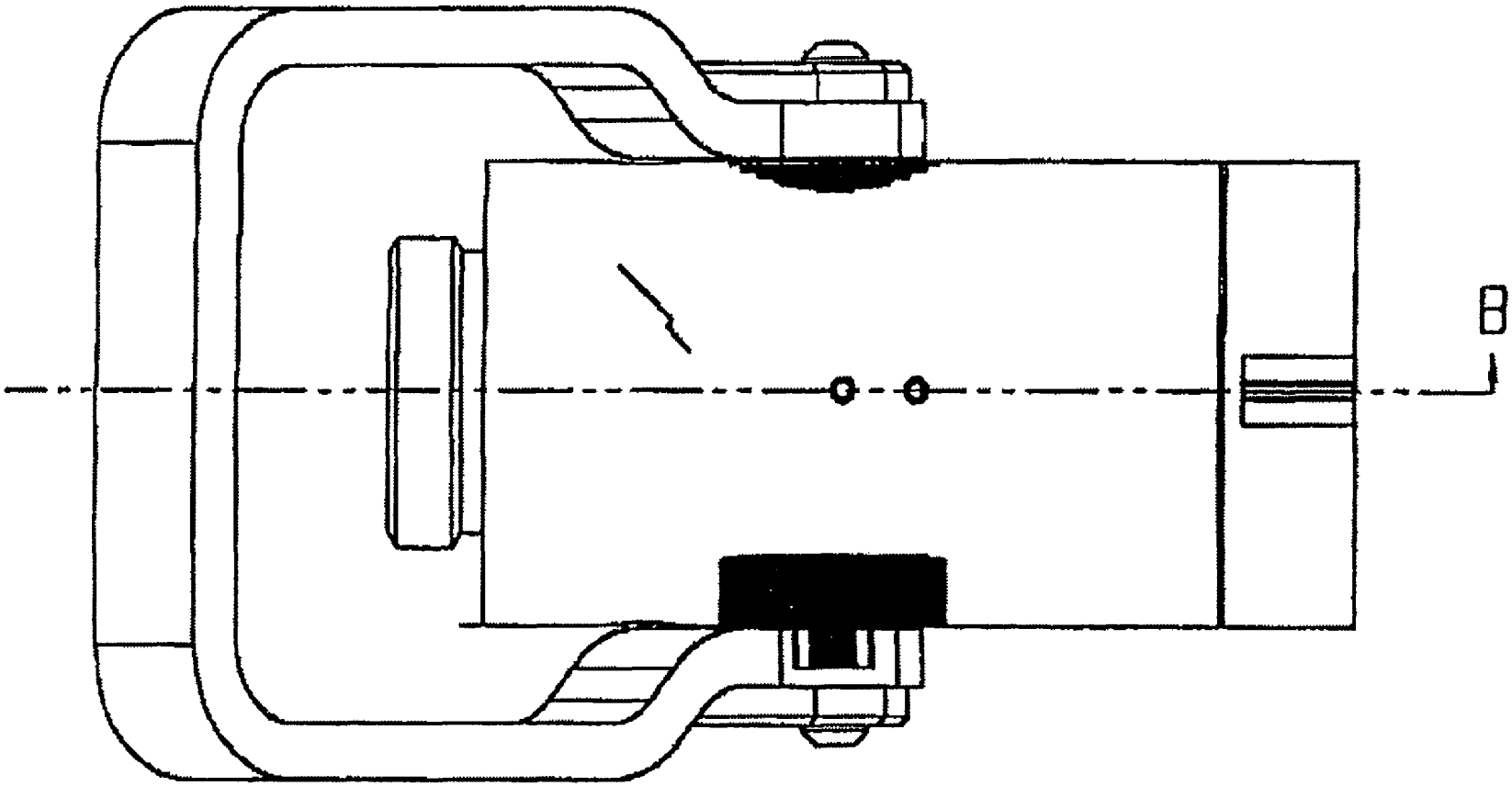
Figure 62:
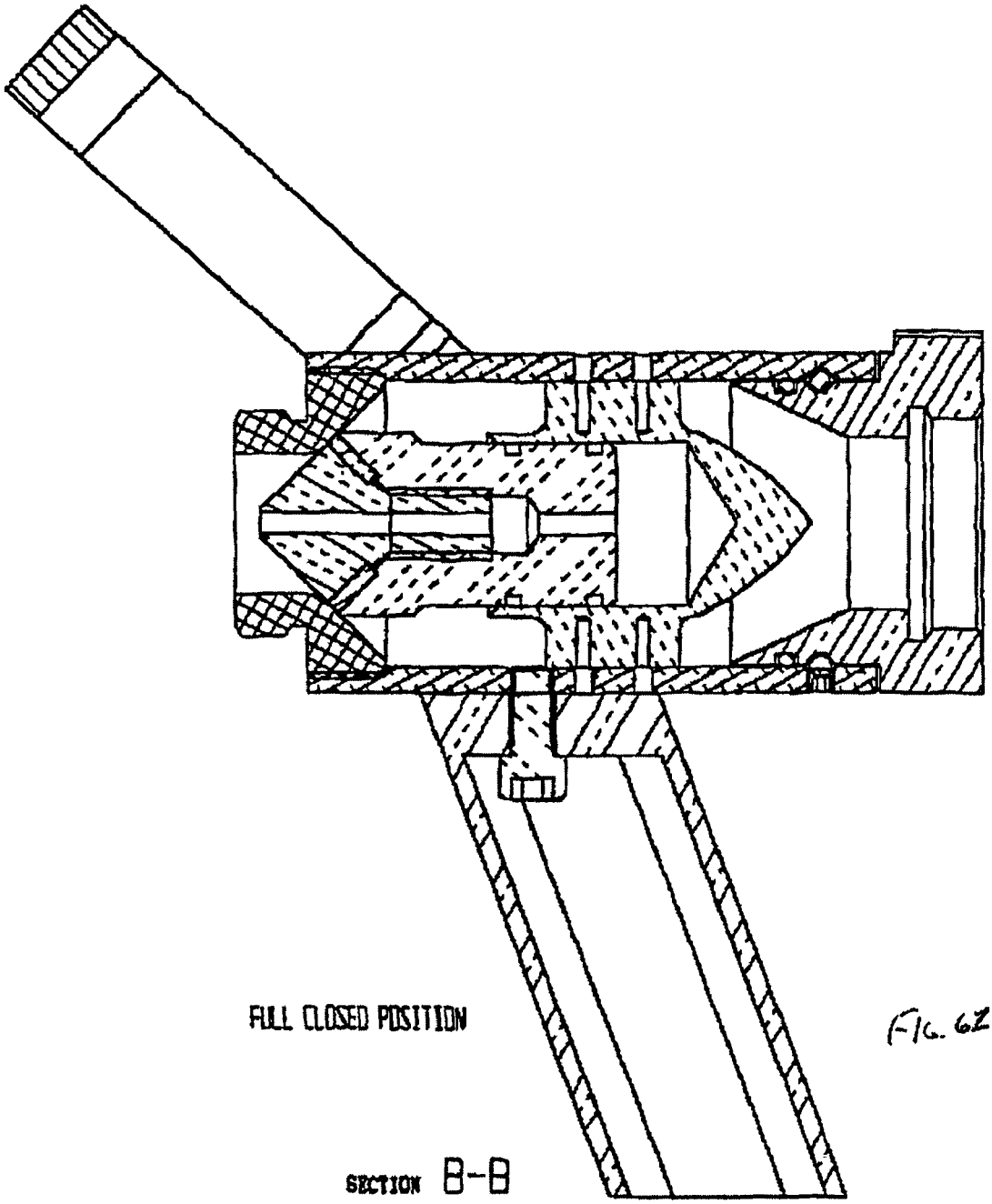
Figure 63:
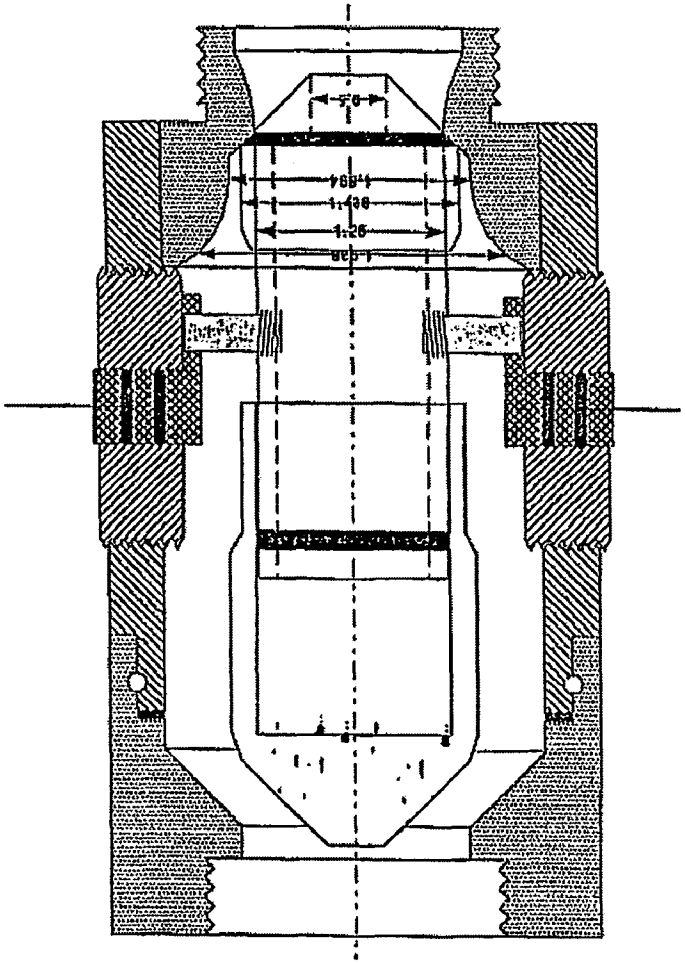
Figure 64:
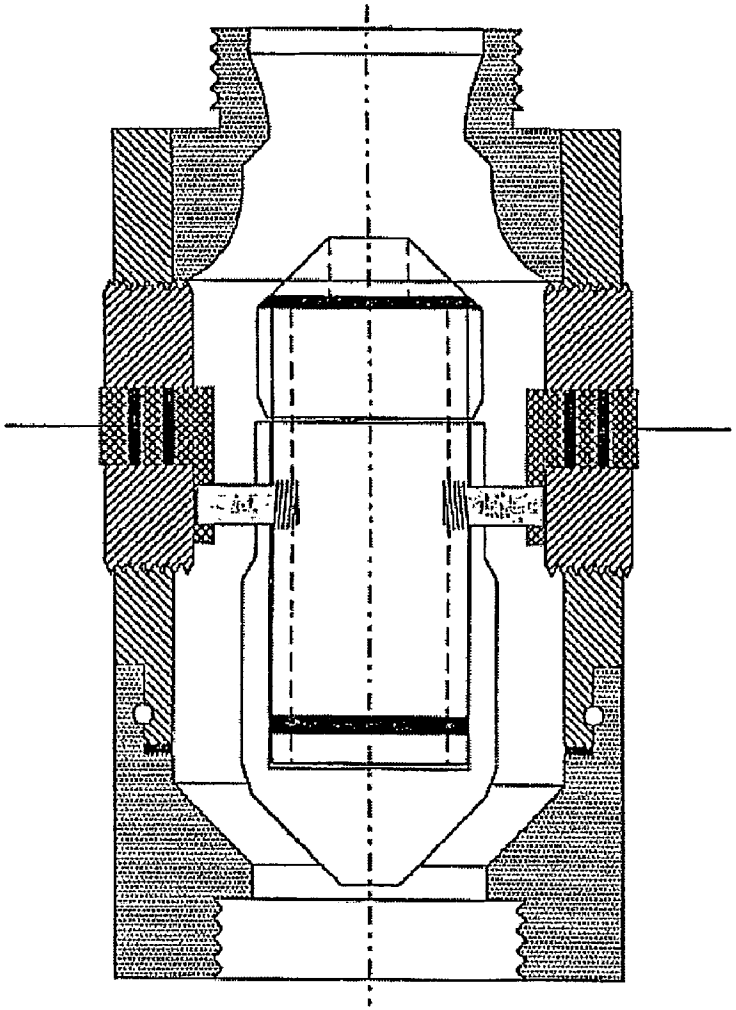

Component 1 is an elastic, water impervious material such as rubber. Component 2 is a rigid, springy, non-rusting material such as stainless spring steel. Component 3 is a rigid, non-rusting member suitably adapted for connection (usually threaded) to a hose (water source). Components 2 and 3 are rigidly connected by a means such as welding to each other. They are then inserted into 1. A band is added to create a water-tight seal between 1 and the body of 3. This assembly is the automatic smooth bore. The right end (larger diameter) is the inlet. The left end (outlet) of the assembly remains able to expand due to the elasticity of component 1 and the ability of component 2 to uncoil. The force required for the outlet end to expand can be modified by many means, such as the wall thickness of components 1 and 2 and the individual properties of the selected materials. The assembled components of FIG. 57 are shown in FIG. 57*a*.

For the following example, the force required for the expansion of the outlet end will be a force equal to 60 psi at the inlet end of this nozzle. This inlet pressure is customary for smooth bore nozzles and will produce a solid, straight stream of sufficient reach. A pump at the other end of the hose will supply the water at variable GPM. The GPM of the pump is slowly raised until an inlet nozzle pressure of 60 psi is reached. This is the minimum operating GPM for the nozzle. From this point the pump will once again increase the GPM supply. This will cause the discharge end of the nozzle to expand, allow more GPM to be expelled and maintain the 60 psi nozzle inlet pressure equilibrium. By maintaining this operating pressure despite the increase in GPM, the nozzle reaction (force required to hold back the nozzle) is minimized compared to fixed discharge orifice smooth bore nozzles. Also the reach and stream quality remain unchanged.

In a separate embodiment, a metering valve invention is described. The text pertaining to the metering valve corresponds to illustrations provided FIGS. 58-64. A prior art design has water flowing through the interior of a sliding tube and then around a rigidly mounted, solid sealing surface down the middle of the waterway. This means that water first starts down the center of the waterway and then is moved to the perimeter of the waterway. The present embodiment of the invention operates just the opposite. Water starts its journey by moving around a rigidly mounted body in the center of the waterway and then is allowed to flow down the center of the waterway. This allows this valve to be used with smooth bore nozzles and still get a good stream quality.

Smooth bore nozzles are very susceptible to poor flow quality due to obstructions in the middle of the waterway. By leaving the water in the center of the waterway, once past the valve, one embodiment of the current invention produces acceptable stream quality with smooth bores. In comparison, a prior art design leaves an object in the middle of the waterway once the valve is past and therefore upsets the stream quality more for smooth bores.

Automatic nozzles have a spring loaded baffle at the exit end of the nozzle. This baffle is spring-biased to keep the exit orifice minimized. The baffle moves outward in reaction to increase in upstream pressure, thereby increasing the area of the exit orifice and allowing more water to be expelled thus maintaining near constant pressure upstream. This device in cooperation with the slider valve allows the nozzle operator to control the GPM rate. The operator opens up the valve to allow the desired rate of flow to pass. The baffle opens in response to this volume/pressure relationship to maintain pressure and therefore stream quality. Automatic nozzles, unlike smooth bores are not effected by components in the center of the waterway such as the baffle.

One embodiment of the metering valve invention can be used on selectable and fixed nozzles. Selectable GPM nozzles rely on a separate manual control for increasing/decreasing exit orifice area to regulate the flow and a separate ball valve to turn on/off the nozzle. The fixed nozzle has just one exit orifice area so GPM will be determined by supply pressure only. If these style tips were connected to the metering valve, they would achieve easier flow regulation (flow regulation performed by the nozzle operator with just one control, the handle of the valve, and not the separate control ring of the selectable types or the pumper operator in the case of the fixed type).

Referring now to FIGS. 58-64, the following numbers refer to reference numerals shown on the figures:

1. This is the shoulder of the plunger body where mechanical linkage (not shown) is affixed. This linkage is connected to the manual handle operation in a way identical to that of the handle operation of the "twin tip". Moving the handle forward moves the plunger body forward. This direction of travel will decrease the amount of flow and the opposite direction of travel increases the GPM.
2. This creates the seal against the sealing surface (4).
3. The nose cone washer minimizes the turbulence of the flowing water as it returns to the center of the waterway. The distance between it and sealing surface (4), in cooperation with the available water pressure defines the GPM rate.
4. Sealing surface. See 2 and 3.
5. Receiver for the plunger body which is rigidly mounted to the ID of the main body (12). By being rigidly mounted it prohibits movement that would otherwise be caused by the rushing water in the flow condition. The upstream surface of the receiver is streamline to avoid turbulence and direct water around itself and the plunger body.
6. Plunger body moves in and out of (5). The shoulder (1) of this body is purposely raised. This raised section allows the water pressure to push tight against the seal and prohibit leaks in the no-flow condition. The plunger body has one or two (two are shown) o-rings to create a watertight seal between itself and (5). This is necessary in the off position.

7. Female threads which connect to the hose (shown as part of a free swivel for convenience of assembly).
8. Male treads to connect to the nozzle tip (smooth bore, automatic, selectable or fixed).
9. Bolt to hold (3), (2) and (6) firmly together. This bolt has a hole (10) right down the middle of it.
10. Hole down the middle (9), (3), (2), and (6). This hole is necessary to avoid a vacuum from being created between (5) and (6) when moving from the open position to the closed position.
11. This raised shoulder of (6) is made streamline so as not to be pushed closed by the moving water in the flowing water condition. In the full open position, where GPM and therefore frictional force of rushing water is greatest, the shoulder imbeds into (5) so as to reduce its upstream profile which of course reduces force of water friction. Further resistance to closing is created by the ball detents' friction of the manual handle (not shown) and the upstream surface of the receiver (5) which directs water around itself and the plunger body.
12. Main body.

What is claimed is:

1. A method of adjusting a fluid stream in a nozzle, comprising:

providing an adjustable nozzle that has:

a nozzle body having a longitudinal central axis, said body having an inlet having a fixed inner diameter and an outlet;

a flow chamber between the inlet and the outlet;

an elastic water impervious material in fluid communication with said inlet, said material having a tapered end proximate to the fluid outlet;

an adjustable tapered non-rusting body having an outlet diameter, said adjustable tapered non-rusting body comprised of numerous, elongated sections extending along said longitudinal central axis, said adjustable tapered non-rusting body adapted to expand or constrict when said tapered body is adjusted in a fashion to either increase or decrease its outlet diameter to enable the nozzle to operate as a selectable smooth bore, said elastic water impervious material having a tapered configuration similar to that of the tapered non-rusting body;

a rigid, non-rusting member suitably adapted for connection to a water supply, and initiating a flow of fluid into a fluid inlet associated with said nozzle, the fluid inlet leading to a flow chamber, the flow chamber terminating in a fluid outlet having a variable diameter; and automatically varying the diameter of the outlet in response to variations in a flow rate, wherein the diameter of the outlet is increased in response to increases in the flow rate and the diameter of the outlet is decreased in response decreases in the flow rate;

wherein automatically varying the diameter of the outlet substantially maintains the inlet pressure at a predetermined pressure.

2. The method of claim 1, wherein the step of automatically varying the diameter occurs only for flow rates above a threshold flow rate, wherein the threshold flow rate is defined as a flow rate below which an inlet pressure of less than or equal to a predetermined pressure is present at the inlet when the outlet nozzle is at a minimum diameter, wherein for flow rates below the threshold flow rate, the diameter of the outlet is maintained at the minimum diameter.

3. The method of claim 2, wherein the predetermined pressure is 60 psi.

4. The method of claim 1, wherein initiating the flow of fluid includes withdrawing a plunger body from a forward most position of a plunger body positioned in the flow chamber, wherein in the forward most position, the plunger body provides a seal that prevents fluid from passing beyond the plunger body.

5. The method of claim 4, wherein the plunger body is movable within a plunger body receiver between the forwardmost position and a rearwardmost position, the plunger body receiver including a tapered end operable to divert fluid around the plunger body receiver and the plunger body.

6. The method of claim 4, wherein the predetermined pressure is 60 psi.

7. The method of claim 1, further comprising:

moving a nozzle bell between an open and a closed position, wherein in the open position the inner diameter of the longitudinal flow chamber is allowed increase, and wherein in the closed position the inner diameter of the longitudinal flow chamber is not allowed to increase.

8. The method of claim 7, wherein moving the bell includes rotating the bell between a forwardmost position corresponding to the closed position and a rearwardmost position of the bell corresponding to the open position.

9. The adjustable nozzle according to claim 1, wherein said numerous, elongated sections extending along said longitudinal central axis, flex in response to fluid pressure in said passageway.

10. An adjustable nozzle comprising:

a nozzle body having a longitudinal central axis, said body having an inlet having a fixed inner diameter and an outlet;

a flow chamber between the inlet and the outlet;

an elastic water impervious material in fluid communication with said inlet, said material having a tapered end proximate to the fluid outlet;

an adjustable tapered non-rusting body having an outlet diameter, said adjustable tapered non-rusting body comprised of numerous, elongated sections extending along said longitudinal central axis, said adjustable tapered non-rusting body adapted to expand or constrict when said tapered body is adjusted in a fashion to either increase or decrease its outlet diameter to enable the nozzle to operate as a selectable smooth bore, said elastic water impervious material having a tapered configuration similar to that of the tapered non-rusting body; and a rigid, non-rusting member suitably adapted for connection to a water supply.

11. The adjustable nozzle of claim 10, further comprising:

a nozzle bell having an open and a closed position, wherein in the open position the inner diameter of the longitudinal flow chamber is allowed to increase, and wherein in the closed position the inner diameter of the longitudinal flow chamber is not allowed to increase.

12. The adjustable nozzle of claim 11, wherein moving the bell rotates between a forwardmost position corresponding to the closed position and a rearwardmost position of the bell corresponding to the open position.

13. The adjustable nozzle according to claim 10, wherein said numerous, elongated sections extending along said longitudinal central axis, flex in response to fluid pressure in said passageway.

14. The adjustable nozzle of claim 10, further comprising a plunger body positioned in the flow chamber, the plunger body movable within a plunger body receiver, said plunger body receiver including a tapered end operable to divert fluid around the plunger body receiver and the plunger body.

* * * * *